US005942366A

United States Patent [19]

Ohno et al.

[11] Patent Number: 5,942,366

[45] Date of Patent: Aug. 24, 1999

[54] IMAGE FORMING METHOD EMPLOYING TONER CONTAINING HIGHER AND LOWER MOLECULAR WEIGHT POLYMER COMPONENTS

[75] Inventors: Manabu Ohno, Funabashi; Hiroyuki Suematsu, Yokohama; Akihiko Nakazawa, Kanagawa-ken; Nobuyuki Okubo, Yokohama; Shunji Suzuki, Tokyo, all of Japan

[73] Assignee: Canon Kabushiki Kaisha, Tokyo, Japan

[21] Appl. No.: 09/022,975

[22] Filed: Feb. 12, 1998

Related U.S. Application Data

[62] Division of application No. 08/220,044, Mar. 30, 1994, Pat. No. 5,744,276.

[30] Foreign Application Priority Data

| | | | |
|---|---|---|---|
| Mar. 31, 1993 | [JP] | Japan | 5-095005 |
| Jun. 29, 1993 | [JP] | Japan | 5-182205 |
| Jun. 29, 1993 | [JP] | Japan | 5-182206 |

[51] Int. Cl.[6] ..... G03G 13/22; G03G 15/08

[52] U.S. Cl. ..... 430/125; 430/126; 399/252

[58] Field of Search ..... 430/125, 126; 399/252

[56] References Cited

U.S. PATENT DOCUMENTS

| | | | |
|---|---|---|---|
| 3,941,898 | 3/1976 | Sadamatsu et al. | 430/109 |
| 4,386,147 | 5/1983 | Seimiya et al. | 430/99 |
| 4,486,524 | 12/1984 | Fujisaki et al. | 430/109 |
| 4,883,734 | 11/1989 | Ikeuchi et al. | 430/110 |
| 5,071,918 | 12/1991 | Funato et al. | 430/109 |
| 5,126,224 | 6/1992 | Hyosu et al. | 430/106.6 |
| 5,268,248 | 12/1993 | Tanikawa et al. | 430/111 |
| 5,489,498 | 2/1996 | Ohno et al. | 430/110 |

FOREIGN PATENT DOCUMENTS

| | | |
|---|---|---|
| 0501768 | 1/1987 | European Pat. Off. . |
| 0331015 | 9/1989 | European Pat. Off. . |
| 0427272 | 5/1991 | European Pat. Off. . |
| 0488413 | 6/1992 | European Pat. Off. . |
| 0519715 | 12/1992 | European Pat. Off. . |
| 56-116043 | 9/1981 | Japan . |
| 57-178249 | 11/1982 | Japan . |
| 57-208559 | 12/1982 | Japan . |
| 61-110156 | 5/1986 | Japan . |
| 62-009356 | 1/1987 | Japan . |
| 63-214760 | 9/1988 | Japan . |
| 63-217362 | 9/1988 | Japan . |
| 63-217363 | 9/1988 | Japan . |
| 63-217364 | 9/1988 | Japan . |
| 63-313182 | 12/1988 | Japan . |
| 1-15063 | 3/1989 | Japan . |
| 1-187582 | 7/1989 | Japan . |
| 2-168264 | 6/1990 | Japan . |
| 2-235069 | 9/1990 | Japan . |
| 3-72505 | 3/1991 | Japan . |

OTHER PUBLICATIONS

Patent Abstracts, Japan, vol. 14, No. 425, P–1082 (4188) May 24, 1990, JPA 02–064556 Database WPI Week 8941, Derwent Publn. AN–89–298039 of JPA 1–221–757.

*Primary Examiner*—Roland Martin

*Attorney, Agent, or Firm*—Fitzpatrick, Cella, Harper & Scinto

[57] ABSTRACT

An electrophotographic toner composition suitable for heat-fixation and showing good storage characteristics is constituted by polymer components, a colorant and a metal-containing organic compound. The toner composition shows a melt index (at 125° C., 10 kg-load) of 5–25 g/10 min., and the polymer components are characterized by (a) containing substantially no THF (tetrahydrofuran)-insoluble content, (b) including a THF-soluble content thereof providing a GPC (gel permeation chromatography) chromatogram showing i) a main peak in a molecular weight region of $2\times10^3$–$3\times10^4$, and a sub-peak or shoulder in a molecular weight region of at least $10^5$, and ii) an areal percentage of 3–10% in a molecular weight region of at least $10^6$, and (c) including a polymer component (H) in a molecular weight region of at least $10^5$ obtained by polymerization using a polyfunctional polymerization initiator and a mono-functional polymerization initiator.

52 Claims, 9 Drawing Sheets

IMAGE FORMING METHOD EMPLOYING TONER CONTAINING HIGHER AND LOWER MOLECULAR WEIGHT POLYMER COMPONENTS

This application is a Divisional of prior application No. 08/220,044, now U.S. Pat. No. 5,744,276.

FIELD OF THE INVENTION AND RELATED ART

The present invention relates to a toner for developing electrostatic images used in image forming methods, such as electrophotography, electrostatic recording and magnetic recording, and also an image forming method using the toner.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper, as desired, fixed by heating, pressing, or heating and pressing or with solvent vapor to obtain a copy. The residual toner on the photosensitive member without being transferred is cleaned by various methods, and then the above steps are repeated.

In recent years, such an electrophotographic image forming apparatus has been required to satisfy serious requirements regarding a smaller size, a smaller weight, a higher speed and a higher reliability, and accordingly a toner is required to show higher performances. For example, regarding the step of fixing a toner image onto a sheet such as paper, various methods and apparatus have been developed. Among these, the most popular is the hot pressure fixing system using hot rollers. In the heat-fixing system using such hot rollers, a sheet carrying a toner image to be fixed (hereinafter called "fixation sheet") is passed, while the surface of a hot roller having a releasability with the toner is caused to contact the toner image surface of the fixation sheet under pressure, to fix the toner image. In this method, as the hot roller surface and the toner image on the fixation sheet contact each other under a pressure, a very good heat efficiency is attained for melt-fixing the toner image onto the fixation sheet to afford quick fixation, so that the method is very effective in a high-speed electrophotographic copying machine.

However, the above-mentioned hot roller fixation system frequently used heretofore has left the following problems.

(1) There is required a so-called waiting time within which image formation is not allowed, until the hot rollers reach a prescribed temperature.

(2) It is necessary to keep the hot rollers at an optimum temperature so as to prevent fixation failure and offsetting of a toner onto the hot rollers caused by a change in hot roller temperature due to passing of recording materials or sheets (i.e., fixation sheets) or other external factors. For this purpose, it is necessary to increase the heat capacity of the hot rollers or the heating member, and this requires a large electrical power consumption and also causes a temperature increase in the image forming apparatus.

(3) As the rollers are at a high temperature, the toner on the recording sheets having passed and discharged out of the rollers is cooled slowly to retain a high viscosity for a substantial time, so that the toner is liable to cause offset or winding of the recording sheets about the rollers leading to paper jamming.

Japanese Laid-Open Patent Application (JP-A) 63-313182 has proposed an image forming apparatus of a short waiting time and a low electric power consumption including a fixing apparatus wherein a toner image on a recording sheet is heated via a moving heat-resistant sheet by a heat-generating member of a low heat capacity energized and heated by pulse current conduction, thereby to be fixed onto the recording sheet. Further, JP-A 1-187582 has proposed a fixing apparatus for heating a toner image via a heat-resistant sheet to fix the toner image onto a recording sheet, wherein the heat-resistant sheet has a heat-resistant layer and a release layer or a low-resistivity layer so as to effectively prevent the offset phenomenon.

However, the realization of excellent fixation of toner images onto recording sheets and prevention of offset as well as a short waiting time and a low power consumption, should owe much to the characteristics of a toner used in addition to the fixing apparatus as mentioned above.

It has been hitherto practiced to add a wax such as low-molecular weight polyethylene or polypropylene susceptible of sufficient melting on heating to a toner to increase the releasability of the toner, thereby preventing the toner from attaching onto the fixing roller surface. This is effective in offset prevention but on the other hand increases the agglomeratability of the toner and makes the chargeability unstable, thus being liable to result in deterioration of successive image forming characteristic. Alternatively, various proposals have been made in order to improve the toner binder resin.

For example, it has been known to improve the viscoelastic properties of a toner by increasing the glass transition temperature (Tg) and molecular weight of the toner binder resin. However, this measure, when used for improving the anti-offset characteristic, is liable to cause an insufficient fixability, thus resulting in a deterioration of fixability at a low temperature (i.e., a low-temperature fixability) as required in high-speed development and economization of energy.

In order to improve the low-temperature fixability, it is generally required to lower the melt-viscosity of the toner and increase the adhesion area thereof onto a fixation substrate, so that the binder resin used is required to show a lower Tg or a lower molecular weight.

There is a contradiction between the low-temperature fixability and the anti-offset characteristic, so that it is very difficult to develop a toner satisfying these properties in combination.

In order to solve the above-mentioned problems, Japanese Patent Publication (JP-B) 51-23354, (corresponding to U.S. Pat. No. 3,941,898) for example, has proposed a toner comprising a moderately crosslinked vinyl polymer through addition of a crosslinking agent and a molecular weight-adjusting agent. JP-B 55-6895 (corresponding to U.S. Pat. Nos. 4,386,147 and 4,486,524) has proposed a toner containing a polymer comprising an $\alpha,\beta$-ethylenically unsaturated monomer and having a broadened molecular weight distribution as represented by a weight-average molecular weight/number-average molecular weight ratio of 3.5–4.0. Further, there has been proposed a toner comprising a blend of vinyl polymers having a combination of Tg, molecular weights and gel contents.

These toners are actually caused to have a broader fixable temperature range between a fixation lower limit temperature (a lowest temperature at which the fixation is possible)

and an offset initiation temperature (at which the offset phenomenon begins to occur) compared with a toner comprising a single resin having a narrow molecular weight. These toners however still involve problems that a toner having a sufficient anti-offset characteristic cannot have a sufficiently low fixing temperature and, on the other hand, a toner produced with much attention to a low-temperature fixability cannot have a sufficient anti-offset characteristic.

Further, JP-A 57-208559 has proposed a toner wherein a polyester resin which has been considered to have an essentially better low-temperature fixability is crosslinked and combined with an offset-preventing agent. This toner is excellent in both low-temperature fixability and anti-offset characteristic but has left a problem regarding the productivity i.e., pulverizability of the kneaded product).

JP-A 56-116043 has proposed a toner using a resin which has been obtained by polymerizing a vinyl monomer in the presence of a reactive polyester resin while causing crosslinking, addition and grafting in the polymerization stage to provide a higher molecular weight. The toner is provided with an improved pulverizability but it is still difficult to fully utilize the characteristics of respective resins regarding the low-temperature fixability and anti-offset characteristic.

JP-B 1-15063 has proposed a toner including a blend of a polyester resin and two types of vinyl resins having different gel contents (at least 80% and below 10%). The toner has a good low-temperature fixability but does not yet have sufficient anti-offset characteristic or pulverizability. If the proportion of the vinyl resin having a gel content of at least 80% is increased so as to improve the anti-offset characteristic, the low-temperature fixability is remarkably impaired on the contrary, while the anti-offset characteristic is improved. Further, it is impossible to obtain a satisfactory pulverizability only by simply incorporating a vinyl resin having a gel content of below 10%.

On the other hand, regarding the physical properties of a toner as described above, there are also proposals of reacting a polymer having a carboxylic acid group and a metal compound to cause a crosslinking in a binder resin (JP-A 57-178249, JP-A 57-178250), and reacting a binder having a vinyl resin monomer and a specific monoester compound as essential constituents and a multi-valent metal compound to cause a crosslinking via the metal (JP-A 61-110155, JP-A 61-110156).

Further, JP-A 63-214760, JP-A 63-217362, JP-A 63-217363 and JP-A 63-217364 have proposed a binder resin having a molecular weight distribution with two separated portions of a low-molecular weight portion and a high-molecular weight portion, a carboxylic acid group contained in the low-molecular weight portion being reacted with a multi-valent metal ion to cause crosslinking (i.e., a metal compound is added to a solution polymerization resultant after the solution and reacted by elevating a temperature). In any method, however, it is difficult to effect the reaction between the binder and the metal compound or uniform dispersion of the metal compound within the binder so that it has not yet become possible to well satisfy the properties required of a toner, especially the fixability and the anti-offset characteristic. Moreover, as it is necessary to incorporate a large amount of the metal compound within the binder resin, the metal compound incorporated can show a catalyst function for the binder resin, thus being liable to cause gellation of the binder resin. As a result, it is difficult to determine the conditions for producing a desired toner by incorporating a metal compound and, even if the production conditions are once determined, it is difficult to obtain a satisfactory reproducibility.

JP-A 2-168264 and JP-A 2-235069 have proposed further separation of a low-molecular weight component and a high-molecular weight component and adjustment of a carboxylic group content so as to improve the anti-offset characteristic while preventing the worsening of the productivity and the developing performance. As a result of further study, while the fixability and anti-offset characteristic are improved, the inclusion of an acid in an amount as disclosed rather unstabilizes the dispersion of the respective components in the developer including the binder resin, thus being liable to cause localization of the respective components in the developer and liberation of the respective components out of the developer, so that it is difficult to obtain a stable developing characteristic. When a developer in such a state is used in a hot-fixing system using a fixing film, it is liable to cause a sticking onto the fixing film and a breakage of the fixing film. These difficulties are pronounced if the weight-average molecular weight (Mw)/number-average molecular weight (Mn) ratio considered to represent a degree of separation into two portions is increased and the difference in specific gravity among the constituents is increased as in a magnetic toner. Particularly, a magnetic toner having Mw/Mn ratio exceeding 20 may satisfy the fixability and the anti-offset characteristic to some extent but has left a problem regarding the developing performance and adaptability to the fixing scheme.

JP-A 62-9356 has proposed a toner binder resin composition comprising a blend of two types of vinyl resins having different molecular weights and acid values. However, when such a binder resin is used, it is necessary to enhance the kneading condition so as to improve the mutual solubility and dispersibility of the toner components. As a result, the binder resin is affected by the severance of molecular chains, thus making difficult to exhibit particularly a satisfactory anti-offset characteristic. In case of a degree of kneading not causing the severance of molecular chains, the other additives are liable to be dispersed insufficiently, thus promoting the soiling of the surfaces of the developer-carrying members, such as a carrier and a sleeve and also resulting in difficulties such as fog and scattering regarding the developing performance. These difficulties are noticeable, particularly when a polymer having a weight-average molecular weight of $10^6$ or higher is used.

JP-A 3-72505 has proposed a vinyl-type toner binder resin having a molecular weight of at least $3\times10^5$ formed by using a multi-functional initiator. In case where such a binder resin is used, a satisfactory fixability is obtained to some extent, whereas the developer is liable to cause a lowering in performance after being left at a high temperature in addition to the above difficulties. It has not been clarified as yet why the lowering in performance is caused but it may be assumed that, during the toner formation, only the severance of molecular chains of the binder resin is promoted to reduce the proportion of a resin component having a sufficient molecular weight in the toner composition, thus resulting in a toner which is less heat-resistant.

Further, various performances as mentioned above required of a toner are mutually contradictory in many cases and satisfaction of those performances is even more required in these years. Further, a toner having excellent overall performances inclusive of developing performances is still being desired.

SUMMARY OF THE INVENTION

An object of the present invention is to provide a toner for developing electrostatic images having solved the above-mentioned problems of the prior art, thus showing improved fixability and anti-offset characteristic, providing high-quality toner images and being excellent in long-term storage stability.

A further object of the present invention is to provide a toner for developing electrostatic images, not adversely affecting a developer-carrying member and a heat-fixing sheet used in a heat-fixing system.

Another object of the present invention is to provide a toner for developing electrostatic images, capable of providing stable images without losing initial developing performance even after standing for a long term in a high temperature environment.

Another object of the present invention is to provide an image forming method including a charging step capable of retaining a sufficient contact between a charging member and a member to be charged (photosensitive member) and free from charging failure or charging irregularity by preventing the soiling of the charging member and the member to be charged as by sticking of the residual toner onto the surfaces of these members.

Another object of the present invention is to provide an image forming method including a cleaning step free from cleaning failure and capable of retaining the surface of a member to be charged (photosensitive member) in an always good state by removing a residual toner on the surface of the member to be charged by a cleaning member while alleviating the abrasion of the member to be charged.

A further object of the present invention is to provide a process cartridge including a toner which can be uniformly carried on the surface of a developer-carrying member, can provide stable high-quality images and is free from adversely affecting an electrostatic image-bearing member and a developer-carrying member.

According to the present invention, there is provided a toner composition for developing an electrostatic image, comprising: polymer components, a colorant and a metal-containing organic compound, wherein the composition shows a melt index (at 125° C., 10 kg-load) of 5–25 g/10 min., and the polymer components are characterized by (a) containing substantially no THF (tetrahydrofuran)-insoluble content, (b) including a THF-soluble content thereof providing a GPC (gel permeation chromatography) chromatogram showing i) a main peak in a molecular weight region of $2\times10^3$–$3\times10^4$, and a sub-peak or shoulder in a molecular weight region of at least $10^5$, and ii) an areal percentage of 3–10% in a molecular weight region of at least $10^6$, and (c) including a polymer component (H) in a molecular weight region of at least $10^5$ obtained by polymerization using a polyfunctional polymerization initiator and a mono-functional polymerization initiator.

According to another aspect of the present invention, there is provided an image forming method, comprising:

a charging step of disposing a charging member in contact with a member to be charged and applying a voltage to the charging member, thereby charging the member to be charged, a step of forming an electrostatic image on the charged member to be charged, a step of developing the electrostatic image with a toner of the above-described toner composition to form a toner image on the member to be charged, a transfer step of transferring the toner image on the member to be charged to a transfer-receiving material, and a cleaning step of cleaning the surface of the member to be charged after the transfer step.

According to a further aspect of the present invention, there is provided a process cartridge detachably mountable to a main assembly of an image forming apparatus, comprising:

an electrostatic image-bearing member; and developing means integrally supported with the electrostatic image-bearing member to form the process cartridge;

said developing means including a developer-carrying member for carrying a developer layer thereon, an elastic regulating member for exerting an elastic force onto the developer layer on the developer-carrying member to regulate a thickness of the developer layer, a developer container for containing the developer to be supplied to the developer-carrying member, and a stirring means for stirring the developer disposed in the developer container;

wherein said developer comprises at least a toner of the above-described toner composition.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
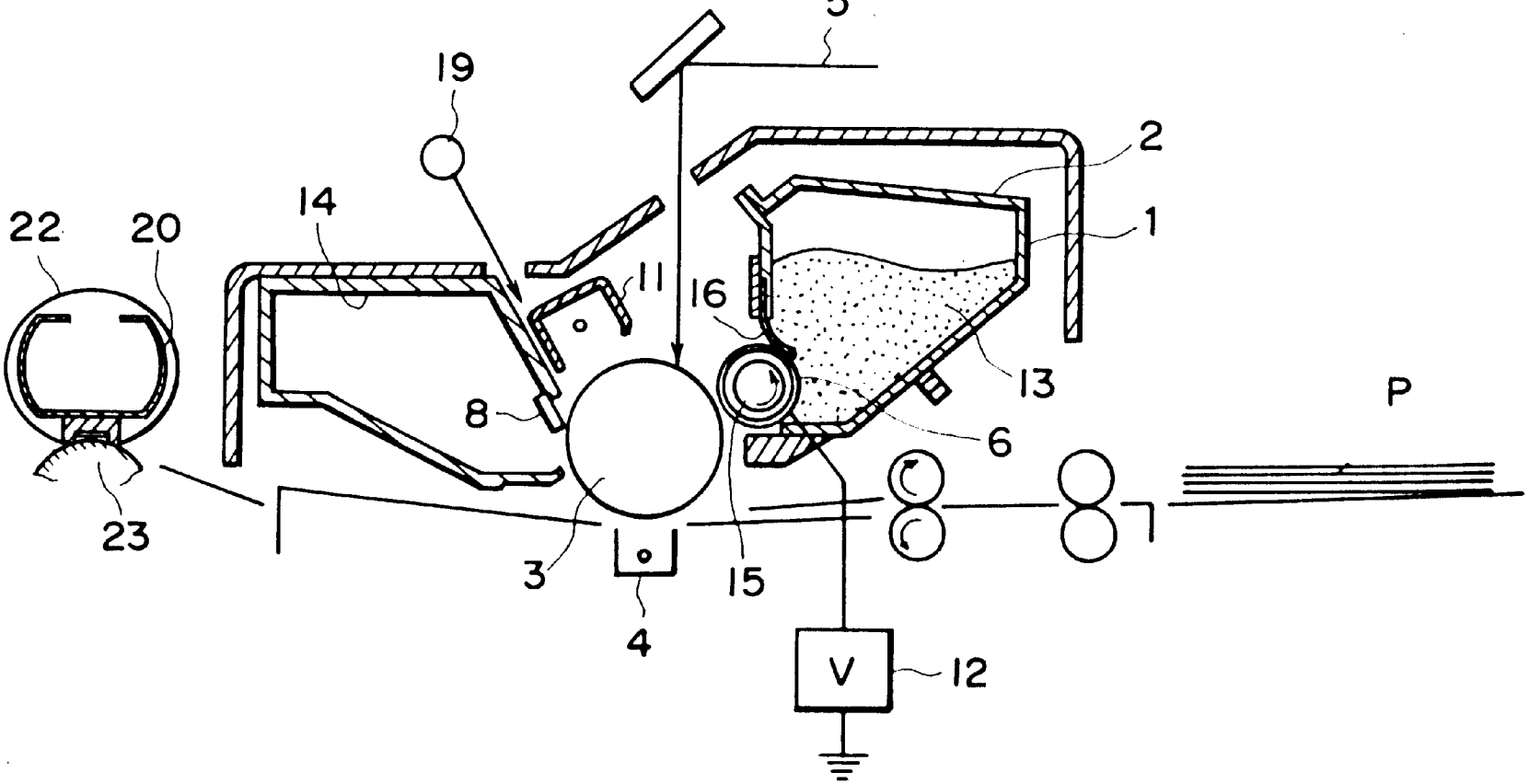
FIGS. 1 and 2 are respectively a schematic illustration of an example of image forming apparatus to which the toner of the present invention is applicable.

As a result of extensive study of ours, it has been found possible to provide a toner having an extremely broad fixable temperature range and excellent dot reproducibility and capable of forming stably good images for a long period by specifying the properties of the toner through adjustment of a binder resin composition and polymer components constituting the resin composition.

The resin composition is substantially free from THF-insoluble content. More specifically, the composition does not contain more than 5 wt. %, preferably more than 3 wt. %, of a THF-insoluble content.

The "THF-insoluble content" referred to herein means a polymer component (substantially, a crosslinked polymer) which is insoluble in a solvent THF (tetrahydrofuran) within a resin composition constituting a toner, and thus may be used as a parameter indicating the degree of crosslinking of a resin composition containing a crosslinked component. The THF-insoluble content may be defined as a value measured in the following manner.

About 0.5–1.0 g of a toner sample is weighed (at $W_1$ g) and placed in a cylindrical filter paper (e.g., "No. 86R" available from Toyo Roshi K.K.) and then subjected to extraction with 100–200 ml of solvent THF in a Soxhlet's extractor. The extraction is performed for 6 hours. The soluble content extracted with the solvent is dried first by evaporation of the solvent and then by vacuum drying at 100° C. for several hours, and weighed (at $W_2$ g). The components other than the resin component, such as a magnetic material and pigment, are weighed or determined (at $W_3$ g). The THF-insoluble content (wt. %) is calculated as $[(W_1-(W_3+W_2))/(W_1-W_3)]\times 100$.

A THF-insoluble content exceeding 5 wt. % not only results in an inferior fixability but also leaves a problem regarding matching with a hot fixing apparatus as used in Examples described hereinafter.

The THF-soluble content of the polymer component in the toner composition according to the present invention has a main peak in a molecular weight region of $2\times10^3$–$3\times10^4$ and a sub-peak or shoulder in a molecular weight region of at least $10^5$ respectively on a GPC chromatogram thereof.

In the toner of the present invention, the THF-soluble polymer component includes a polymer component having a molecular weight of at least $10^6$ showing an areal ratio of 3–10% on the above-mentioned GPC chromatogram. By including the THF-soluble component having a molecular weight of at least $10^6$ at 3–10%, it becomes possible to improve the anti-offset characteristic without impairing the low-temperature fixability and also enhance the storage stability under standing at a high temperature.

The molecular weight distribution of toner compositions, binder resins and waxes described herein are based on values measured by GPC (gel permeation chromatography) under the following conditions.

GPC measurement for toner compositions and resin components

Apparatus: GPC-150C (available from Waters Co.)

Columns: 7 columns of KF801–KF807 (all available from Showdex K.K.)

Temperature: 40° C.

Solvent: THF (tetrahydrofuran)

Flow rate: 1.0 ml/min.

Sample concentration: 0.05–0.6 wt. %

Sample volume: 0.1 ml

GPC measurement for waxes

Apparatus: GPC-150C (available from Waters Co.)

Column: 2 columns of GMH-HT (available from TOSO K.K.)

Temperature: 135° C.

Solvent: o-dichlorobenzene (containing 0.1% ionol)

Flow rate: 1.0 ml/min.

Sample concentration: 0.15 wt. %

Sample volume: 0.4 ml.

GPC chromatograms are obtained under the above-mentioned conditions, and the molecular weight levels (abscissa) of the chromatogram are determined based on a calibration curve prepared by using mono-disperse polystyrene standard samples. Further, the molecular weights of waxes are calculated based on a conversion formula derived from a Mark-Houwink viscosity formula.

The polymer components constituting the toner composition according to the present invention may preferably include a high-molecular weight component comprising a carboxylic monomer unit (A) having at least one of carboxylic group, carboxylic acid salt group and carboxylic anhydride group and a crosslinking monomer unit in a weight ratio of $20 \leqq A/B \leqq 10{,}000$. By satisfying this condition, it is possible to cause a sufficient crosslinking with a metal-containing organic compound through a hot melt-kneading step during the toner production. Particularly, in case where a low melt-viscosity binder resin is used, due to the viscosity-increasing effects given by the use of the crosslinking monomer unit and the crosslinking reaction, the toner components receive a uniform shearing force which is stronger than given heretofore. As a result, the dispersibility is improved to stabilize the anti-offset characteristic and the developing characteristic at a level which has not been realized heretofore and also realize a good matching with the heat-fixing scheme using a fixing film.

The polymer components in the toner composition may preferably comprise a low-molecular weight component having little reactive polar group so as to suppress the competitive crosslinking reaction of the low-molecular weight component and selectively crosslinking the high molecular weight component effectively. As a result, it is possible to prevent the coarsening of the fixing characteristic due to the crosslinking and the unnecessary reaction of the metal-containing organic compound, thereby allowing an enhanced low-temperature fixability and a further stabilization of the developing characteristic.

The above-mentioned effects become pronounced when the high-molecular weight component and the low-molecular weight component in the binder resin are caused to have separated molecular weights. Particularly, in case where the high-molecular weight component has a weight-average molecular weight (Mw) in excess of $10^6$ causing a remarkably lower mobility in the binder resin, it is preferred to incorporate the above-mentioned carboxylic monomer unit so as to provide a certain level or more of crosslinking to exhibit the desired effects of the crosslinking and also to prevent the low-molecular weight component having a molecular weight below $10^5$ from containing a substantial amount of the polar group, particularly suppressing the acid value of at most 3.0, preferably at most 1.5.

In the binder resin constituting the toner according to the present invention, it is preferred that the high-molecular weight component comprises a carboxylic monomer unit having at least one of carboxylic group, carboxylic acid salt group and carboxylic anhydride group so as to provide the high-molecular weight component with an acid value exceeding 3.0, more preferably 5.0 or higher. By increasing the acid value above a certain level, it becomes possible to form a sufficient crosslinking structure, thereby preventing the deterioration of the anti-offset characteristic and alleviating the difficulties caused by a lowered dispersibility of the other components in the toner.

Examples of the carboxyl group-containing monomer for synthesizing a vinyl polymer may include: acrylic acid and α- or β-alkyl derivatives, such as acrylic acid, methacrylic acid, α-ethylacrylic acid, and crotonic acid; and unsaturated dicarboxylic acids, such as fumaric acid, maleic acid and citraconic acid, and mono-ester derivatives thereof. Desired polymers may be synthesized by polymerizing these monomers alone or in mixture, or by copolymerization of these monomers with other monomers. Among these, it is particularly preferred to use mono-ester derivatives of unsaturated dicarboxylic acids.

Preferred examples of the carboxyl group-containing monomer used in the present invention may include: monoesters of α,β-unsaturated dicarboxylic acids, such as monomethyl maleate, monoethyl maleate, monobutyl maleate, monooctyl maleate, monoallyl maleate, monophenyl maleate, monomethyl fumarate, monoethyl fumarate, monobutyl fumarate and monophenyl fumarate; monoesters of alkenyldicarboxylic acids, such as monobutyl n-butenylsuccinate, monomethyl n-octenylsuccinate, monoethyl n-butenylmalonate, monomethyl n-dodecenylglutarate, and monobutyl n-butenyladipate; and monoesters of aromatic dicarboxylic acids, such as monomethyl phthalate, monoethyl phthalate and monobutyl phthalate.

The above-mentioned carboxyl group-containing monomer may preferably constitute 1–20 wt. %, particularly 3–15 wt. %, of the total monomers providing a high-molecular weight component of the binder resin.

A reason why a monomer in the form of a dicarboxylic acid monoester is preferred is that an acid monomer having a high solubility in an aqueous suspension medium is not suitable but an ester having a lower solubility is preferred in suspension polymerization.

In the present invention, the carboxylic acid group and carboxylic acid ester cite can be subjected to saponification by an alkalline treatment. It is also preferred to convert the carboxylic acid group and the carboxylic acid ester cite into a polar functional group by reaction with an alkalline cationic component. This is because, even if a carboxylic group potentially capable of reacting with a metal-containing organic compound is contained in the high-molecular weight component, the crosslinking efficiency thereof is lowered, if the carboxylic acid group is in the form of an anhydride, i.e., cyclized.

The alkalline treatment may be performed by adding an alkali into the solvent medium after the preparation of the binder resin. Examples of the alkali may include: hydroxides of alkalline metal or alkalline earth metals, such as Na, K, Ca, Li, Mg and Ba; and ammonium hydroxide, alkylammonium hydroxides, such as pyriminium hydroxide. Particularly preferred examples may include NaOH and KOH.

In the present invention, the above-mentioned saponification need not be effected with respect to all the carboxylic acid group and carboxylic ester cite of the copolymer, but a part of the carboxylic groups can be saponified into a polar functional group.

The alkali for the saponification may be used in an amount of 0.02–5 equivalents to the acid value of the binder resin. Below 0.02 equivalent, the saponification is liable to be insufficient to provide insufficient polar functional groups, thus being liable to cause insufficient crosslinking thereafter. On the other hand, in excess of 5 equivalents, the functional group, such as the carboxylic ester cite, can receive adverse effects, such as hydrolysis and salt formation.

If the alkalline treatment in an amount of 0.02–5 equivalents to the acid value is effected, the remaining cation concentration may be within the range of 5–1000 ppm.

On the other hand, the low-molecular weight component within the binder resin of the present invention, may be produced through a known process. According to the bulk polymerization, however, such a low-molecular weight polymer can be produced by adopting a high polymerization temperature providing an accelerated reaction speed, the reaction cannot be controlled easily. In contrast thereto, according to the solution polymerization process, such a low-molecular weight polymer can be produced under moderate conditions by utilizing the radical chain transfer function of the solvent and by adjusting the polymerization initiator amount or reaction temperature, so that the solution polymerization process is preferred for formation of the low-molecular weight component in the binder resin. It is also effective to perform the solution polymerization under an elevated pressure, so as to suppress the amount of the polymerization initiator to the minimum and suppress the adverse effect of the residual polymerization initiator.

Examples of the monomer constituting the high-molecular weight component and the low-molecular weight component in the binder resin used in the toner according to the present invention may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; the esters of the above-mentioned α,β-unsaturated acids and the diesters of the above-mentioned dibasic acids. These vinyl monomers may be used singly or in combination of two or more species.

Among these, a combination of monomers providing styrene-type copolymers and styrene-acrylic type copolymers may be particularly preferred.

The toner according to the present invention may preferably have dynamic visco-elasticities including a dynamic loss modulus (G") and a dynamic loss tangent (tan δ) which is a ratio of G" to a dynamic storage modulus (G') at 200° C. and 150° C. satisfying the following conditions:

$$1 \leqq \tan\delta_{150}/\tan\delta_{200} \leqq 2,\ 10^3\ \text{dyn/cm}^2 \leqq G''_{200} \leqq G''_{150} \leqq 10^5\ \text{dyn/cm}^2.$$

In order that a toner shows a good fixability onto a transfer-receiving medium such as paper, the toner is required to show a sufficiently low viscosity at a temperature around a set temperature of the heating member of the fixing apparatus.

When a hot fixing apparatus is continuously used, the heating roller causes a local temperature increase at non-paper passing region thereof (e.g., at roller ends). This is particularly pronounced when a transfer paper shorter than the width of the fixing apparatus and the temperature can deviate from the set temperature by about 50° C. in some cases to cause a high temperature offset, so that the maintenance of the elasticity is also an important factor.

Accordingly, in order for a toner to satisfy the fixability and the anti-offset characteristic in a broad temperature range, the toner composition is required to show such viscoelasticities that the toner is caused to have a low viscosity in a set fixing temperature region and retains a sufficient elasticity at a higher temperature.

The viscoelasticities described herein are based on values measured under the following conditions:

Apparatus: RMS-800 Mechanical Spectrometer (available from Rheomtrics Co.)

Test fixtures: Parallel plates (25 mm in diameter)

Sample: A toner formed by a press into a disk of 25 mm in diameter and 1.5 mm in thickness.

Measured frequency: 1 Hz (6.28 rad./sec.)

Measurement temperatures: 150° C. and 200° C.

Shear strain: 1%-fixed

The toner composition according to the present invention may preferably show a melt index (MI) of 5–25 g/10 min., particularly 8–20 g/10 min., so as to show a good matching with image forming apparatus as will be described with reference to Examples hereinafter. The melt index values referred to herein are values measured by using an apparatus according to JIS K7210 (Flow testing method for a thermoplastic material according to Japanese Industrial Standards) under the following conditions. The measurement may be performed by manual cutting, and the measured values are converted into an amount per 10 min.

Measurement temperature: 125° C.

Load: 10 kg

Sample weight: 5–10 g

The toner composition according to the present invention may preferably show a glass transition temperature of 50–70° C., more preferably 55–65° C., so as to show a good storage stability. If the glass transition temperature is below 50° C., the toner is liable to be deteriorated in a high temperature environment and cause an offset at the time of fixation. In excess of 70° C., the fixability can be adversely affected.

The glass transition temperature Tg may be measured by using a differential scanning calorimeter ("DSC-7" available from Perkin Elmer Inc.) in the following manner.

The measurement sample is accurately weighed at 5–20 mg, preferably around 10 mg.

The sample is placed on an aluminum pan and subjected to heating in a range of 30–200° C. at a rate of 10° C./min in a normal temperature-normal humidity environment with reference to an empty aluminum pan. In the temperature raising stage, a main absorption peak may appear in a temperature range of 40–100° C. Base lines are taken both before and after the appearance of the absorption peak, and an intermediate line is drawn passing between the base lines. An intersection of the intermediate line and the DSC curve may provide a corresponding temperature which is taken as the glass transition temperature of the sample.

The binder resin used in the present invention may be obtained through various processes, inclusive of: a solution blend process wherein a high-molecular weight polymer and a low-molecular weight polymer produced separately are blended in solution, followed by removal of the solvent; a dry blend process wherein the high- and low-molecular weight polymers are melt-kneaded by means of, e.g., an extruder; and a two-step polymerization process wherein a low-molecular weight polymer prepared, e.g., by solution polymerization is dissolved in a monomer constituting a high-molecular weight polymer, and the resultant solution is subjected to suspension polymerization, followed by washing with water and drying to obtain a binder resin. However, the dry blend process leaves a problem regarding the uniform dispersion and mutual solubilities, and the two-step polymerization process makes it difficult to increase the low-molecular weight component in excess of the high-molecular weight component while it is advantageous in providing a uniform dispersion. Further, the two-step polymerization process providing a difficulty that, in the presence of a low-molecular weight polymer component, it is difficult to form an adequately high-molecular weight component and an unnecessary low-molecular weight component is by-produced. Accordingly, the solution blend process is most suitable in the present invention.

The high-molecular weight component in the binder resin composition used in the present invention may be produced by emulsion polymerization or suspension polymerization.

In the emulsion polymerization process, a monomer almost insoluble in water is dispersed as minute particles in an aqueous phase with the aid of an emulsifier and is polymerized by using a water-soluble polymerization initiator. According to this method, the control of the reaction temperature is easy, and the termination reaction velocity is small because the polymerization phase (an oil phase of the vinyl monomer possibly containing a polymer therein) constitute a separate phase from the aqueous phase. As a result, the polymerization velocity becomes large and a polymer having a high polymerization degree can be prepared easily. Further, the polymerization process is relatively simple, the polymerization product is obtained in fine particles, and additives such as a colorant, a charge control agent and others can be blended easily for toner production. Therefore, this method can be advantageously used for production of a toner binder resin.

In the emulsion polymerization, however, the emulsifier added is liable to be incorporated as an impurity in the polymer produced, and it is necessary to effect a post-treatment such as salt-precipitation in order to recover the product polymer at a high purity. The suspension polymerization is more convenient in this respect.

The suspension polymerization may preferably be performed by using at most 100 wt. parts, preferably 10–90 wt. parts, of a monomer (mixture) per 100 wt. parts of water or an aqueous medium. The dispersing agent may include polyvinyl alcohol, partially saponified form of polyvinyl alcohol, and calcium phosphate, and may preferably be used in an amount of 0.05–1 wt. part per 100 wt. parts of the aqueous medium. The polymerization temperature may suitably be in the range of 50–95° C. and selected depending on the polymerization initiator used and the objective polymer.

The high-molecular weight component in the resin composition used in the present invention may suitably be produced in the presence of a combination of a polyfunctional polymerization initiator and a monofunctional polymerization initiator, as enumerated hereinbelow.

Specific examples of the polyfunctional polymerization initiator may include: polyfunctional polymerization initiators having at least two functional groups having a polymerization-initiating function, such as peroxide groups, per molecule, inclusive of 1,1-di-t-butylperoxy-3,3,5-trimethylcyclohexane, 1,3-bis-(t-butylperoxyisopropyl) benzene, 2,5-dimethyl-2,5-(t-butylperoxy)hexane, 2,5-dimethyl-2,5-di-(t-butylperoxy)hexine-3, tris(t-butylperoxy)triazine, 1,1-di-t-butylperoxycyclohexane, 2,2-di-t-butylperoxybutane, 4,4-di-t-butylperoxyvaleric acid n-butyl ester, di-t-butylperoxyhexahydroterephthalate, di-t-butylperoxyazelate, di-t-butylperoxytrimethyladipate, 2,2-bis-(4,4-di-t-butylperoxycyclohexyl)propane, 2,2-t-butylperoxyoctane and various polymer oxides; and polyfunctional polymerization initiators having both a polymerization-initiating functional group, such as peroxide group, and a polymerizable unsaturation group in one molecule, such as diallyl-peroxydicarbonate, t-butylperoxymaleic acid, t-butylperoxyallylcarbonate, and t-butylperoxyisopropylfumarate.

Among these, particularly preferred examples may include: 1,1-di-t-butylperoxy-3,3,5-trimethylcyclohexane, 1,1-di-t-butylperoxycyclohexane, di-t-butylperoxyhexahydroterephthalate, di-t-butylperoxyazerate, 2,2-bis(4,4-di-t-butylperoxycyclohexyl)propane, and t-butylperoxyallylcarbonate.

These polyfunctional polymerization initiators may be used in combination with a monofunctional polymerization initiator, preferably one having a 10 hour-halflife temperature (a temperature providing a halflife of 10 hours by decomposition thereof) which is lower than that of the polyfunctional polymerization initiator, so as to provide a toner binder resin satisfying various requirements in combination.

Examples of the monofunctional polymerization initiator may include: organic peroxides, such as di-t-butyl peroxide, dicumyl peroxide, benzoyl peroxide, t-butylperoxy-2-ethylhexanoate, and t-butylperoxybenzoate; and azo and diazo compounds, such as azobisisobutyronitrile, and diazoaminoazobenzene.

The monofunctional polymerization initiator can be added to the monomer simultaneously with the above-mentioned polyfunctional polymerization initiator but may preferably be added after lapse of a polymerization time which exceeds the halflife of the polyfunctional polymerization initiator, in order to appropriately retain the initiator efficiency of the polyfunctional polymerization initiator.

The above-mentioned polymerization initiators may preferably be used in an amount of 0.05–2 wt. parts per 100 wt. parts of the monomer.

The high-molecular weight component of the resin composition used in the present invention may comprise a crosslinking monomer as enumerated hereinbelow so as to satisfy the required properties according to the present invention.

The crosslinking monomer may principally be a monomer having two or more polymerizable double bonds. Specific examples thereof may include: aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl) propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylethane triacrylate, tetramethylolmethane tetracrylate, oligoester acrylate, and compounds obtained by substituting methacrylate groups for the acrylate groups in the above compounds; triallyl cyanurate and triallyl trimellitate.

These crosslinking agents may preferably be used in a proportion of 1 wt. part or less, particularly about 0.001–0.05 wt. parts, per 100 wt. parts of the other vinyl monomer components.

Among the above-mentioned crosslinking monomers, aromatic divinyl compounds (particularly, divinylbenzene) and diacrylate compounds connected with a chain including an aromatic group and an ether bond may suitably be used in a toner resin in view of fixing characteristic and anti-offset characteristic.

It is preferred to preliminarily mix the high-molecular weight polymer constituting the resin composition according to the present invention with a low-molecular weight wax, thereby being able to alleviate microscopic phase separation, prevent re-agglomeration of the high-molecular weight component and provide a good dispersion state with the low-molecular weight polymer.

Examples of the low-molecular weight wax usable in the present invention may include: waxy substances, such as polypropylene, polyethylene, microcrystalline wax, carnauba wax, sasol wax, and paraffin wax, and oxidized and graft-modified products thereof.

The low-molecular weight wax may preferably have a weight-average molecular weight of at most $3\times10^4$, more preferably at most $10^4$. The addition amount thereof may preferably be about 1–20 wt. parts per 100 wt. parts of the binder polymer component.

In toner production, the low-molecular weight wax may preferably be added to and mixed with the binder resin in advance. It is particularly preferred to preliminarily dissolve the low-molecular weight wax and the high-molecular weight polymer in a solvent, and mix the resultant solution with a solution of the low-molecular weight polymer, thereby producing a binder resin.

Such polymer solutions may preferably have a solid content of 5–70 wt. % in view of dispersion efficiency, prevention of denaturation of the resin under stirring and operability. More particularly, the preliminary solution of the high-molecular weight polymer component and the low-molecular weight wax may preferably have a solid content of 5–60 wt. %, and the low-molecular weight polymer solution may preferably have a solid content of 5–70 wt. %.

The high-molecular weight polymer component and the low-molecular weight wax may be dissolved or dispersed under stirring either batchwise or continuously to prepare the preliminary solution.

The blending with the low-molecular weight polymer solution may preferably be performed by blending the low-molecular weight polymer solution in an amount of 10–1000 wt. parts with the preliminary solution containing 30 wt. parts of the solid content. The blending may be performed either batchwise or in a continuous manner.

It is further preferred to blend 5–100 wt. parts, more preferably 10–80 wt. parts, of the low-molecular weight polymer component with 10 wt. parts the solid content in the preliminary solution.

Examples of the organic solvent used for the solution blending for preparation of the resin composition according to the present invention may include: hydrocarbon solvents, such as benzene, toluene, xylene, solvent naphtha No. 1, solvent naphtha No. 2, solvent naphtha No. 3, cyclohexane, ethylbenzene, Solvesso 100, Solvesso 150 and mineral sprit; alcohol solvents, such as methanol, ethanol, iso-propyl alcohol, n-butyl alcohol, sec-butyl alcohol, iso-butyl alcohol, amyl alcohol, and cyclohexanol; ketone solvents, such as acetone, methyl ethyl ketone, methyl isobutyl ketone, and cyclohexanone; ester solvents, such as ethyl acetate, n-butyl acetate, and cellosolve acetate; and ether solvents, such as methyl cellosolve, ethyl cellosolve, high cellosolve and methyl carbitol. Among these, aromatic, ketone and/or ester solvents may be preferred. These solvents can be used in mixture.

The organic solvent may preferably be removed by removing 10–80 wt. % thereof by heating the polymer solution under a normal pressure and removing the remainder under a reduced pressure. In this instance, it is preferred to retain the polymer solution at a temperature which is at least the boiling point of the solvent and at most 200° C. Below the boiling point, not only the efficiency of the solvent removal is lowered, but also the polymers within the organic solvent receive an unnecessary shearing force to promote re-distribution of the component polymers, thus being liable to cause microscopic phase separation. In excess of 200° C., the de-polymerization of the polymerization is liable to occur, thus not only resulting in oligomers due to molecular severance but also being liable to result in monomers which may be entrained into the product resin. This is undesirable in the binder resin for electrophotography.

The toner binder resin composition prepared through the above-mentioned production process is excellent not only in dispersibility of the low-molecular weight wax but also in compatibility between the low-molecular weight polymer and the high-molecular weight.

A metal-containing organic compound is added to the toner according to the present invention so as to promote the crosslinking between polymers in the resin composition at the time of toner production.

Among the metal-containing organic compounds, those containing an organic compound, which is rich in vaporizability or sublimability, as a ligand or a counter ion, are advantageously used. Among the organic compounds forming coordinate bonds or ion pairs with metal ions, examples of those having the above property may include: azo-metal complexes; salicylic acid and its derivatives, such as salicylic acid, salicylamide, salicylamine, salicylaldehyde, salicylosalicylic acid, and di-tert-butylsalicylic acid; β-diketones, such as acetylacetone and propionylacetone: and low-molecular weight carboxylic acid salts, such as acetate and propionate.

It is possible to have the organic metal complex also function as a charge control agent for toner particles. Examples of such a metal complex include azo metal complexes represented by the following formula [I]:

[I]

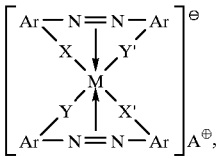

wherein M denotes a coordination center metal, inclusive of metal elements having a coordination number of 6, such as Cr, Co, Ni, Mn and Fe; Ar denotes an aryl group, such as phenyl or naphthyl, capable of having a substituent, examples of which may include: nitro, halogen, carboxyl, anilide, and alkyl and alkoxy having 1–18 carbon atoms; X, X', Y and Y' independently denote —O—, —CO—, —NH—, or —NR— (wherein R denotes an alkyl having 1–4 carbon atoms; and $A^{\oplus}$ denotes hydrogen, sodium, potassium, ammonium or aliphatic ammonium.

Specific examples of this type of complexes may include the following:

Complex [I]-1

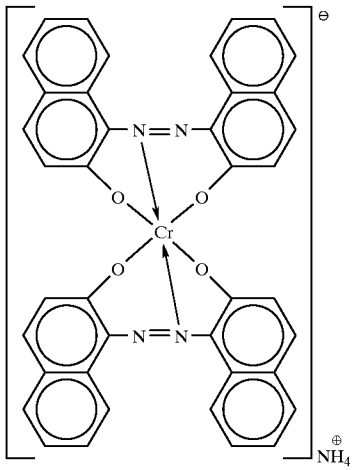

-continued
Complex [I]-2
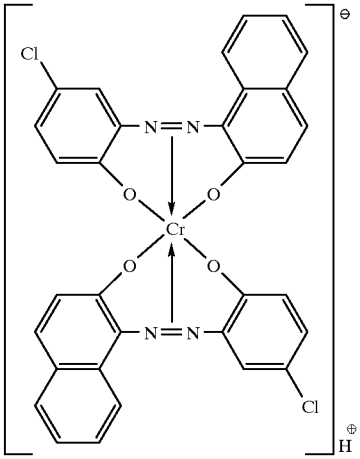
Complex [I]-3
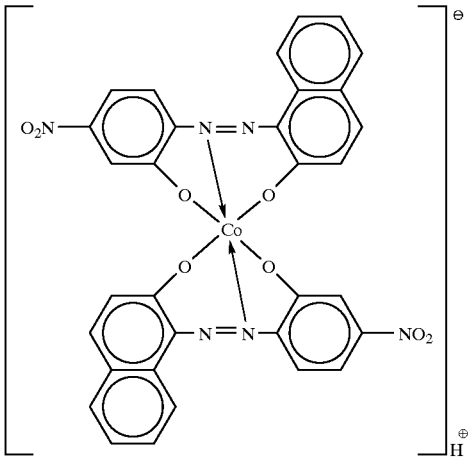
Complex [I]-4
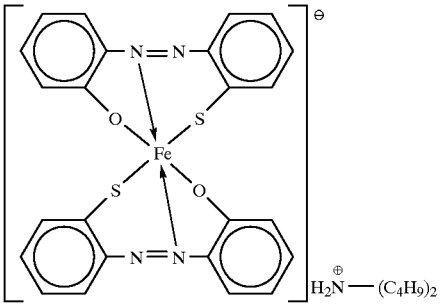

-continued
Complex [I]-5
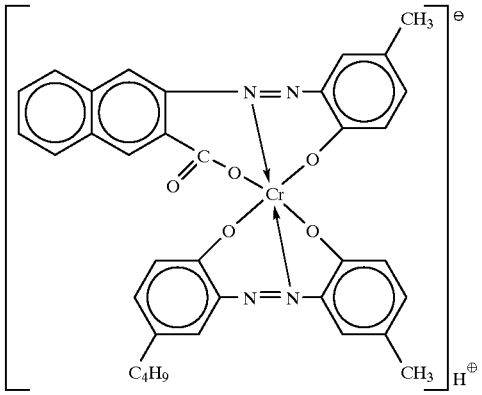
Complex [I]-6
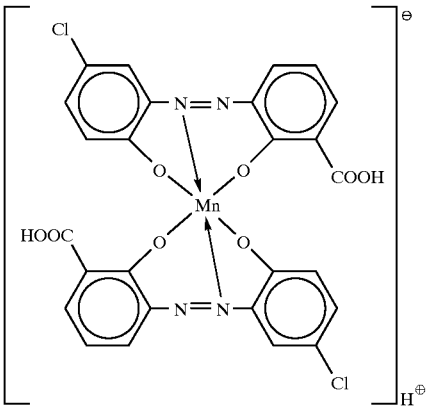
Complex [I]-7
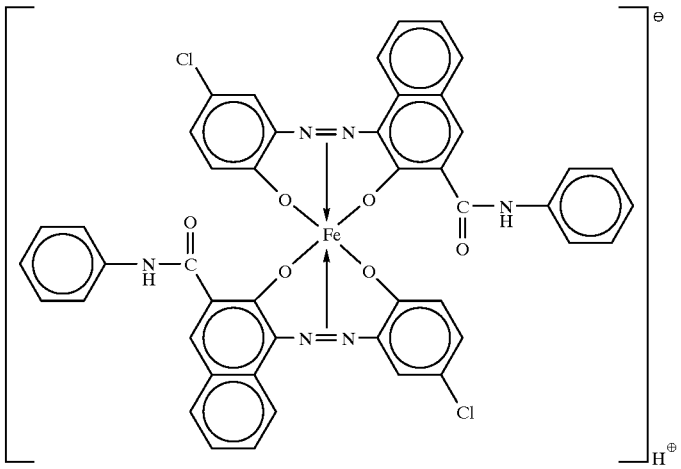
Basic organic acid metal complexes represented by the following formula [II] impart a negative chargeability and may also be used in the present invention.
[II]
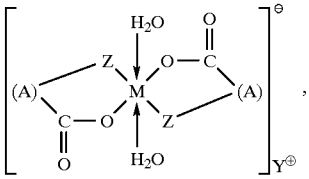

wherein M denotes a coordination center metal, inclusive of metal elements having a coordination number of 6, such as Cr, Co, Ni, Mn and Fe; A denotes

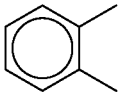

(capable of having a substituent, such as an alkyl),

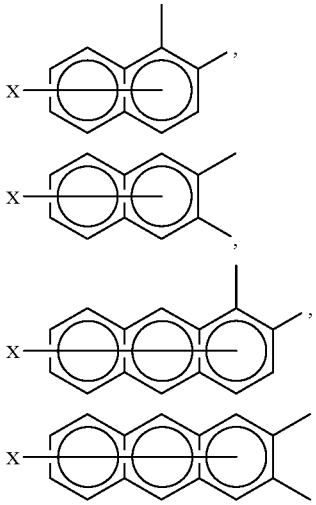

(X denotes hydrogen alkyl, halogen, or nitro),

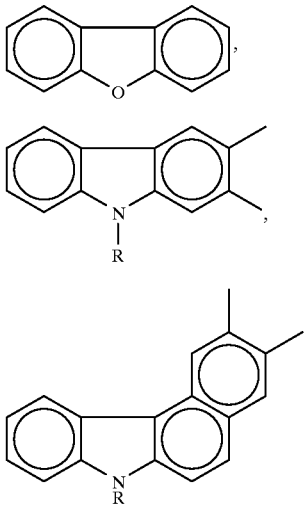

(R denotes hydrogen, $C_1$–$C_{18}$ alkyl or $C_1$–$C_{18}$ alkenyl); $Y^{\oplus}$ denotes a counter ion, such as hydrogen, sodium, potassium, ammonium, or aliphatic ammonium; and Z denotes —O— or —CO.O—.

Specific examples of the complexes represented by the above formula [II] may include the following:

Complex [II]-1

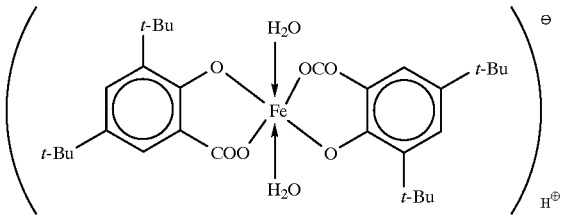

Complex [II]-2

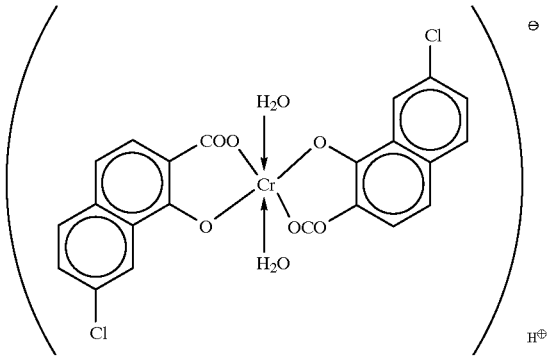

-continued

Complex [II]-3

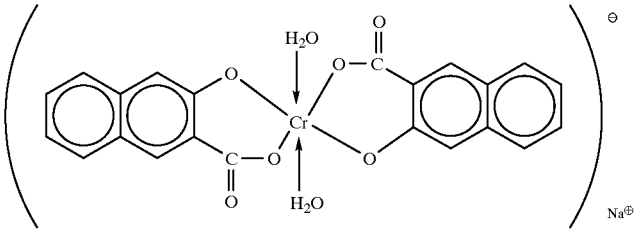

Complex [II]-4

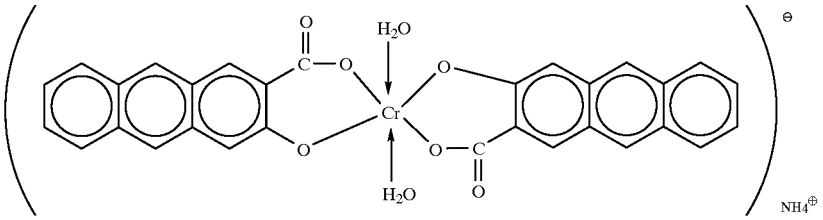

Complex [II]-5

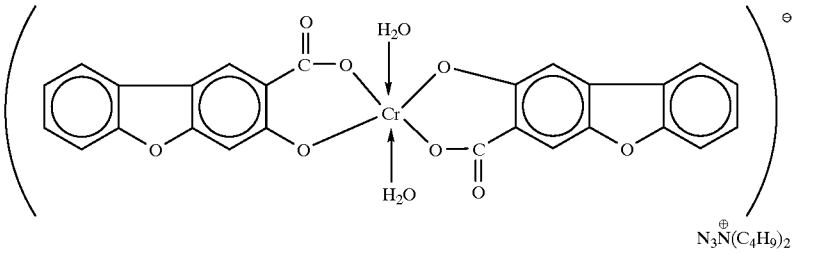

Complex [II]-6

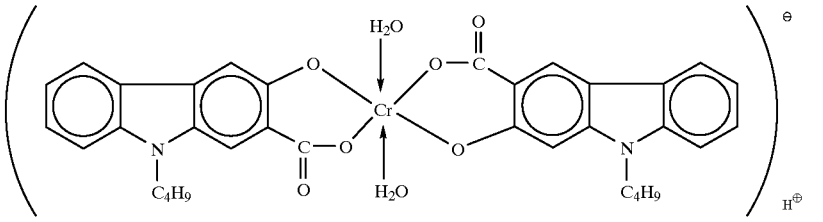

Complex [II]-7

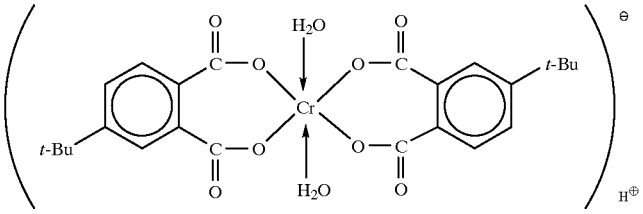

The above organic metal compounds may be used singly or in combination of two or more species.

The addition amount of the organic metal compounds to the toner particles may be varied depending on the specific binder resin used, the use or nonuse of a carrier, the colorant for the toner and the reactivity of the metal compounds with the resin but may generally be 0.01–20 wt. parts, preferably 0.1–10 wt. parts, per 100 wt. parts of the binder resin including the non-reacted portion thereof.

The above-mentioned organic metal complex shows excellent compatibility and dispersibility with the binder resin to provide a toner with a stable chargeability, particularly when it is reacted with the binder resin at the time of melt-kneading, compared with the case where it is added during the synthesis of the binder resin.

As described above, the metal-containing organic compound as a crosslinking component can be also used as a charge control agent, but it is also possible to use another charge control agent, as desired, in combination. Such another charge control agent may for example be a known negative or positive charge control agent.

Examples of such known negative charge control agent may include: organic metal complexes and chelate compounds inclusive of monoazo metal complexes as described above, acetylacetone metal complexes, and organometal complexes of aromatic hydroxycarboxylic acids and aromatic dicarboxylic acids. Other examples may include: aromatic hydroxycarboxylic acids, aromatic mono- and poly-carboxylic acids, and their metal salts, anhydrides and esters, and phenol derivatives, such as bisphenols. Among the above, monoazo metal complexes are preferred.

Examples of the positive charge control agents may include: nigrosine and modified products thereof with aliphatic acid metal salts, etc., onium salts inclusive of quarternary ammonium salts, such as tributylbenzylammonium 1-hydroxy-4-naphtholsulfonate and tetrabutylammonium tetrafluoroborate, phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; acetylacetone metal complexes; diorganotin oxides, such as dibutyltin oxide, dioctyltin oxide and dicyclohexyltin oxide; and diorganotin borates, such as dibutyltin borate, dioctyltin borate and dicyclohexyltin borate. These may be used singly or in mixture of two or more species.

It is preferred to use the toner according to the present invention together with inorganic fine powder blended therewith in order to improve the charge stability, developing characteristic and fluidity.

The inorganic fine powder may include silica fine powder, titanium oxide fine powder and alumina fine powder. The inorganic fine powder used in the present invention provides good results if it has a specific surface area of 30 $m^2/g$ or larger, preferably 50–400 $m^2/g$, as measured by nitrogen adsorption according to the BET method. The silica fine powder may be added in a proportion of 0.01–8 wt. parts, preferably 0.1–5 wt. parts, per 100 wt. parts of the toner particles.

For the purpose of being provided with hydrophobicity and/or controlled chargeability, the inorganic fine powder may well have been treated with a treating agent, such as silicone varnish, modified silicone varnish, silicone oil, modified silicone oil, silane coupling agent, silane coupling agent having functional group or other organic silicon compounds. It is also preferred to use two or more treating agents in combination.

Other additives may be added as desired, inclusive of: a lubricant, such as polytetrafluoroethylene, zinc stearate or polyvinylidene fluoride, of which polyvinylidene fluoride is preferred; an abrasive, such as cerium oxide, silicon carbide or strontium titanate, of which strontium titanate is preferred; a flowability-imparting agent, such as titanium oxide or aluminum oxide, of which a hydrophobic one is preferred; an anti-caking agent, and an electroconductivity-imparting agent, such as carbon black, zinc oxide, antimony oxide, or tin oxide. It is also possible to use a small amount of white or black fine particles having a polarity opposite to that of the toner as a development characteristic improver.

The toner according to the present invention can be mixed with carrier powder to be used as a two-component developer. In this instance, the toner and the carrier powder may be mixed with each other so as to provide a toner concentration of 0.1–50 wt. %, preferably 0.5–10 wt. %, further preferably 3–5 wt. %.

The carrier used for this purpose may be a known one, examples of which may include: powder having magnetism, such as iron powder, ferrite powder, and nickel powder; glass beads; and carriers obtained by coating these powders or beads with a resin, such as a fluorine-containing resin, a vinyl resin or a silicone resin.

The toner according to the present invention can be constituted as a magnetic toner containing a magnetic material in its particles. In this case, the magnetic material can also function as a colorant. Examples of the magnetic material may include: iron oxide, such as magnetite, hematite, and ferrite; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten and vanadium; and mixtures of these materials.

The magnetic material may have an average particle size of 0.1–2 micron, preferably 0.1–0.5 micron.

The magnetic material may preferably show magnetic properties under application of 10 kilo-Oersted, inclusive of: a coercive force of 20–250 Oersted, a saturation magnetization of 50–200 emu/g, and a residual magnetization of 2–20 emu/g. The magnetic material may be contained in the toner in a proportion of 20–200 wt. parts, preferably 40–150 wt. parts, per 100 wt. parts of the resin component.

The toner according to the present invention can contain a colorant which may be an appropriate pigment or dye. Examples of the pigment may include: carbon black, aniline black, acetylene black, Naphthol Yellow, Hansa Yellow, Rhodamine Lake, Alizarin Lake, red iron oxide, Phthalocyanine Blue, and Indanthrene Blue. These pigments are used in an amount sufficient to provide a required optical density of the fixed images, and may be added in a proportion of 0.1–20 wt. parts, preferably 2–10 wt. parts, per 100 wt. parts of the binder resin.

Examples of the dye may include: azo dyes, anthraquinone dyes, xanthene dyes, and methine dyes, which may be added in a proportion of 0.1–20 wt. parts, preferably 0.3–10 wt. parts, per 100 wt. parts of the binder resin.

The toner according to the present invention may be prepared through a process including: sufficiently blending the binder resin, the organic metal compound such as the metal salt or metal complex, a colorant, such as pigment, dye and/or a magnetic material, and an optional charge control agent and other additives, as desired, by means of a blender such as a Henschel mixer or a ball mill, melting and kneading the blend by means of hot kneading means, such as hot rollers, a kneader or an extruder to cause melting of the resinous materials and disperse or dissolve the magnetic material, pigment or dye therein, and cooling and solidifying the kneaded product, followed by pulverization and classification to obtain toner particles.

The thus obtained toner particles may be further blended with other external additives, as desired, by means of a mixer such as a Henschel mixer to provide a toner.

The kneading step after the preliminary blending step can be performed by ordinary kneading means but, among these, it is particularly preferred to use an extruder having a single screw or twin screws in the present invention, in order not to impair the performances of the binder resin according to the present invention but to provide good dispersion of and wetting with the internal additives. In this instance, the melt-kneading may preferably be performed by using an extruder having a kneading shaft with a length (L) and a diameter (D) satisfying a ratio L/D in the range of 10–60. This condition is preferred so as to effectively lower the melt viscosity of the binder resin under melt-kneading and suppressing an unnecessarily large shearing force acting on the resin, thereby well preventing the reagglomeration of the binder resin components and severance of molecular chains (particularly of the high-molecular component). If the kneading is performed with $L/D<10$, the melt viscosity of the binder resin is liable to be not sufficiently lowered, thereby failing to provide a sufficient wetting with the internal additives constituting the toner and thus to realize a good dispersion state. Further, a strong shearing force can act on the binder resin to cause the severance of the polymer chains. In case of $L/D>60$, the binder resin can have an unnecessarily low melt viscosity to result in a poor dispersion of the internal additives and a phase separation between the polymer components. These tendencies are pronounced particularly in case of production of a toner containing an additive which has a large difference in specific gravity with the binder resin, e.g., a magnetic toner containing a magnetic material. The L/D ratio may further preferably be 15–55.

Figure 7:
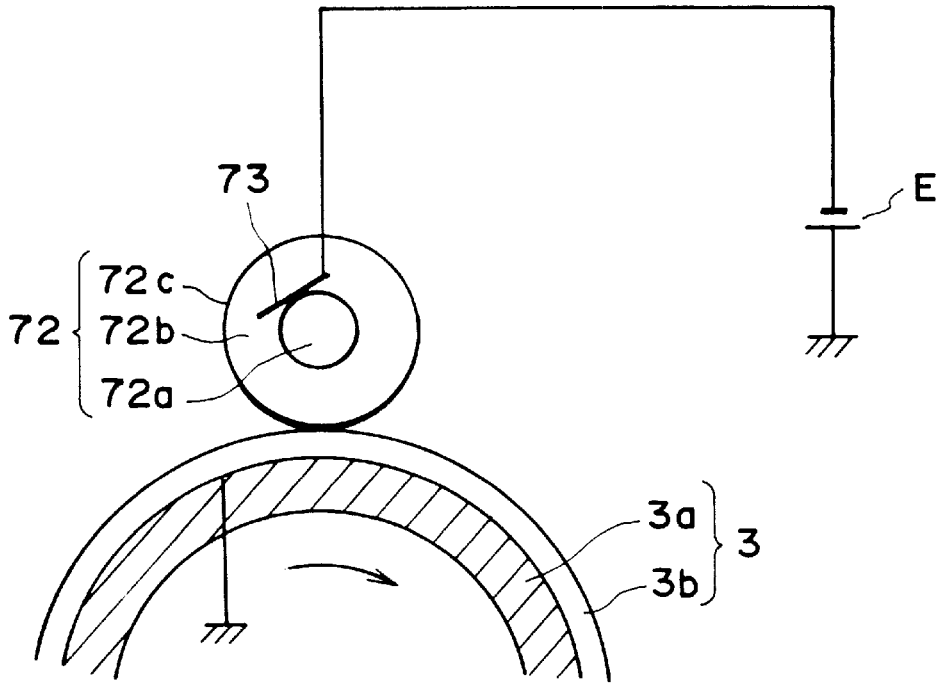
FIG. 7 is an illustration of a contact-charging roller.

FIG. 7 is a schematic illustration of an example of a contact charging apparatus for effecting a contact charging step according to the present invention. Referring to the figure, the apparatus includes an electrostatic image-bearing member or a photosensitive drum 3, as a member to be charged, which comprises a drum substrate 3*a* of aluminum and an organic photoconductor (OPC) layer 3*b* as a photosensitive layer disposed around the outer periphery of the drum substrate 3*a*. The photosensitive drum 3 rotates at a prescribed speed in the direction of an indicated arrow and has an outer diameter of 24 mm in this specific embodiment. Disposed in contact with the photosensitive drum 3 at a prescribed pressure is a charging roller 72, as a charging member, which comprises a metal core 72*a* surrounded with an electroconductive rubber layer 72*b* around which is disposed a surface layer or film 72*c* of a release characteristic. The surface layer 72*c* contains an insulating metal oxide so as to improve the surface film strength and the withstand voltage and suppress the occurrence of pinholes due to dielectric breakdown. Further disposed in contact with the metal core 72*a* is a contact electrode 73 for supplying an electricity based on a bias voltage from a power supply E to charge the photosensitive drum.

As a result, a prescribed DC or DC+AC bias voltage is supplied from the supply E via the contact electrode 73 to the metal core 72*a*, thereby to charge the surface of the photosensitive drum 3 to a prescribed potential of a prescribed polarity.

The surface layer 72*c* may preferably comprise a releasable film in view of the matching with the toner and the image forming method according to the present invention.

The releasable film may preferably have a surface roughness maximum height (Rmax) (according to JIS B0601) which is at least 10 $\mu$m so as to increase the discharge points and increase the charging efficiency and at most 100 $\mu$m so as to provide a high image quality.

The releasable film may preferably have an appropriate level of resistivity, i.e., a volume resistivity of $10^7$–$10^{11}$ ohm.cm, as the photosensitive drum 3 cannot be suitably charged at too large a resistivity and an excessive voltage is applied to the photosensitive drum 3 at too small a resistivity to cause the breakage of or pinholes on the photosensitive drum 3. The releasable film may preferably have a thickness of at most 30 $\mu$m. The film may suitably have a thickness of about 5 $\mu$m or larger so as not to cause a pealing or stripping thereof.

The release film 72*c* may preferably have a surface (scratch) hardness of at most 30 g so as to prevent the occurrence of scars on the photosensitive drum 3 due to the contact member 72.

Further, the contact member may preferably have a storage modulus of $5\times10^6$–$5\times10^7$ Pa and a loss modulus of around $1\times10^5$ Pa so as to prevent the occurrence of scars and toner sticking on the photosensitive drum.

Figure 8:
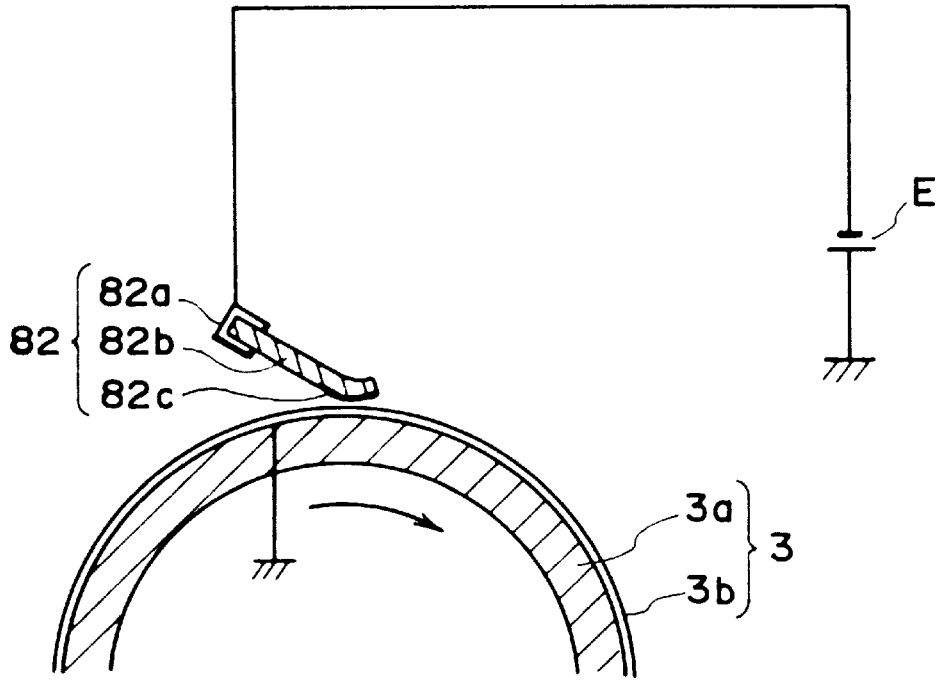
FIG. 8 is an illustration of a contact-charging blade.

FIG. 8 is a schematic illustration of another example of a contact charging apparatus for effecting a contact charging step according to the present invention. In FIG. 8, members identical to those described with reference to FIG. 7 are denoted by the same reference numerals and the repetitive description thereof is omitted.

Referring to FIG. 8, a blade-shaped contact charging member 82 is abutted against a photosensitive drum 3 at a prescribed pressure. The blade 82 comprises a metal support member 82*a* to which a voltage is supplied, and an electroconductive rubber blade 82*b* supported by the support member 82*a* and having a surface layer 82*c* comprising a releasable film at its portion contacting the photosensitive drum 3. The blade 82 in this embodiment may have a thickness of at least 1.0 mm and can show similar function and effect as in the previous embodiment without causing difficulties, such as adhesion onto the photosensitive drum.

The releasable film used in these contact charging members may preferably comprise a nylon resin, a PVDF (polyvinylidenefluoride) resin or a PVDC(polyvinylidene chloride) resin.

The mechanical pressure and electrical voltage exerted between the charging member and the photosensitive member are parameters suitably controlled in the present invention. More specifically, the contact pressure of the charging member against the photosensitive member may preferably be controlled in the range of 5–500 g/cm, and the voltage applied to the changing member may preferably be controlled in the range of 500–2000 volts in terms of an absolute value. In the case of AC voltage application, it is preferred to apply a peak-to-peak voltage of 500 to 5000 volts at a frequency of 50–300 Hz.

Other shapes of contact charging member may be applied in addition to the above-described roller and blade.

In the above-described examples, a charging member comprises an electroconductive rubber layer and a release film, but it is possible to insert a high-resistivity layer of, e.g., a hydrine rubber with a small environmental change, between the electroconductive rubber layer and the release film, so as to prevent the leakage to the photosensitive member.

The volume resistivity values of a contact charging member described herein are based on values measured in the following manner.

Figure 9:
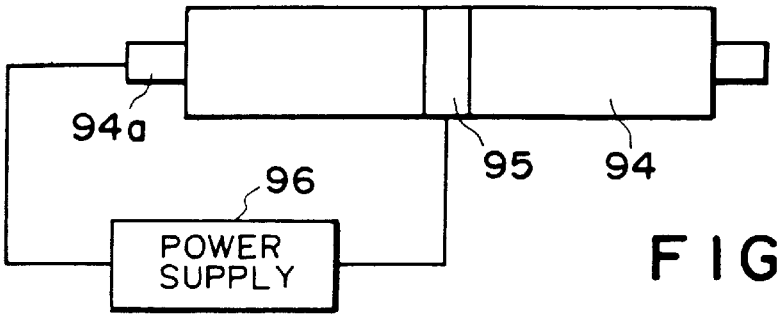
FIG. 9 is an illustration of a method of measuring a volumetric resistivity of a contact-charging member.

As shown in FIG. 9, a 10 mm-wide aluminum foil 95 is wound about a charging member 94, and a DC voltage of 250 volts is applied between a metal core 94*a* and the aluminum foil 95 from a power supply 96 to measure a current passing therebetween from which the resistance between the core metal and the aluminum foil is calculated.

Then, a cleaning step involved in the present invention will be described.

A photosensitive member after a toner image transfer is recycled to a repetitive image formation, after which a residual toner and other contaminating materials are wiped and cleaned by a cleaning member such as a cleaning blade.

It is also possible to effect such a cleaning step simultaneously with a charging step, a developing step or a transfer step involved in electrophotography.

In case where a toner having a small particle size (particularly, a weight-average particle size of at most 7 $\mu$m) is applied to an image forming apparatus involving such a cleaning step, the toner is liable to lower the wiping effect due to an increased electrostatic charge due to an increase in specific surface area even apart from the shape factor of the toner. In case where a cleaning member such as a blade is strongly abutted against the photosensitive member, a strong frictional movement is repeated on the photosensitive drum at the time of image formation, so that the life of the photosensitive drum is shortened and the tip of the blade, because of its incessant vibrational movement, functions to embed the minute toner particles into the photosensitive drum surface.

As a result of our study, it has been found possible to solve the above-mentioned problems and accomplish good cleaning performance by appropriately disposing the cleaning member and optimizing the material properties inclusive of the toner materials.

A cleaning member used in such a cleaning step will now be described.

Figure 10:
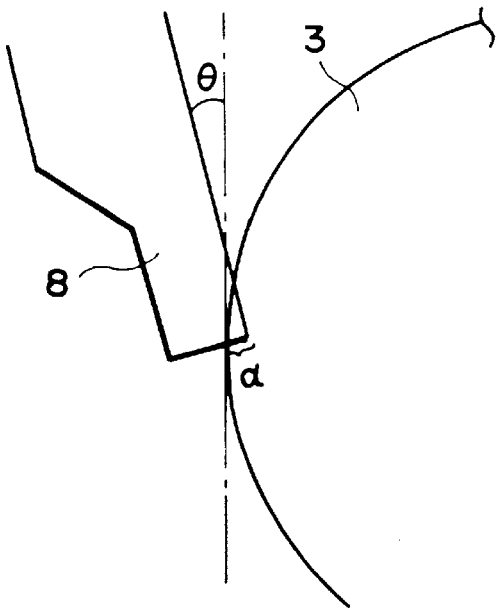
FIG. 10 is an illustration of a penetration $\alpha$ and a blade contact angle of a cleaning blade.

FIG. 10 illustrates a relationship between a blade penetration $\alpha$ and a set blade angle $\theta$. The blade penetration a is a hypothetical value if the tip of a blade 8 is assumed to penetrate into an electrostatic image-bearing member 3 without causing a deformation of the tip of the blade 8, and the blade angle $\theta$ is defined as an angle formed between the blade 8 and a tangent line on the image bearing member 3 at a point where the blade tip contacts the image-bearing member 3.

Figure 11:
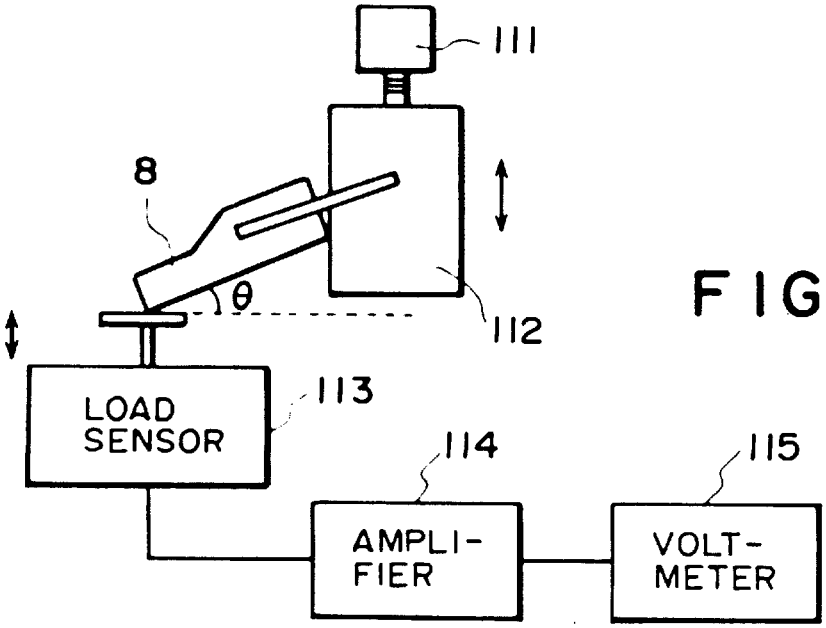
FIG. 11 is an illustration of a method of measuring a blade contact pressure.

A blade contact pressure may be measured in a manner as illustrated in FIG. 11. A blade 8 cut into a width of 1 cm so as to measure a linear pressure is fixed to a blade support 112 which can be driven by a motor 111 vertically in the direction of arrows, and the blade 8 is set to contact a load sensor 113 at a prescribed set angle $\theta$. Then, the blade support 112 is moved toward the load sensor 113 by a desired penetration $\alpha$ to measure a detected value on the load sensor 113, which value is amplified by an amplifier 114 and read on a voltmeter 115. Preliminarily, a load-voltage relationship has been determined, and a contact pressure per unit length may be derived from the measured load. The value measured in this manner is referred to as a blade contact pressure.

In this embodiment, it is preferred to set the blade set angle $\theta$ in the range of about 20 degrees to 50 degrees and the blade contact pressure in the range of 25–60 g-f/cm in order to prevent cleaning failure or toner sticking.

The cleaning member may preferably suppress a length change rate (dL) to at most 10% so as to retain a uniform cleaning performance. Further, the cleaning member may preferably have a storage modulus E' in the range of $5\times10^6$–$5\times10^7$ Pa, a loss modulus E" of at least $1\times10^5$ Pa and a temperature dependence between 10° C. and 60° C. thereof represented by a $E''_{10}/E''_{60}$ ratio in the range of 3–50. The viscoelasticities may be measured under the same conditions as the elastic blade described hereinafter.

Around the photosensitive member may be disposed various members, inclusive of a primary charger for uniformly charging the surface of the photosensitive member 3, an exposure unit for exposing the charged surface with a light image, such as image-modulated laser light or reflected light from an original, to lower the potential at the exposed part to form an electrostatic image on the photosensitive member, a developing device for developing the electrostatic image to form a toner image on the photosensitive member, and a transfer means for transfer the toner image onto a transfer-receiving material, such as paper, generally placed before the cleaning member. These conventional members are omitted from showing herein.

The present invention is particularly effectively applicable to an image forming apparatus including an electrostatic image-bearing member (photosensitive member) of which the surface comprises an organic compound. This is because a surface layer comprising an organic compound shows a generally good adhesion with a binder resin of the toner and is liable to lower the transferability of the toner because of a chemical affinity.

The surface of an electrostatic image-bearing member may for example comprise silicone resin, vinylidene chloride resin, ethylene-vinyl chloride copolymer, styrene-acrylonitrile copolymer, styrene-methyl methacrylate copolymer, polystyrene, polyethylene terephthalate or polycarbonate. However, these are not limitative and other resins, copolymers or blends may also be used.

The present invention is particularly advantageous for an image forming apparatus including a cylindrical electrostatic image-bearing member having a diameter below 25 mm. This is because, in case of a small diameter drum, an identical line pressure can cause a concentration of a pressure at the abutting portion because of a large curvature (a small curvature radius).

The same problem may also be encountered in a belt-form photosensitive member having a curvature radius below 25 mm, to which the present invention is also effective.

In case where the toner according to the present invention is used, even if some residual toner is present on a photosensitive drum after the cleaning step, the sticking thereof onto the charging member or the photosensitive member surface hardly occurs.

From the above, the toner according to the present invention shows very excellent matching with the contact charging step or the cleaning step contemplated in the present invention, thus allowing the contact charging step or the cleaning step to fully exhibit the performance, thereby allowing always good image formation.

Regarding the reasons why the toner according to the present invention shows excellent performances, we now consider as follows. The polymer components in the toner composition shows a molecular weight distribution of a two peak-type giving a broader dispersion and the high-molecular weight component thereof has an appropriate degree of three-dimensional structure, so that the polymer-components can retain appropriate degree of elasticity and viscosity although they have little THF-insoluble content. Because of the characteristic, the toner present on the charging member or the photosensitive member alleviates a pressure exerted as a mechanical pressure or an electrical pressure in a DC or AC electric field applied onto the charging member or the photosensitive member, thereby preventing the sticking in the form of spots or a film of the toner onto these members, thus preventing the occurrence of scars or abrasion on these members. The above properties are also effective for improving the preservability in a high temperature-high humidity environment.

Further, as the toner shows a moderate viscoelasticity, the toner does not readily damage the photosensitive drum surface but effectively suppresses the occurrence of scars or abrasion on the contacting members and the photosensitive drum.

As described above, the toner according to the present invention can show appropriate degree of viscoelasticity in the charging step and the cleaning step, so that good charging and cleaning performances are exhibited in the image forming method according to the present invention in addition to excellent developing performance.

Figure 12:
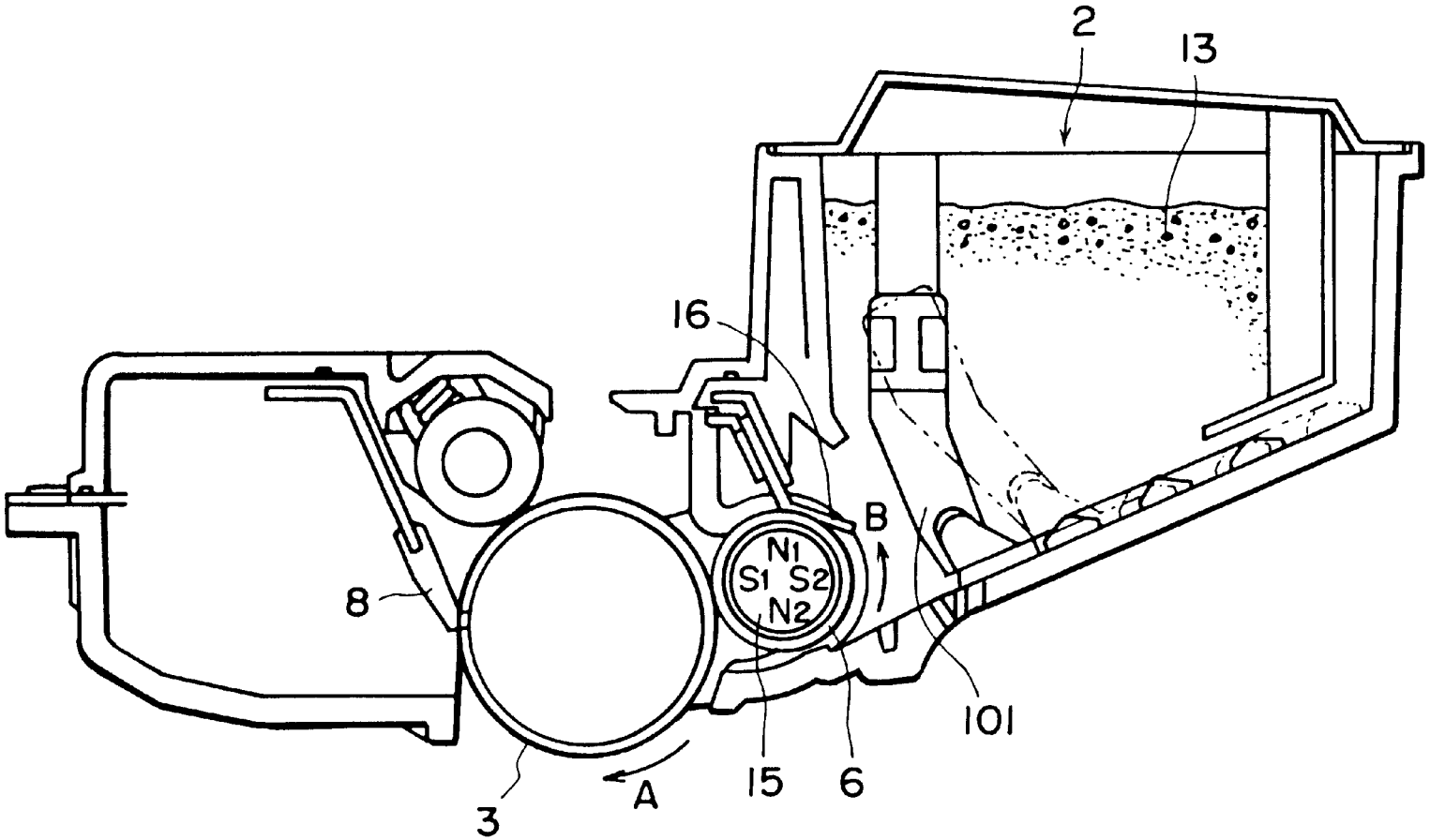
FIG. 12 is a schematic illustration of a process cartridge.

FIG. 12 is a sectional view of an embodiment of a process cartridge according to the present invention.

Referring to FIG. 12, the cartridge includes a photosensitive drum 3, as an electrostatic image-bearing member, which bears an electrostatic image thereon and rotates in the direction of an indicated arrow A. The photosensitive drum 3 may have or not have an insulating surface layer thereon. The electrostatic image-bearing member can be in the form of a sheet or a belt in addition to a drum as shown. The cartridge further includes a developing sleeve 6, as a developer carrying member, rotating in the direction of an indicated arrow B. Inside the sleeve 6, a multi-polar permanent magnet 15 is fixed so as not to rotate. The surface of the sleeve 6 is provided with an about 0.5–30 $\mu$m-thick resin coating layer containing electroconductive five particles as will be described hereinafter. An elastic blade 16 is disposed to contact the sleeve 6 surface at a drawing pressure of 10–15 g/cm so as to regulate the thickness of a toner layer formed on the sleeve 6 surface in a prescribed thickness.

The drawing pressure referred to herein is a measure of a contact pressure measured by inserting three superposed 20 μm-thick SUS plates between the blade and the sleeve at the nip part therebetween and drawing an intermediate one of the three SUS plates with a spring balance to read a weight (g) on the balance at which the intermediate plate can be drawn out. The weight (g) is divided by the SUS plate width (cm) to provide a drawing pressure.

A toner 13 within a developer container 2 is stirred by a reciprocation of a stirring member 101 to be sent toward the sleeve 6. The stirring member 101 includes an arm 101*a* and a plate-like developer feeding member 101*b* which is connected to the arm 101*b* and reciprocally moved along the bottom of the developer container.

When the developing apparatus described above is driven to rotate the sleeve 6 in the arrow B direction, the toner 13 within the developer container is provided with a charge of polarity opposite to that of an electrostatic image on the photosensitive drum 3 (in the case of normal development) due to friction between particles of the toner 13 per se or the toner 13 and the sleeve 6 surface and then applied onto the sleeve 6 surface. On the other hand, in the case of reversal development, the toner 13 is provided with a charge of a polarity identical to that of the electrostatic image on the photosensitive drum 3. The toner layer formed on the sleeve 6 surface is regulated into a thin uniform layer having a prescribed thickness by the elastic blade 16 and conveyed to a developing region formed between the photosensitive drum 3 and the sleeve 6.

In the developing region, an AC bias may be applied between the sleeve 6 and the photosensitive drum 3 so as to have the toner on the sleeve 6 jump toward the photosensitive drum 3.

The toner according to the present invention is particularly effective for use in a developing apparatus or a process cartridge having a structure as described below. A photosensitive member and a developer-carrying member are disposed with a constant spacing SD (μm) therebetween and a DC-superposed AC voltage having a peals-to-peak voltage Vpp (volts) and a frequency f (Hz) is applied to the developer-carrying member to effect development under the conditions of:

$$Vpp/SD<1.5+f/600,$$

and the developer-carrying member is rotated at a peripheral speed which is at least 1.3 times that of the photosensitive member. Thus, Vpp is reduced to decrease the driving electric field tower the photosensitive member and the frequency is increased to decrease one cycle time for toner jumping, whereby fog toner is prevented from attaching onto non-image parts on the photosensitive member while increasing the toner supply by increasing the peripheral speed of the developer carrying member relative to the photosensitive member.

A sleeve preferably used in the present invention is one having an uneven surface provided with a plurality of sphere-traced concavities. The surface state may be formed by blasting with definite-shaped particles. The definite-shaped particles may for example be various rigid balls comprising a metal,such as stainless steel, aluminum, steel, nickel or brass, having a particular particle size, and various rigid balls comprising e.g., ceramic, plastic or glass beads. By blasting the sleeve surface with definite-shaped particles having a particular particle size, it is possible to form a plurality of sphere-traced concavities having almost identical diameters R.

In the present invention, the toner may preferably be formed in a small particle size, more specifically a weight-average particle size of at most 7.0 μm, in order to provide a high resolution and a faithful reproduction of latent images. In harmony with such a small toner particle size, it is preferred to form a sleeve surface state as described below by blasting.

The sleeve surface may preferably be provided with plural sphere-traced concavities having a diameter R in the range of 20–250 μm. If the diameter R is below 20 μm, the sleeve is liable to be soiled with toner components. If the diameter R exceeds 250 μm, the toner coating uniformity on the sleeve is lowered. Accordingly, it is preferred to use definite-shaped particles having a diameter in the range of 20–250 μm. The pitch P and surface roughness of a sleeve surface referred to herein are based on values measured by examining sleeve surfaces by a minute surface roughness meter (available from Taylor Hopson Co., Kosaka Kenkyusho K.K., etc.). The surface roughness d corresponds to a ten point-average roughness ($R_Z$) according to JIS B0610.

The sleeve surface may preferably have a surface unevenness pitch P of 2–100 μm. If P is below 2 μm, the soiling of the sleeve with toner components is increased. If P exceeds 100 μm, the toner coating uniformity on the sleeve is lowered. The surface roughness d on the uneven sleeve may preferably be 0.1–5 μm. If d exceeds 5 μm, an electric field is liable to be concentrated at projections in the developing scheme where an alternating voltage is applied between the sleeve and the latent image-bearing member to cause the toner to jump from the sleeve onto the latent image surface to effect development, so that the developed image is liable to be disordered. If d is below 0.1 μm, the toner coating uniformity on the sleeve is lowered.

The outer surface of a sleeve can be covered with a coating layer.

For example, the sleeve may be coated with a crystalline graphite which may be roughly classified into natural graphite and artificial graphite. The artificial graphite may be obtained by once calcining pitch coke solidified with tar pitch at around 1200° C., followed by heat treatment at a high temperature around 2300° C. to cause carbon crystal growth. Natural graphite has been formed under the action of a geothermal heat and a high pressure in the underground for a long period and occurs naturally from the ground. Graphite is a crystalline mineral which is dark gray or dark colored, glossy, very soft and rich in lubricity. Graphite is sometimes used for pencils and, because of its heat resistance and chemical stability, is utilized for lubricants, anti-fire materials and electrical materials in the form of powder, solid or paint. The crystal structure is hexagonal or sometimes rhombohedral and has a complete layer structure. Graphite shows a good electrical conductor because of free electrons between carbons. Graphite used herein may be either natural or artificial and may preferably have a particle size in the range of 0.5–10 μm.

The sleeve may also be coated with a layer of a polymeric material, examples of which may include: thermoplastic resins, such as styrene resin, vinyl resin, polyethersulfone resin, polycarbonate resin, polyphenylene oxide resin, polyamide resin, fluorine-containing resin, cellulose resin, and acrylic resin; and thermosetting resins or photosetting resins, such as epoxy resin, polyester resin, alkyd resin, phenolic resin, melamine resin, polyurethane resin, urea resin, silicone resin, and polyimide resin. Among these, it is preferred to use a resin with a releasability, such as silicone resin or fluorine containing resin; or a resin having an excellent mechanical property, such as polyethersulfone, polycarbonate, polyphenylene oxide, polyamide, phenolic resin, polyester, polyurethane, styrene resin or a phenolic. It is particularly preferred to use a thermosetting phenolic resin.

Electroconductive amorphous carbon may generally be defined as a mass of carbon crystallites obtained by subjecting a hydrocarbon or a carbon-containing compound to combustion or thermal decomposition in an atmosphere of insufficient air supply. It is excellent in electroconductivity and it is widely used as a filler for a polymeric material for imparting an electroconductivity which can be controlled arbitrarily to some extent by controlling the addition amount thereof. The electroconductive amorphous carbon used in the present invention may preferably have a particle size of 10–80 μm, particularly 15–40 μm.

A preferable coated sleeve may for example be obtained by blasting a drawn aluminum tube with definite-shaped particles as described above, coating the aluminum tube with a coating liquid of one of the following prescription examples by spraying into a thickness of about 0.5–30 μm and thermosetting the coating in a drying furnace. The volatile matter in the coating layer may be reduced by controlling the heating temperature and heating time during the heat treatment in the above-mentioned thermosetting step, etc.

Prescription Example 1

| | |
|---|---|
| Resin: phenolic resin (solid) | 30 wt. parts |
| Carbon: amorphous carbon ("CONDUCTEX 9752B" available from Columbia Carbon Co.) | 5 wt. parts |
| Conductive lubricant: artificial graphite (2 μm) | 25 wt. parts |
| Diluent: methyl alcohol/methyl cellosolve | 200 wt. parts |

Prescription Example 2

| | |
|---|---|
| Resin: phenolic resin (solid) | 15 wt. parts |
| Conductive lubricant: artificial graphite (1 μm) | 15 wt. parts |
| Diluent: methyl alcohol/methyl cellosolve | 225 wt. parts |

Prescription Example 3

| | |
|---|---|
| Resin: phenolic resin (solid) | 30 wt. parts |
| Conductive lubricant: artificial graphite (1 μm) | 15 wt. parts |
| Diluent: methyl alcohol/methyl cellosolve | 225 wt. parts |

The coating layers were subjected to thermosetting under the conditions respectively shown in the following Table 1 and the result coating layers showed heating losses as also shown in Table 1 when heated up to 300° C.

TABLE 1

| Prescription Example | Heating conditions | Heating loss up to 300° C. |
|---|---|---|
| 1 | 140° C./30 min. | 1.1 wt. % |
| 2 | 125° C./15 min. | 2.0 wt. % |
| 3 | 90° C./10 min. | 5.9 wt. % |

The elastic blade may be formed of a rubbery elastic material, such as urethane rubber, silicone rubber or NBR rubber; a synthetic resin elastic material, such as polyethylene terephthalate; or a metallic elastic material, such as stainless steel. The upper-positioned root thereof is fixedly supported by the developer container and the lower side thereof is pressed and warped against its elasticity onto the sleeve surface so as to extend in a forward direction or a counter direction (as shown in FIG. 12) with respect to the rotation direction of the sleeve 6 and so that the inner side (or the outer side in the case of the counter contact) of the blade is pressed against the sleeve surface at an appropriate pressure, e.g., at a drawing pressure of 10–15 g/cm. The elastic blade may preferably have a thickness in the range of 0.8–1.5 mm and may preferably be disposed so that its free end is distant from the position (nip) abutted against the developing sleeve by 0.5–3.5 mm. If the distance is too small, it is difficult to provide an appropriate charge to the toner and, if the distance is too large, an immovable toner layer is liable to occur, thus deteriorating the developing performance. According to the apparatus, it is possible to form a stably thin and tight toner layer regardless of an environmental change. The reason therefor has not been clarified as yet but, compared with an ordinary apparatus in which a metal blade is disposed with a spacing from the sleeve, the toner particles are forcibly rubbed with the sleeve surface, so that the triboelectrification may be performed always in a constant state regardless of the change in behavior of the toner due to an environmental change.

The elastic blade may preferably satisfy viscoelastic properties inclusive of a storage modulus E' in a range of $5\times10^6$–$5\times10^7$ Pa, a loss modulus E" of at least $1\times10^5$ Pa, a change in length of at most 10% between 10 and 60° C., and a ratio $E''_{10}/E''_{60}$ in the range of 3–50 between the loss modulus $E''_{10}$ at 10° C. and the loss modulus $E''_{60}$ at 60° C. Outside these ranges, it is difficult to provide an appropriate charge to the toner, the elastic blade per se and the sleeve are liable to be soiled with toner components and it becomes difficult to realize a uniform coating state regardless of an environmental change.

The viscoelastic properties are based on values measured under the following conditions.

Apparatus: "DMS 200" (a viscoelasticity spectrometer available from Seiko Denshi Kogyo K.K.)

Deformation mode: tension

Sample: cut in sizes of 30 mm (length)×1 mm (thickness)×1 mm (width)

Measurement frequency: 0.1–10 Hz

Measurement temperature: 10–60° C.

Temperature raising rate: 1° C./min.

Environment: in nitrogen ($N_2$) $N_2$ flow rate: 200 ml/min

The stirring device 101 disposed in the developer container 2 comprises an arm 101*a* and a plate-like toner feeding member 101*b* which is connected to the arm 101*a* and is reciprocally slided along the bottom of the container 2 to feed the toner toward the developing sleeve 6, thereby suppressing the change in image density during a successive image formation to provide stably good images.

The above-mentioned stirring device may be small in size but uniformly takes up the developer while preventing the occurrence of coarse toner particles due to agglomeration and sticking due to a repetitive stress by the stirring, if it is combined with the toner according to the present invention.

This effect is particularly pronounced when the stirring device is used in combination with a blasted and crystalline graphite/resin-coated developer-carrying member (sleeve). More specifically, such a blasted developer-carrying member has an increased conveying ability and is liable to cause ununiform take-up of the developer. In a developer container in which a stirring member rotates, a good stirring state is accomplished in the vicinity of the stirring member but it is difficult to obtain a sufficient stirring at other parts, particularly in the vicinity of the contain bottom. Further, if a stronger stirring device capable of enhanced rotation is used so as to obtain a sufficient stirring state, the toner is liable to cause a charge up to cause a lower developing performance or an agglomeration or coarsening due to enhanced stress by stirring during a continual image formation. Particularly, the toner according to the present invention suitable for low-temperature fixation is liable to be affected by these effects to be agglomerated. Accordingly, the above-mentioned stirring means may be effectively used.

The magnet 15 used in the developing apparatus may preferably be a 4-poled permanent magnet, and the developer-conveying pole thereof may preferably show a magnetic force of at least 550 G. The above-mentioned stirring device effectively operates in combination with such a powerful developer-conveying pole to allow a uniform take-up of the developer.

Thus, the toner according to the present invention may suitably be applied to an image forming method using a developing apparatus including: a developer-carrying member for carrying and conveying a developer thereon having a surface blasted with definite-shaped particles and coated with a crystalline graphite-containing resin layer; an elastic layer thickness-regulating member for exerting an elastic force to a developer layer on the developer-carrying member; and a developer container in which a stirring member comprising a plate-shaped developer feeding member is disposed and reciprocally slided along the bottom of the container for feeding the developer toward the developer-carrying member. Particularly, when a binder resin of a low melt-viscosity is used, due to the thickening effect given by the crosslinking monomer unit and the crosslinking reaction, the toner-constituting elements receive stronger and more uniform shearing force than ever to be dispersed in a synergistically improved state, and the resultant toner is prevented from sticking onto the developer-carrying member and the photosensitive member in contact therewith. Further, the toner does not readily agglomerate in the developer container to be uniformly taken up. In this way, the toner is considered to show a good matching with the image forming method as described above.

Figure 6:
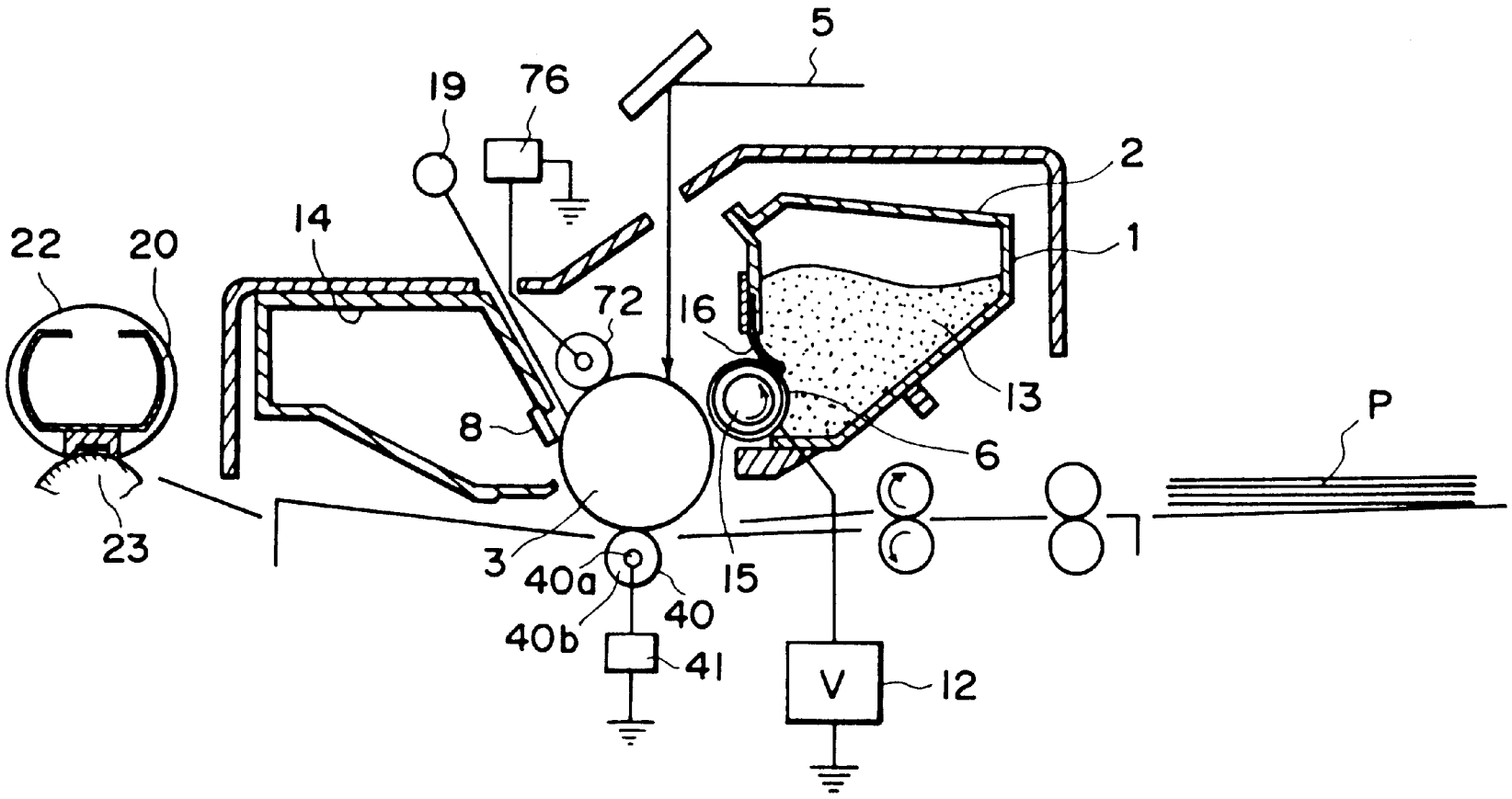
FIG. 6 is a schematic illustration of another example of image forming apparatus to which the toner of the present invention is applicable.
Figure 13:
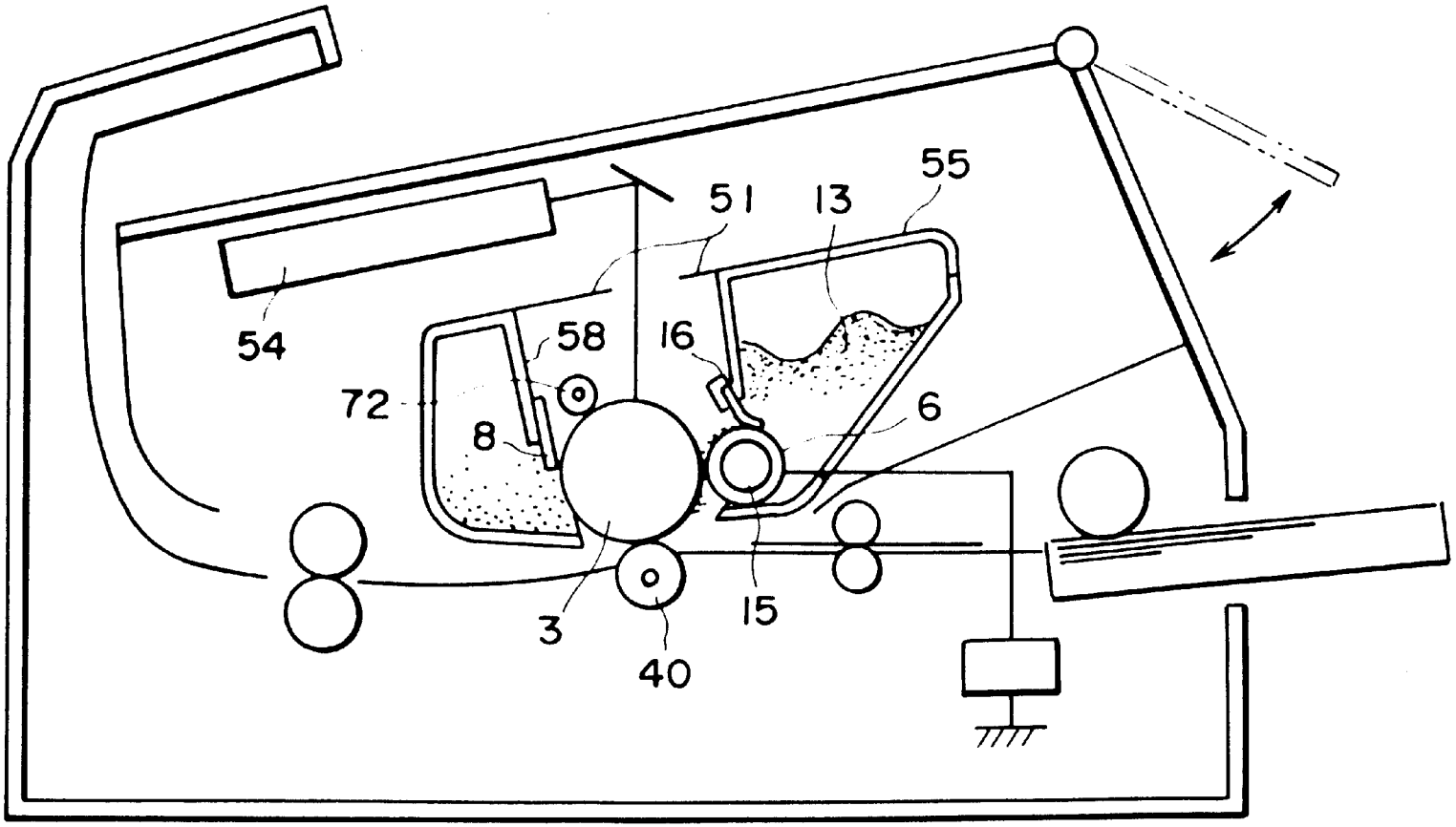
FIG. 13 is a schematic illustration of an LBP printer to which the toner of the present invention is applicable.

The transfer apparatus used in the present invention may suitably comprise a transfer roller 40 as shown in FIG. 6 (or FIG. 13).

The transfer roller 40 comprises a metal core 40*a* and an electroconductive elastic layer 40*b*, and the electroconductive elastic layer comprises an elastic material, such as polyurethane resin or ethylene-propylene-diene terpolymer (EPDM), having a volumetric resistivity of $10^6$–$10^{10}$ ohm.cm, e.g., by dispersing therein an electroconductive material, such as carbon. The core metal 40*a* is supplied with a bias voltage from a constant-voltage power supply 41. Preferred bias conditions may include a current of 0.1–50 $\mu$A and a voltage (absolute value) of 100–5000 volts, more preferably 500–4000 volts.

The transfer roller 40 may preferably be pressed against an electrostatic image-bearing member 3 at a contact linear pressure of at least 3 g/cm as calculated by the following equation:

Linear pressure [g/cm]=(total pressure applied to a transfer-receiving material) [g]/(contact length) [cm]

If the contact pressure is below 3 g/cm, a positional deviation of the transfer-receiving material can be caused and also a transfer failure can be caused due to an insufficient transfer current. The contact pressure may further preferably be at least 20 g/cm, particularly 25–80 g/cm.

Hereinbelow, the present invention will be described based on specific Examples, to which the present invention is however not limited.

Production Example 1 for resin composition

Synthesis of low-molecular weight polymer (L-1)

300 wt. parts of xylene was placed in a four-necked flask, and the interior of the flask was sufficiently aerated with nitrogen under stirring. Then, the xylene was heated and subjected to refluxing.

Under the refluxing condition, a mixture of 85 wt. parts of styrene, 15 wt. parts of n-butyl acrylate and 2 wt. parts of di-tertbutyl peroxide was added dropwise in 4 hours. The system was held for 2 hours to complete the polymerization to obtain a solution of a low-molecular weight polymer (L-1).

A part of the polymer solution was sampled and dried under a reduced pressure to recover the low-molecular weight polymer (L-1), which was then subjected to GPC (gel permeation chromatography) and measurement of glass transition temperature (Tg). As a result, the polymer (L-1) showed a weight-average molecular weight (Mw) of 9,400, a number-average molecular weight (Mn) of 5,900, a peak molecular weight (PMW) of 8,100, and a Tg of 63° C.

The polymer conversion at that time was 97%.

Synthesis of high-molecular weight polymer (H-1)

In a four-necked flask, 180 wt. parts of degassed water and 20 wt. parts of 2 wt. % polyvinyl alcohol aqueous solution were placed, and then a mixture liquid of 70 wt. parts of styrene, 25 wt. parts of n-butyl acrylate, 5 wt. parts of monobutyl maleate, 0.005 wt. part of divinylbenzene and 0.1 wt. part of 2,2-bis(4,4-di-tert-butylperoxycyclohexyl) propane (a 10 hour-halflife temperature ($T_{10h}$)=92° C.) was added thereto, followed by stirring to form a suspension liquid.

The interior of the flask was sufficiently aerated with nitrogen, and then the system was heated to 85° C. to initiate the polymerization. After 24 hours at the temperature, 0.1 wt. part of benzoyl peroxide ($T_{10h}$=72° C.) was added, and the system was further held at the temperature for 12 hours to complete the polymerization.

To the suspension liquid after the reaction, an NaOH aqueous solution in an amount of 6 times equivalent to the acid value (AV=7.8) of the resultant high-molecular weight polymer (H-1) was added, and the system was stirred for 2 hours.

The resultant high-molecular weight polymer (H-1) was filtered out, washed with water, dried and, as a result of measurement, showed Mw=$1.8\times10^6$, PMW=$1.2\times10^6$ and Tg=62° C.

Production of binder resin

In a four-necked flask, 100 wt. parts of xylene, 25 wt. parts of the above high-molecular weight polymer (H-1) and 4 wt. parts of polypropylene (Mw=6,000) were placed and heated and stirred under reflux to effect preliminary dissolution. The system was retained for 12 hours in the state to obtain a preliminary solution (Y-1) wherein the polymer H-1 and the polypropylene were uniformly mixed.

A part of the preliminary solution was sampled and dried under a reduced pressure to recover a solid matter which showed Tg of 61° C.

Separately, 300 wt. parts of the above-mentioned uniform solution of low-molecular weight polymer (L-1) was placed in another vessel and refluxed.

The above preliminary solution (Y-1) and low-molecular weight polymer (L-1) solution were blended under reflux, followed by distilling-off of the organic solvent to recover a resin, which was then cooled and, after being solidified, pulverized to obtain a resin composition (I).

As a result of the measurement, the resin composition (I) showed PMW=$1.1\times10^6$, an areal percentage occupied by a molecular weight portion of $10^6$ or above on its GPC chromatogram (A(≧$10^6$))=9.2%, Tg=64° C., and a THF-insoluble content of 2.1 wt. %.

Production Example 2 for resin composition

Synthesis of low-molecular weight polymer (L-2)

300 wt. parts of xylene was placed in a glass autoclave, and the interior of the autoclave was sufficiently aerated with nitrogen under stirring. Then, the autoclave was closed and the xylene was heated to 200° C.

While keeping the reflux under pressure, a mixture of 70 parts of styrene and 2 wt. parts of di-tertbutyl peroxide was added dropwise in 2.5 hours. The system was held for further 1 hour to complete the polymerization to obtain a solution of a low-molecular weight polymer (L-2).

A part of the polymer solution was sampled and dried under a reduced pressure to recover the low-molecular weight polymer (L-2). The polymer (L-2) showed Mw=5,000, PMW=3,700, and Tg=64° C. The polymer conversion was 98%.

Production of binder resin

In a four-necked flask, 200 wt. parts of xylene, 50 wt. parts of the above-mentioned high-molecular weight polymer (H-1) and 4 wt. parts of polypropylene (Mw=6,000) were placed and heated and stirred under reflux to effect preliminary dissolution. The system was retained for 12 hours in the state to obtain a preliminary solution (Y-2) wherein the polymer H-1 and the polypropylene were uniformly mixed.

The solid matter in the preliminary solution showed Tg=61.5° C.

The above preliminary solution (Y-2) and 200 wt. parts of the low-molecular weight polymer (L-2) solution were blended under reflux, followed by distilling-off of the organic solvent to recover a resin, which was then cooled and, after solidification, pulverized to obtain a resin composition (II).

The resin composition (II) showed PMW=$1.1\times10^6$, A(≧$10^6$)=16.4%, Tg=61.7° C. and a THF-insoluble content of 2.9%.

Production Example 3 for resin composition

Synthesis of low-molecular weight polymer (L-3)

A low-molecular weight polymer (L-3) solution was prepared in the same manner as in Synthesis of low-molecular weight (L-1) in Production Example 1 except that the starting monomer mixture was changed to one of 84 wt. parts of styrene, 16 wt. parts of n-butyl acrylate, and 6 wt. parts of di-tert-butyl peroxide.

A part of the polymer solution was sampled and dried under a reduced pressure to recover the low-molecular weight polymer (L-3). The polymer (L-3) showed Mw=30,000, Mn=15,000, PMW=28,000, and Tg=63.2° C. The polymer conversion was 97%.

Production of binder resin

In a four-necked flask, 100 wt. parts of xylene, 10 wt. parts of the above-mentioned high-molecular weight polymer (H-1) and 4 wt. parts of polypropylene (Mw=6,000) were placed and heated and stirred under reflux to effect preliminary dissolution. The system was retained for 12 hours in the state to obtain a preliminary solution (Y-3) wherein the polymer H-1 and the polypropylene were uniformly mixed.

The solid matter in the preliminary solution showed Tg=60.5° C.

The above preliminary solution (Y-3) and 360 wt. parts of the low-molecular weight polymer (L-3) solution were blended under reflux, followed by distilling-off of the organic solvent to recover a resin, which was then cooled and, after solidification, pulverized to obtain a resin composition (III).

The resin composition (III) showed PMW=$1.1\times10^6$, A(≧$10^6$)=4.0%, Tg=61.0° C. and a THF-insoluble content of 1.0%.

Production Examples 4–7 for resin composition

Synthesis of high-molecular weight polymers (H-2 to H-5)

High-molecular weight polymers (H-2 to H-5) were prepared in the same manner as in Synthesis of high-molecular weight polymer (H-1) in the above-mentioned Production Example 1 except that the amounts (wt. parts) of the monobutyl maleate (MB) and the divinylbenzene (DVB) were respectively changed as shown in Table 2 appearing hereinafter.

All the high-molecular weight polymers thus obtained showed Mw≧$1.0\times10^6$ and PMW≧$8.0\times10^5$.

Production of binder resins

In a four-necked flask, 100 wt. parts of xylene, 25 wt. parts of one of the above-prepared high-molecular weight polymers (H-2 to H-5) and 6 wt. parts of polyethylene (Mw=30,000) were placed, and preliminary dissolution was performed in the same manner as in the above Production Example 1. The resultant preliminary solution was blended with the low-molecular weight polymer (L-1) solution.

The above-operation was repeated to obtain resin compositions IV–VII, the measured values thereof are shown in Table 3.

TABLE 2

| | | Resin composition | High-molecular weight polymer: Polymer name | Monomer amounts*1: MB*2 | Monomer amounts*1: DVB*2 |
|---|---|---|---|---|---|
| P. Ex. | 4 | (IV) | H-4 | 1.0 | 0.1 |
| | 5 | (V) | H-5 | 1.0 | 0.001 |
| | 6 | (VI) | H-6 | 10 | 0.1 |
| | 7 | (VII) | H-7 | 10 | 0.001 |

*1: wt. parts
*2: MB: monobutylmaleate
DVB: divinylbenzene

TABLE 3

| | | Resin composition | Molecular weight distribution: PMW ($\times10^4$) | Molecular weight distribution: A (≧$10^6$) (%) | Molecular weight distribution: Tg (° C.) | THF-insoluble (wt. %) |
|---|---|---|---|---|---|---|
| Production Example | 4 | (IV) | 110 | 2.7 | 62.3 | 7.2 |
| | 5 | (V) | 82 | 7.5 | 62.1 | 0.9 |
| | 6 | (VI) | 130 | 3.1 | 62.5 | 8.4 |
| | 7 | (VII) | 90 | 8.1 | 62.6 | 0.8 |

Comparative Production Example 1 for resin composition

Synthesis of high-molecular weight polymer (H-6)

A mixture of 70 wt. parts of styrene, 25 wt. parts of n-butyl acrylate and 5 wt. parts of monobutyl maleate was subjected to bulk polymerization, and xylene was added to the system to complete the polymerization by solution polymerization, thereby obtaining a high-molecular weight polymer (H-6).

The high-molecular weight polymer (H-6) showed Mw=$1.3\times10^6$, PMW=$0.65\times10^6$ and Tg=62° C.

Production of binder resin

In a four-necked flask, 300 wt. parts of xylene, 70 wt. parts of the low-molecular weight polymer (L-1), the above high-molecular weight polymer (H-6) and 4 wt. parts of polypropylene were simultaneously placed and then heated and stirred under reflux for 24 hours, followed by distilling-off of the solvent. The resultant resin was cooled to be solidified and pulverized to obtain a comparative resin composition (i).

The comparative resin composition (i) showed PMW= $0.59\times10^6$, A($\geqq10^6$)=6.7% and a THF-insoluble content of 0.4 wt. %.

Comparative Production Example 2 for resin composition

Synthesis of high-molecular weight polymer (H-7)

A mixture of 57 wt. parts of styrene, 40 wt. parts of butyl methacrylate and 3 wt. parts of acrylic acid was subjected to bulk polymerization, and xylene was added to the system to complete the polymerization by solution polymerization, thereby obtaining a high-molecular weight polymer (H-7).

The high-molecular weight polymer (H-7) showed Mw=$0.9\times10^6$, PMW=$0.50\times10^6$ and Tg=64° C.

Production of binder resin

A comparative resin composition (ii) was prepared in the same manner as in Comparative Production Example 1 except that the above high-molecular weight polymer (H-7) was used instead of (H-6).

The comparative resin composition (ii) showed PMW= $0.45\times10^6$, A($\geqq10^6$)=5.2% and a THF-insoluble content of 6.8 wt. %.

Comparative Production Example 3 for resin composition

Synthesis of low-molecular weight polymer (L-4)

A low-molecular weight polymer (L-4) was prepared in the same manner as in Synthesis of low-molecular weight polymer (L-1) in the above-mentioned Production Example 1 except that a monomer mixture comprising 70 wt. parts of styrene, 25 wt. parts of n-butyl acrylate, 5 wt. parts of monobutyl maleate and 6 wt. parts of di-tert-butyl peroxide was used.

The low-molecular weight polymer (L-4) showed Mw=9, 900, Mn=5,300, PMW=8,500 and Tg=65° C.

Production of binder resin

A comparative resin composition (iii) was prepared in the same manner as in Comparative Production Example 1 except that the above low-molecular weight polymer (L-4) was used instead of (L-1).

The comparative resin composition (iii) showed PMW= $0.60\times10^6$, and A($\geqq10^6$)=6.7%.

Comparative Production Example 4 for resin composition

Synthesis of high-molecular weight polymer (H-8)

A mixture of 70 wt. parts of styrene, 25 wt. parts of n-butyl acrylate and 0.1 wt. part of divinylbenzene was subjected to bulk polymerization, and xylene was added to the system to complete the polymerization by solution polymerization, thereby obtaining a high-molecular weight polymer (H-8).

The high-molecular weight polymer (H-8) showed Mw=$3.0\times10^6$, PMW=$1.40\times10^6$ and Tg=62.5° C.

Production of binder resin

A comparative resin composition (iv) was prepared in the same manner as in Comparative Production Example 1 except that the above high-molecular weight polymer (H-8) was used instead of (H-6).

The comparative resin composition (iv) showed PMW= $1.30\times10^6$, A($\geqq10^6$)=4.0%, Tg=62.9° C. and a THF-insoluble content of 8.1 wt. %.

Comparative Production Example 5 for resin composition

Production of binder resin

A comparative resin composition (v) was prepared in the same manner as in Comparative Production Example 4 except that 6 wt. parts of polyethylene (Mw=30,000) was used instead of the polypropylene.

The comparative resin composition (v) showed PMW= $1.3\times10^6$, A($\geqq10^6$)=8.1%, Tg=62.6° C. and a THF-insoluble content of 8.4 wt. %.

Comparative Production Example 6 for resin composition

Synthesis of high-molecular weight polymer (H-9)

A high-molecular weight polymer (H-9) was prepared in the same manner as in Synthesis of high-molecular weight polymer (H-6) in the above-mentioned Comparative Production Example 1 except that the monobutyl maleate was used in an amount of 10 wt. parts.

The high-molecular weight polymer (H-9) showed Mw=$1.4\times10^6$, PMW=$0.8\times10^6$ and Tg=63° C.

Production of binder resin

A comparative resin composition (vi) was prepared in the same manner as in Comparative Production Example 5 except that the above high-molecular weight polymer (H-9) was used.

The comparative resin composition (vi) showed PMW= $0.79\times10^6$, A($\geqq10^6$)=6.8%, Tg=62.7° C. and a THF-insoluble content of 8.4 wt. %.

Comparative Production Example 7 for resin composition

Synthesis of high-molecular weight polymer (H-10)

A high-molecular weight polymer (H-10) was prepared in the same manner as in Synthesis of high-molecular weight polymer (H-6) in the above-mentioned Comparative Production Example 1 except that a monomer mixture comprising 70 wt. parts of styrene, 25 wt. parts of n-butyl acrylate, 1 wt. part of monobutyl maleate, 0.1 wt. part of divinylbenzene and 1 wt. part of benzoyl peroxide was used.

The high-molecular weight polymer (H-10) showed Mw=$2.9\times10^6$, PMW=$1.2\times10^6$ and Tg=62.3° C.

Production of binder resin

A comparative resin composition (vii) was prepared in the same manner as in Comparative Production Example 1 except that the above high-molecular weight polymer (H-10) was used.

The comparative resin composition (vii) showed PMW= $1.0\times10^6$, A($\geqq10^6$)=5.1%, Tg=62.7° C., and a THF-insoluble content of 14.3 wt. %.

Examples 1–3 and Comparative Examples 1–4

The resin compositions (I)–(III) prepared in the above Production Examples and the comparative resin compositions (i)–(iv) prepared in the Comparative Production Examples each in an amount of 100 wt. parts were respectively uniformly blended with 100 wt. parts of magnetic material fine powder (number-average particle size=0.2 $\mu$m) and 1 wt. part of a negative charge control agent (azo dye-based chromium complex, the above-mentioned Complex [I]-2), and each blend was melt-kneaded through a twin-screw extruder (L/D=30) heated at 110° C. The kneaded products were cooled, coarsely crushed by a hammer mill and finely pulverized by a jet mill. The pulverized products were classified pneumatically to obtain magnetic toners and comparative magnetic toners each having a weight-average particle size of 6.5 $\mu$m.

Each magnetic toner in an amount of 100 wt. parts was dry-blended with 1.2 wt. parts of hydrophobic silica fine powder (BET specific surface area ($S_{BET}$)=180 $m^2/g$). Thus, magnetic toners (A)–(C) and comparative magnetic toners (a)–(d) were prepared.

The resultant magnetic toners respectively showed properties as given in Table 4 below.

TABLE 4

| | | Toner No. | Molecular weight distribution* LMW-side peak value ×10⁴ | HMW-side peak value ×10⁴ | A (≧10⁶) (%) | MI (g/10 min.) | THF-insoluble (wt. %) | Dynamic viscoelasticities G" (dyn/cm²) 150° C. | 200° C. | $\tan\delta_{150}/\tan\delta_{200}$ |
|---|---|---|---|---|---|---|---|---|---|---|
| Ex. | 1 | A | 0.81 | 66 | 5.1 | 12.9 | 0.9 | $2.2 \times 10^4$ | $8.6 \times 10^3$ | 1.3 |
| | 2 | B | 0.36 | 62 | 8.6 | 5.4 | 1.3 | $3.3 \times 10^4$ | $1.3 \times 10^4$ | 1.2 |
| | 3 | C | 2.7 | 70 | 3.2 | 22.8 | 0.5 | $7.6 \times 10^3$ | $1.8 \times 10^4$ | 1.9 |
| Comp. | 1 | a | 0.81 | 34 | 0.7 | 27.3 | 0.3 | $1.4 \times 10^4$ | $9.0 \times 10^3$ | 2.1 |
| Ex. | 2 | b | 0.81 | 27 | 10.3 | 6.7 | 4.4 | $1.9 \times 10^5$ | $6.1 \times 10^4$ | 1.1 |
| | 3 | c | 0.85 | 40 | 1.9 | 4.3 | 6.0 | $3.4 \times 10^4$ | $1.4 \times 10^4$ | 0.94 |
| | 4 | d | 0.81 | 55 | 12.3 | 15.5 | 1.4 | $2.1 \times 10^4$ | $1.0 \times 10^4$ | 1.2 |

*LMW stands for "low-molecular weight".
HMW stands for "high-molecular weight".

Examples 4–7 and Comparative Examples 5–7

The resin compositions (IV)–(VII) prepared in the above Production Examples and the comparative resin compositions (v)–(vii) prepared in the Comparative Production Examples each in an amount of 100 wt. parts were respectively uniformly blended with 6 wt. parts of carbon black ($S_{BET}$=130 $m^2/g$) and 2 wt. parts of a negative charge control agent (salicylic acid chromium complex, the above-mentioned Complex [II]-3). The respective blends were processed in a similar manner as in the above-mentioned Examples 1–3, etc., to prepare non-magnetic toners and comparative non-magnetic toners each having a weight-average particle size of 6.7 $\mu$m.

Each non-magnetic toner in an amount of 100 wt. parts was dry-blended with 1.2 wt. parts of hydrophobic titanium oxide fine powder ($S_{BET}$=130 $m^2/g$). Thus, non-magnetic toners (D)–(G) and comparative non-magnetic toners (f)–(k) were prepared.

The resultant non-magnetic toners respectively showed properties as given in Table 5 below.

TABLE 5

| | | Toner No. | Molecular weight distribution* LMW-side peak value ×10⁴ | HMW-side peak value ×10⁴ | A (≧10⁶) (%) | MI (g/10 min.) | THF-insoluble (wt. %) | Dynamic viscoelasticities G" (dyn/cm²) 150° C. | 200° C. | $\tan\delta_{150}/\tan\delta_{200}$ |
|---|---|---|---|---|---|---|---|---|---|---|
| Ex. | 4 | D | 0.81 | 51 | 9.7 | 18.4 | 2.9 | $1.1 \times 10^4$ | $2.7 \times 10^3$ | 1.4 |
| | 5 | E | 0.81 | 39 | 4.9 | 22.0 | 0.4 | $5.5 \times 10^3$ | $1.3 \times 10^3$ | 1.5 |
| | 6 | F | 0.81 | 59 | 9.1 | 13.9 | 4.8 | $2.0 \times 10^4$ | $3.9 \times 10^3$ | 1.1 |
| | 7 | G | 0.81 | 41 | 4.2 | 15.2 | 0.4 | $9.2 \times 10^3$ | $2.8 \times 10^3$ | 1.2 |
| Comp. | 5 | e | 0.81 | 54 | 11.2 | 26.6 | 2.5 | $1.1 \times 10^4$ | $9.2 \times 10^3$ | 2.3 |
| Ex. | 6 | f | 0.81 | 38 | 2.7 | 24.3 | 0.5 | $1.3 \times 10^4$ | $8.9 \times 10^3$ | 0.98 |
| | 7 | g | 0.81 | 49 | 14.6 | 3.9 | 6.3 | $2.2 \times 10^5$ | $7.7 \times 10^4$ | 1.0 |

Image forming apparatus used in evaluation of the above-prepared toners will now be described.

Figure 3:
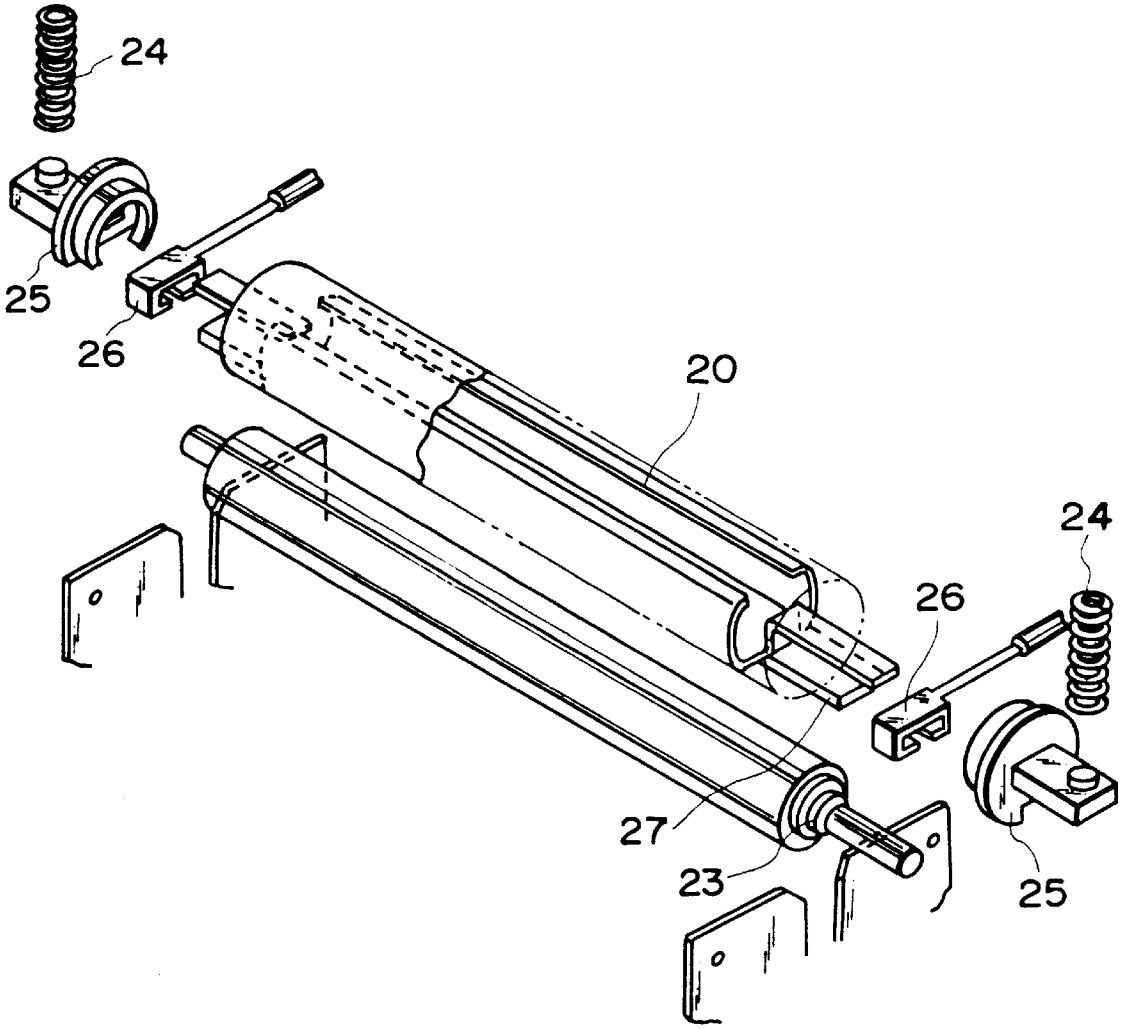
FIG. 3 is an exploded perspective view of a fixing apparatus which can be suitably used for fixing the toner according to the present invention.
Figure 4:
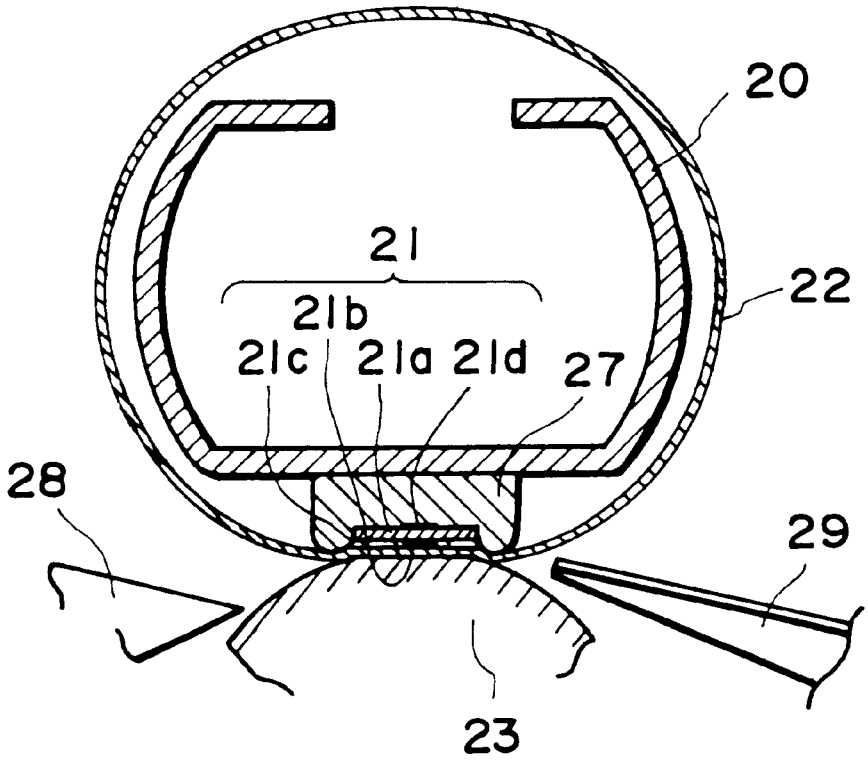
FIG. 4 is a sectional view of a fixing apparatus which can be suitably used for fixing the toner according to the present invention.

For evaluation of the magnetic toners A–C in Examples 1–3 and the comparative magnetic toners a–d in Comparative Examples 1–4, a commercially available laser beam printer ("LBP-SX", available from Canon K.K.) was remodeled by replacing the iron blade in the process cartridge with an elastic blade 16 of urethane rubber as shown in FIG. 1 and replacing the heat-fixing apparatus with a fixing apparatus as shown in FIG. 1 (and also in FIG. 3 (exploded perspective view) and FIG. 4 (sectional view)) to form a remodeled LBP printer.

Figure 2:
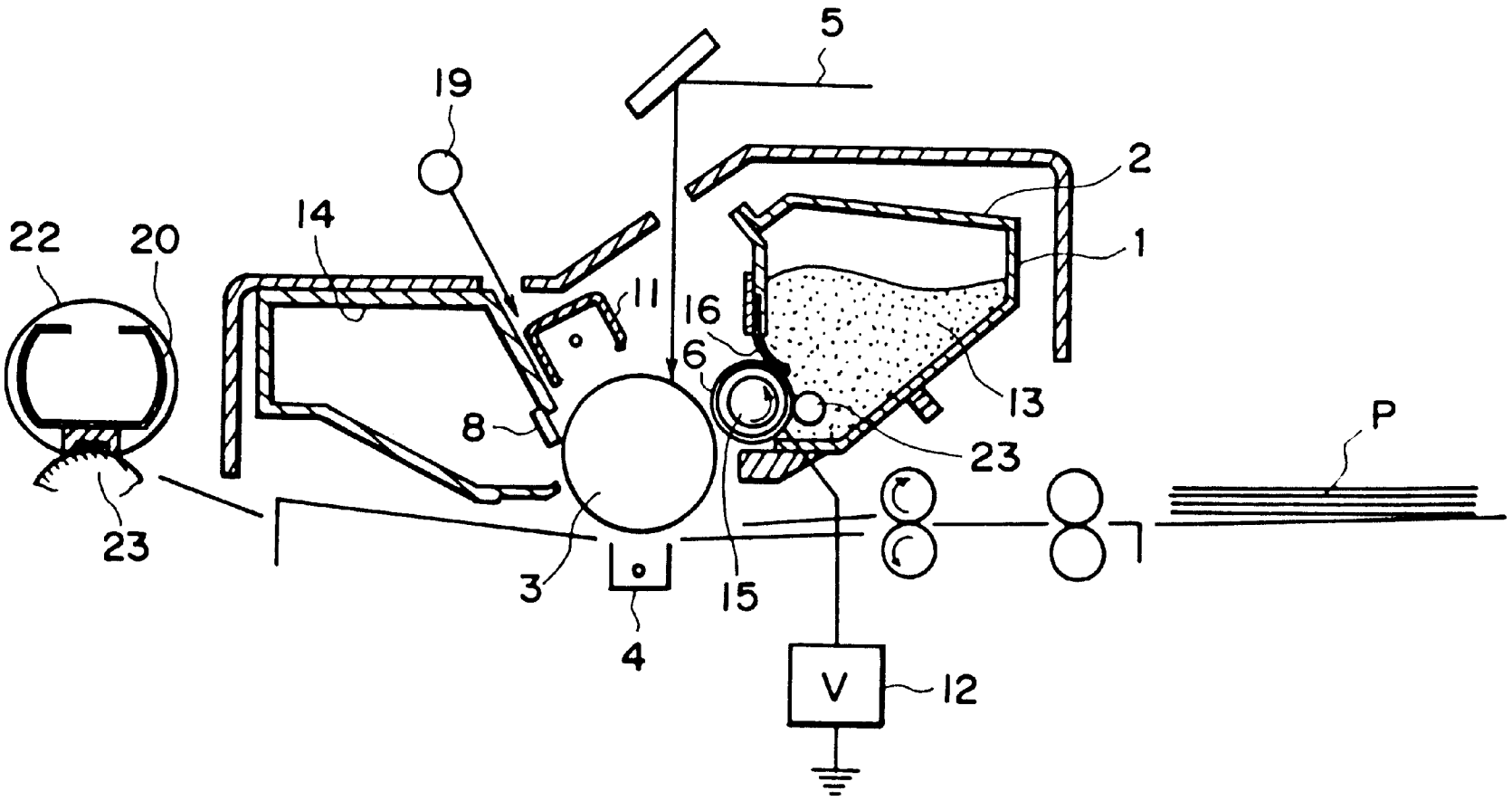

For evaluation of the non-magnetic toners D–G in Examples 4–7 and the comparative non-magnetic toners e–g in Comparative Examples 5–7, a commercially available laser beam printer ("LBP-SX", available from Canon K.K.) was remodeled by replacing the iron blade in the process cartridge with an elastic blade 16 of urethane rubber and disposing a coating roller 23 as shown in FIG. 2 and replacing the heat-fixing apparatus with a fixing apparatus as shown in FIG. 2 (and also in FIG. 3 (exploded perspective view) and FIG. 4 (sectional view)) to form a remodeled LBP printer.

Image formation was performed in the following manner.

Referring to FIG. 1 or 2, an electrostatic image was formed on a photosensitive drum 3 by setting a primary charging voltage to −600 V, and a spacing (300 $\mu$m) was set between the photosensitive drum 3 and a developer-carrying member 6 (containing a magnetic inside thereof) so that the developer layer formed on the developer-carrying member (developing sleeve) 6 did not contact the photosensitive drum. Under application of an AC bias (f=1800 Hz, Vpp=1200 V) superposed with a DC bias ($V_{DC}$=−400 V) to the developing sleeve 6 by a bias supply, an electrostatic image formed with a light-part potential $V_L$ of −150 V was developed by reversal development to form a toner image on the OPC photosensitive drum. The resultant toner image was then transferred to plain paper by applying a positive transfer potential from a transfer supply 4. The plain paper P carrying the toner image was passed through the heat-fixing apparatus 20. In the heat-fixing apparatus, the surface temperature of a temperature sensor 21*d* of a heating member 21 was set to 150° C., the total pressure between the heating member 21—pressure roller 23 was set to 6 kg, and the nip between the pressure roller and a tension-free fixing film 22 was set to 3 mm. The fixing film 22 comprises a 60 $\mu$m-thick heat-resistant polyimide film having a low-resistivity release layer comprising PTFE (polytetrafluoroethylene) with electroconductive substance dispersed therein on its surface contacting the plain paper P.

Under the above-set conditions, printing tests of continuous 4000 sheets were performed at a printing speed of 8 A4-size sheets/min. in a normal temperature—normal humidity environment (25° C.—60% RH) and in a high temperature—high humidity environment (30° C.—80% RH). The resultant images were evaluated with respect to the following items and the results thereof are inclusively shown in Table 6 based on the following standards.

(1) Image density

The density of an image formed on an ordinary plain paper for copying machine (75 g/m$^2$) after printing 3000 sheets was evaluated by a MacBeth Reflection Densitometer (available from MacBeth Co.) as a relative density against a density of 0.00 allotted to a printed white background portion, and the results are evaluated according to the following standards.

⊙ (excellent): 1.40 or above

○ (good): at least 1.35 and below 1.40

Δ (fair): at least 1.00 and below 1.35

× (not acceptable): below 1.00

(2) Image quality

Figure 5:
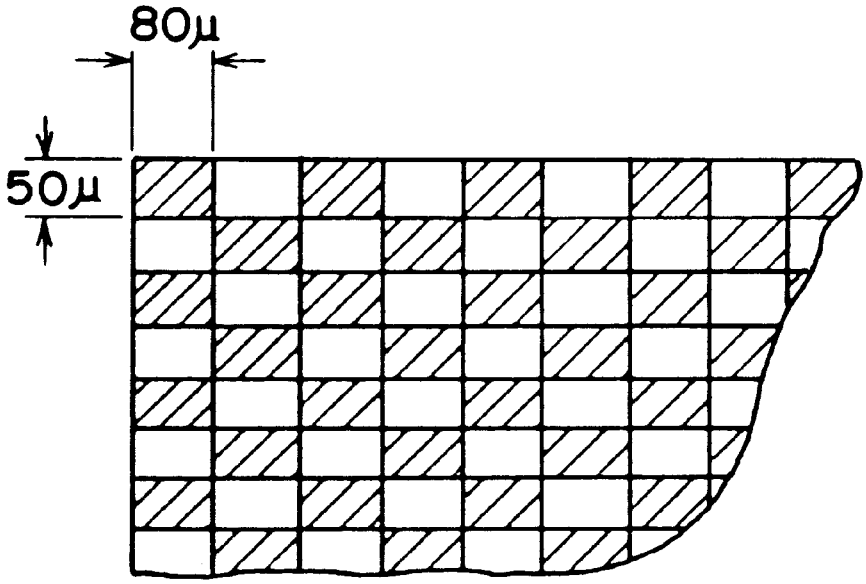
FIG. 5 is a partial enlarged illustration of a checker pattern used for evaluation of image quality.

A checker pattern shown in FIG. 5 was printed out and the dot reproducibility was evaluated by counting the number of lacked dots. The results were evaluated according to the following standards:

⊙ (very good): lack of 2 dots or less/100 dots

○ (good): lack of 3–5 dots/100 dots

Δ (practically acceptable): lack of 6–10 dots/100 dots

× (practically unacceptable): lack of 11 dots or more/100 dots

Further, image fog (%) was evaluated as a difference between the whiteness of a white background portion of a printed image and the whiteness of an original transfer paper by measurement with "Reflectometer" (available from Tokyo Denshoku K.K.). The results are indicated according to the following standards:

⊙ (very good): below 1.5%

○ (good): at least 1.5% and below 2.5%

Δ (practically acceptable): at least 2.5% and below 4.0%

× (practically unacceptable): at least 4%

(3) Storage stability

A developer was stored in a drier set at 45° C. for 1 week and the stored developer was subjected to a similar printing test in the high temperature—high humidity environment, and the storage stability was evaluated based on the image density and image quality of the resultant images.

(4) Fixability

A fixed image was rubbed with a soft tissue paper under a load of 50 g/cm$^2$, and the fixability was evaluated by a lowering (%) in image density after the rubbing. The results were evaluated according to the following standards.

⊙ (excellent): 5% or below

○ (good): at least 5% and below 10%

Δ (fair): at least 10% and below 20%

× (not acceptable): at least 20%

(5) Anti-offset characteristic

A sample image having an image percentage of about 5% was printed out, and the anti-offset characteristic was evaluated by the degree of soiling on the image after printing of 3000 sheets. The results were evaluated by the following standards.

⊙: Very good (non-observable)

○: Good (substantially non-observable)

Δ: Practically acceptable

×: Practically unacceptable

On the other hand, after the printing test, the state of residual toner sticking onto the developing sleeve surface and the influence thereof on the printed images were evaluated by observation with eyes. The results were evaluated according to the following standards.

⊙: Very good (not observable)

○: Good (substantially non-observable)

Δ: Practically acceptable (sticking was observed but did not affect the images)

×: Practically unacceptable (much sticking was observed and resultant in image irregularity)

Similarly, the occurrence of scars and residual toner on the photosensitive drum surface and the influence thereof on the printed images were evaluated by observation with eyes.

⊙: Very good (non-observable)

○: Good (the occurrence of slight scar was observable but did not affect the images)

Δ: Practically acceptable (sticking and scars were observed but little affected the images)

×: Practically unacceptable (much sticking was observed and caused streak-like image irregularity)

The fixing film surface was observed and the durability thereof was evaluated.

(1) Surface state

The occurrence of scars or abrasion on the fixing film after the printing test was observed and evaluated with eyes according to the following standards.

⊙: Very good (non-observable)

○: Good (substantially non-observable)

Δ: Practically acceptable

×: Practically unacceptable (2) Sticking of residual toner

Sticking of residual toner on the fixing film after the printing test was observed with eyes and evaluated according to the following standards.

⊙: Very good (non-observable)

○: Good (substantially non-observable)

Δ: Practically acceptable

×: Practically unacceptable

The results of the above evaluation are summarized in the following Tables 6 and 7.

TABLE 6

| | | Toner No. | Resin composition | Printed image evaluation: N.T.-N.H.*1 Image density | N.T.-N.H.*1 Dot*2 | N.T.-N.H.*1 Fog | H.T.-H.H.*1 Image density | H.T.-H.H.*1 Dot*2 | H.T.-H.H.*1 Fog | Storage stability Image density | Storage stability Dot*2 | Storage stability Fog | Fixability | Anti-offset |
|---|---|---|---|---|---|---|---|---|---|---|---|---|---|---|
| Ex. | 1 | (A) | (I) | ◎ | ◎ | ◎ | ◎ | ◎ | ◎ | ◎ | ◎ | ○ | ◎ | ◎ |
| | 2 | (B) | (II) | ◎ | ○ | ○ | ◎ | ○ | Δ | ◎ | ○ | Δ | ○ | ○ |
| | 3 | (C) | (III) | ○ | ○ | ○ | ○ | ○ | ○ | ○ | ○ | ○ | ◎ | Δ |
| | 4 | (D) | (IV) | ◎ | ◎ | ◎ | ○ | ○ | ○ | ○ | ○ | ○ | ◎ | ○ |
| | 5 | (E) | (V) | ○ | ◎ | ◎ | ○ | ○ | Δ | ○ | ○ | Δ | ◎ | Δ |
| | 6 | (F) | (VI) | ◎ | ◎ | ○ | ○ | ○ | ○ | ○ | ○ | ○ | ○ | ◎ |
| | 7 | (G) | (VII) | ◎ | ○ | ◎ | ○ | ○ | ○ | ○ | ○ | ○ | ◎ | ◎ |
| Comp. Ex. | 1 | (a) | (i) | ○ | Δ | Δ | Δ | Δ | Δ | Δ | Δ | Δ | Δ | x |
| | 2 | (b) | (ii) | ○ | Δ | Δ | Δ | Δ | x | Δ | Δ | x | Δ | Δ |
| | 3 | (c) | (iii) | Δ | Δ | x | Δ | x | x | Δ | x | x | Δ | x |
| | 4 | (d) | (iv) | ○ | Δ | Δ | ○ | Δ | x | ○ | Δ | x | ○ | x |
| | 5 | (e) | (v) | x | x | Δ | x | Δ | Δ | x | Δ | Δ | Δ | x |
| | 6 | (f) | (vi) | Δ | Δ | Δ | Δ | Δ | Δ | Δ | Δ | Δ | ○ | Δ |
| | 7 | (g) | (vii) | ○ | ○ | x | ○ | ○ | x | ○ | ○ | x | x | ○ |

*1N.T.-N.H. = normal temperature - normal humidity
H.T.-H.H. = high temperature - high humidity
*2Dot reproducibility

TABLE 7

| | | Developing sleeve surface state | Photosensitive drum surface state | Fixing film: Surface state | Fixing film: Sticking |
|---|---|---|---|---|---|
| Ex. 1 | 1 | ◎ | ◎ | ◎ | ◎ |
| | 2 | Δ | ○ | ◎ | Δ |
| | 3 | Δ | ◎ | ◎ | Δ |
| | 4 | Δ | ○ | ○ | Δ |
| | 5 | Δ | ○ | ○ | Δ |
| | 6 | ◎ | Δ | Δ | ○ |
| | 7 | ○ | ○ | ○ | ○ |
| Comp. Ex. | 1 | x | ○ | ○ | x |
| | 2 | x | x | x | x |
| | 3 | x | x | x | x |
| | 4 | Δ | Δ | Δ | ○ |
| | 5 | x | Δ | x | x |
| | 6 | x | Δ | Δ | x |
| | 7 | Δ | x | x | x |

Production Example 8 for resin composition

Synthesis of low-molecular weight polymer (L-5)

300 wt. parts of xylene was placed in a four-necked flask, and the interior of the flask was sufficiently aerated with nitrogen under stirring. Then, the xylene was heated and subjected to refluxing.

Under the refluxing condition, a mixture of 86 wt. parts of styrene, 14 wt. parts of n-butyl acrylate and 2 wt. parts of di-tertbutyl peroxide was added dropwise in 4 hours. The system was held for 2 hours to complete the polymerization to obtain a solution of a low-molecular weight polymer (L-5).

A part of the polymer solution was sampled and dried under a reduced pressure to recover the low-molecular weight polymer (L-5), which was then subjected to GPC (gel permeation chromatography) and measurement of glass transition temperature (Tg). As a result, the polymer (L-5) showed a weight-average molecular weight (Mw) of 9,500, a number-average molecular weight (Mn) of 6,000, a peak molecular weight (PMW) of 8,400, and a Tg of 64° C.

The polymer conversion at that time was 97%.

Synthesis of high-molecular weight polymer (H-11)

In a four-necked flask, 180 wt. parts of degassed water and 20 wt. parts of 2 wt. % polyvinyl alcohol aqueous solution were placed, and then a mixture liquid of 65 wt. parts of styrene, 27 wt. parts of n-butyl acrylate, 5 wt. parts of monobutyl maleate, 0.005 wt. part of divinylbenzene and 0.1 wt. part of 2,2-bis(4,4-di-tert-butylperoxycyclohexyl) propane (a 10 hour-halflife temperature ($T_{10h}$)=92° C.) was added thereto, followed by stirring to form a suspension liquid.

The interior of the flask was sufficiently aerated with nitrogen, and then the system was heated to 85° C. to initiate the polymerization. After 24 hours at the temperature, 0.1 wt. part of benzoyl peroxide ($T_{10h}$=72° C.) was added, and the system was further held at the temperature for 12 hours to complete the polymerization.

To the suspension liquid after the reaction, an NaOH aqueous solution in an amount of 6 times equivalent to the acid value (AV=7.8) of the resultant high-molecular weight polymer (H-11) was added, and the system was stirred for 2 hours.

The resultant high-molecular weight polymer (H-11) was filtered out, washed with water, dried and, as a result of measurement, showed Mw=$1.8\times10^6$, PMW=$1.2\times10^6$ and Tg=62° C.

Production of binder resin

In a four-necked flask, 100 wt. parts of xylene, 25 wt. parts of the above high-molecular weight polymer (H-11) and 4.5 wt. parts of polypropylene (Mw=6,000) were placed and heated and stirred under reflux to effect preliminary dissolution. The system was retained for 12 hours in the state to obtain a preliminary solution (Y-4) wherein the polymer H-11 and the polypropylene were uniformly mixed.

A part of the preliminary solution was sampled and dried under a reduced pressure to recover a solid matter which showed Tg of 60° C.

Separately, 300 wt. parts of the above-mentioned uniform solution of low-molecular weight polymer (L-5) was placed in another vessel and refluxed.

The above preliminary solution (Y-4) and low-molecular weight polymer (L-5) solution were blended under reflux, followed by distilling-off of the organic solvent to recover a resin, which was then cooled and, after being solidified, pulverized to obtain a resin composition (VIII).

As a result of the measurement, the resin composition (VIII) showed $P_1$MW (first peak molecular weight) –8,400, $P_2MW$ (second peak molecular weight)=$1.04\times10^6$, an areal percentage occupied by a molecular weight portion of $10^6$ or above on its GPC chromatogram ($A(\geqq10^6)$)=9.2%, Tg=61.0° C., and a THF-insoluble content of 0.9 wt. %.

Production Example 9 for resin composition

Synthesis of low-molecular weight polymer (L-6)

300 wt. parts of xylene was placed in a glass autoclave, and the interior of the autoclave was sufficiently aerated with nitrogen under stirring. Then, the autoclave was closed and the xylene was heated to 200° C.

While keeping the reflux under pressure, a mixture of 70 parts of styrene and 3 wt. parts of di-tertbutyl peroxide was added dropwise in 2.5 hours. The system was held for further 1 hour to complete the polymerization to obtain a solution of a low-molecular weight polymer (L-6).

A part of the polymer solution was sampled and dried under a reduced pressure to recover the low-molecular weight polymer (L-6). The polymer (L-6) showed Mw=3,000, Mn=2,800, PMW=4,200, and Tg=62.9° C. The polymer conversion was 98%.

Production of binder resin

In a four-necked flask, 200 wt. parts of xylene, 50 wt. parts of the above-mentioned high-molecular weight polymer (H-11) and 4.5 wt. parts of polypropylene (Mw=6,000) were placed and heated and stirred under reflux to effect preliminary dissolution. The system was retained for 12 hours in the state to obtain a preliminary solution (Y-5) wherein the polymer H-11 and the polypropylene were uniformly mixed.

The solid matter in the preliminary solution showed Tg=60.5° C.

The above preliminary solution (Y-5) and 200 wt. parts of the low-molecular weight polymer (L-6) solution were blended under reflux, followed by distilling-off of the organic solvent to recover a resin, which was then cooled and, after solidification, pulverized to obtain a resin composition (IX).

The resin composition (IX) showed $P_1MW$=4,200, $P_2MW=1.04\times10^6$, $A(\geqq10^6)$=5.1%, Tg=60.8° C. and a THF-insoluble content of 1.4%.

Production Example 10 for resin composition

Synthesis of low-molecular weight polymer (L-7)

A low-molecular weight polymer (L-7) solution was prepared in the same manner as in Synthesis of low-molecular weight polymer (L-5) in Production Example 8 except that the starting monomer mixture was changed to one of 85 wt. parts of styrene, 17 wt. parts of n-butyl acrylate, and 5 wt. parts of di-tert-butyl peroxide.

A part of the polymer solution was sampled and dried under a reduced pressure to recover the low-molecular weight polymer (L-7). The polymer (L-7) showed Mw=35,000, Mn=15,000, PMW=28,000, and Tg=63.1° C. The polymer conversion was 97%.

Production of binder resin

In a four-necked flask, 100 wt. parts of xylene, 10 wt. parts of the above-mentioned high-molecular weight polymer (H-11) and 4.5 wt. parts of polypropylene (Mw=6,000) were placed and heated and stirred under reflux to effect preliminary dissolution. The system was retained for 12 hours in the state to obtain a preliminary solution (Y-6) wherein the polymer H-11 and the polypropylene were uniformly mixed.

The solid matter in the preliminary solution showed Tg=60.5° C.

The above preliminary solution (Y-6) and 360 wt. parts of the low-molecular weight polymer (L-7) solution were blended under reflux, followed by distilling-off of the organic solvent to recover a resin, which was then cooled and, after solidification, pulverized to obtain a resin composition (X).

The resin composition (X) showed $P_1MW$=28,000, $P_2MW=1.04\times10^6$, $A(\geqq10^6)$=4.0%, Tg=60.5° C. and a THF-insoluble content of 0.7%.

Production Example 11 for resin composition

Synthesis of high-molecular weight polymer (H-12)

A high-molecular weight polymer (H-12) was prepared in the same manner as in Synthesis of high-molecular weight polymer (H-11) in the above-mentioned Production Example 8 except that the amount of the monobutyl maleate was changed to 3.0 wt. parts and the amount of divinylbenzene was changed to 0.01 wt. part.

The high-molecular weight polymer (H-12) showed $Mw\geqq1.0\times10^6$ and $PMW\geqq0.8\times10^6$.

Production of binder resin

In a four-necked flask, 100 wt. parts of xylene, 25 wt. parts of the above high-molecular weight polymer (H-12) and 4.5 wt. parts of polyethylene (Mw=30,000) were placed, and preliminary dissolution was performed in the same manner as in the above-mentioned Production Example 8. The resultant preliminary solution was blended with the low-molecular weight polymer (L-5) solution to obtain a binder resin composition (XI).

The resin composition (XI) showed $P_1MW$=8,400, $P_2MW=0.12\times10^6$, $A(\geqq10^6)$=3.7%, Tg=63.2° C. and THF-insoluble content=2.0 wt. %.

The measured values of the above-prepared resin compositions are summarized in the following Table 8.

TABLE 8

| Production | Low-molecular weight polymer | | | | High-molecular weight polymer | | | Binder resin | | | | |
|---|---|---|---|---|---|---|---|---|---|---|---|---|
| Example | Mw | Mn | $P_1Mw$ | Tg | Mw ($\times10^4$) | $P_2Mw$ ($\times10^4$) | Tg (° C.) | $P_2Mw$ ($\times10^4$) | $P_1Mw$ | A ($\geqq10^6$) (%) | Tg | THF-insoluble |
| 8 | 9500 | 6000 | 8400 | 64 | 180 | 110 | 60 | 104 | 8400 | 9.2 | 61.0 | 0.9 |
| 9 | 3000 | 2800 | 4200 | 62.9 | 180 | 110 | 60 | 104 | 4200 | 5.1 | 60.8 | 1.4 |
| 10 | 25000 | 15000 | 28000 | 63.1 | 180 | 110 | 60 | 104 | 28000 | 4.0 | 60.5 | 0.7 |
| 11 | 9500 | 6000 | 8400 | 64 | ≧100 | ≧80 | 62 | 85 | 8400 | 3.7 | 63.2 | 2.0 |

Example 8

100 wt. parts of the resin composition (VIII) prepared in the above Production Example 8 was uniformly blended with 100 wt. parts of magnetic material fine powder (number-average particle size =0.2 μm) and 1 wt. part of a negative charge control agent (azo dye-based chromium complex, the above-mentioned Complex [I]-7), and the blend was melt-kneaded through a twin-screw extruder heated at 110° C. The kneaded product was cooled, coarsely crushed by a hammer mill and finely pulverized by a jet mill. The pulverized product was classified pneumatically to obtain a classified powder (magnetic toner) having a weight-average particle size of 6.3 μm.

Examples 9–11

The resin compositions (IX)–(XI) prepared in the above Production Examples each in an amount of 100 wt. parts were respectively uniformly blended with 100 wt. parts of a magnetic material (number-average particle size=0.2 μm) and 2 wt. parts of a negative charge control agent (salicylic acid chromium complex, the above-mentioned Complex [II]-1). The respective blends were processed in a similar manner as in the above-mentioned Example 8, to prepare classified powders (magnetic toners) each having a weight-average particle size of 6.9 μm.

Example 12

100 wt. parts of the classified powder (magnetic toner) of Example 8 was dry-blended with 1.0 wt. parts of hydrophobic oil-treated silica fine powder (BET specific surface area ($S_{BET}$)=180m$^2$/g) to obtain a magnetic toner H. The resultant magnetic toner H showed properties as given in Table 9 appearing hereinafter.

Then, the magnetic toner H was charged in an image forming apparatus shown in FIG. 6 and more specifically having a contact charger (as shown in FIG. 7), a cleaning device and a heat-fixing device (as shown in FIGS. 3 and 4) and subjected to a printing test of continuously forming a toner image by reversal development on 5000 A4-sheets at a speed of 6 sheets/min. in environments of normal temperature normal humidity (25° C.—60% RH), high temperature high humidity (30° C.—90% RH) and low temperature low humidity (15° C.—10% RH), whereby the printed images were evaluated, and the surface states of the charging member and the photosensitive drum were observed. The image forming apparatus shown in FIG. 6 and used in this Example was similar to the one shown in FIG. 1 and used in Example 1 except for the use of a charging roller 72 having a bias application means 76 and a transfer roller 40 having a bias application means 41. As a result, good images were formed free from a density difference under any environmental conditions. Further, the surfaces of the charging member and the photosensitive member were free from scars or abrasion, or further sticking of residual toner, and good successive image formation characteristics were exhibited.

The conditions for the contact charging, cleaning and heat-fixation were as follows:

Contact charging conditions

Charging roller:

Rmax=80 μm,

R'=1.0×10$^{14}$ ohm.cm, R"=1.5×10$^{9}$ ohm.cm,

Rd=6.0×10$^{4}$ ohm.cm.

Contact pressure of the charging roller against the photosensitive drum=50 g/cm.

Voltage applied to the charging roller:

DC 500 V; AC 1800 Vpp and f=300 Hz.

Cleaning conditions

For the cleaning member, contact linear pressure P=40 g-f/cm, length change rate dL=2%, storage modulus E'=2.4×10$^{7}$ Pa, loss modulus E"=4×10$^{5}$ Pa, $E''_{10}/E''_{60}$ ratio=1.2.

Heat-fixing conditions

A heat-fixing device used had the structure shown in FIGS. 3 and 4 and comprised a 55 μm-thick heat-resistance polyimide film having a low-resistivity release layer comprising PTE with an electroconductive substance dispersed therein on its surface contacting transfer-receiving materials.

A total pressure between the heating member 21 and the pressure roller 23=5.5 kg-f.

A nip between the pressure roller 23 and the film 22=3 mm.

Set temperature=150° C.

Example 13

100 wt. parts of the classified powder (magnetic toner) of Example 9 was dry-blended with 1.2 wt. parts of hydrophobic silica fine powder ($S_{BET}$=150 m$^2$/g) to obtain a magnetic toner I. The resultant magnetic toner I showed properties as given in Table 9 appearing hereinafter.

The magnetic toner I was subjected to a printing test in various environments in a similar manner as in Example 12 by using an apparatus as shown in FIG. 6 but including a charging blade 82 as shown in FIG. 8 operated under the conditions shown below instead of the charging roller 72 shown in FIG. 6 (FIG. 7). As a result, the surfaces of the charging member and the photosensitive drum after the printing test were free from sticking of the toner but were accompanied with slight scars. However, the image qualities were of no problem, and good successive image forming characteristics were exhibited.

Contact charging conditions

Charging blade:

Rmax=72 μm,

R'=1.2×10$^{14}$ ohm.cm, R"=1.5×10$^{9}$ ohm.cm,

Rd=5.5×10$^{4}$ ohm.cm.

Contact pressure of the charging blade against the photosensitive drum=50 g/cm.

Voltage applied to the charging blade:

DC 500 V; AC 1800 Vpp and f=300 Hz.

Example 14

100 wt. parts of the classified powder (magnetic toner) of Example 10 was dry-blended with 1.0 wt. parts of hydrophobic oil-treated titanium oxide fine powder ($S_{BET}$=150 m$^2$/g) to obtain a magnetic toner J. The resultant magnetic toner J showed properties as given in Table 9 appearing hereinafter.

The magnetic toner J was subjected to a printing test in various environments in a similar manner as in Example 12. As a result, the surfaces of the charging member and the photosensitive drum after the printing test were free from scars or abrasion but were accompanied with very slight sticking of the toner. However, the image qualities were of no problem, and good successive image forming characteristics were exhibited.

Example 15

100 wt. parts of the classified powder (magnetic toner) of Example 11 was dry-blended with 1.2 wt. parts of hydrophobic titanium oxide fine powder ($S_{BET}$=150 m$^2$/g) to obtain a magnetic toner K. The resultant magnetic toner K showed properties as given in Table 9 appearing hereinafter.

The magnetic toner K was subjected to a printing test in various environments in the same manner as in Example 12.

As a result, good images were formed free from a density difference under any environmental conditions. Further, the surfaces of the charging member and the photosensitive member were free from scars or abrasion, or further sticking of residual toner, and good successive image formation characteristics were exhibited.

TABLE 9

| | Toner No. | Molecular weight distribution* LMW-side peak value ×$10^4$ | HMW-side peak value ×$10^4$ | A (≧$10^6$) (%) | MI (g/10 min.) | THF-insoluble (wt. %) | Dynamic viscoelasticities G" (dyn/cm$^2$) 150° C. | 200° C. | $\tan\delta_{150}/\tan\delta_{200}$ |
|---|---|---|---|---|---|---|---|---|---|
| Ex. 12 | H | 0.95 | 85 | 5.0 | 12.5 | 0.7 | $2.2 \times 10^4$ | $8.6 \times 10^3$ | 1.3 |
| 13 | I | 0.42 | 80 | 8.7 | 5.1 | 1.1 | $3.2 \times 10^4$ | $1.4 \times 10^4$ | 1.1 |
| 14 | J | 2.5 | 81 | 3.1 | 23.0 | 0.5 | $7.7 \times 10^3$ | $1.9 \times 10^4$ | 1.9 |
| 15 | K | 0.95 | 62 | 9.6 | 18.1 | 1.6 | $1.1 \times 10^4$ | $2.8 \times 10^3$ | 1.5 |

Production Example 12 for resin composition

Synthesis of low-molecular weight polymer (L-8)

200 wt. parts of xylene was placed in a reaction vessel and heated to a reflux temperature. Under the refluxing condition, a mixture of 84 wt. parts of styrene, 16 wt. parts of butyl acrylate and 4 wt. parts of di-tertbutyl peroxide was added and the solution polymerization was completed in 6 hours to obtain a solution of a low-molecular weight polymer (L-8).

A part of the polymer solution was sampled and dried under a reduced pressure to recover the low-molecular weight polymer (L-8), which was then subjected to GPC (gel permeation chromatography) and measurement of glass transition temperature (Tg). As a result, the polymer (L-8) showed a weight-average molecular weight (Mw) of 11,500, a number-average molecular weight (Mn) of 3,900, a peak molecular weight (PMW) of 7,600, and a Tg of 56° C.

The polymer conversion at that time was 97%.

Synthesis of high-molecular weight polymer (H-13)

In a reaction vessel, 200 wt. parts of degassed water, 0.2 wt. part of polyvinyl alcohol, 70 wt. parts of styrene, 25 wt. parts of butyl acrylate, 5 wt. parts of monobutyl maleate, 0.003 wt. part of divinylbenzene and 0.1 wt. part of 2,2-bis (4,4-di-tert-butylperoxycyclohexyl)propane (a 10 hour-halflife temperature ($T_{10h}$)=92° C.) were blended to form a suspension liquid.

The suspension liquid was heated and held at 85° C. in a nitrogen atmosphere for 24 hours, and then, 0.1 wt. part of benzoyl peroxide ($T_{10h}$=72° C.) was added, and the system was further held at the temperature for 12 hours to complete the polymerization.

To the suspension liquid after the reaction, an NaOH aqueous solution in an amount of 2 times equivalent to the acid value (AV=7.4) of the resultant high-molecular weight polymer (H-13) was added, and the system was stirred for 2 hours.

The resultant high-molecular weight polymer (H-13) was filtered out, washed with water, dried and, as a result of measurement, showed Mw=$1.55\times10^6$, PMW=$0.73\times10^6$ and Tg=62° C.

Production of binder resin

In a reaction vessel, 100 wt. parts of xylene, 25 wt. parts of the above high-molecular weight polymer (H-13) and 4 wt. parts of polypropylene (Mw=6,000) were placed and heated and stirred under reflux to effect preliminary dissolution. The system was retained for 12 hours in the state to obtain a preliminary solution (Y-7) wherein the polymer H-13 and the polypropylene were uniformly mixed.

A part of the preliminary solution was sampled and dried under a reduced pressure to recover a solid matter which showed Tg of 61° C.

Separately, 225 wt. parts of the above-mentioned uniform solution of low-molecular weight polymer (L-8) was placed in another vessel and refluxed.

The above preliminary solution (Y-7) and low-molecular weight polymer (L-8) solution were blended under reflux, followed by distilling-off of the organic solvent to recover a resin, which was then cooled and, after being solidified, pulverized to obtain a resin composition (XII).

As a result of the measurement, the resin composition (XII) showed $P_1$MW (first peak molecular weight)=8400 and $P_2$MW (second peak molecular weight)=$0.97\times10^6$, an areal percentage occupied by a molecular weight portion of $10^6$ or above on its GPC chromatogram (A(≧$10^6$))=9.1%, Tg=56.0° C., and a THF-insoluble content of 2.2 wt. %.

Production Example 13 for resin composition

A resin composition (XIII) was prepared in the same manner as in Example 12 except that Production of binder resin was effected by using 35 wt. parts of the high-molecular weight polymer (H-13) and 195 wt. parts of the low-molecular weight polymer The resin composition (XIII) showed $P_1$MW=8,500, $P_2$MW=$1.1\times10^6$, A(≧$10^6$)=14.0%, Tg=57.5° C. and a THF-insoluble content=2.3 wt. %.

Production Example 14 for resin composition

Synthesis of low-molecular weight polymer (L-9)

A low-molecular weight polymer (L-9) solution was prepared in the same manner as in Synthesis of low-molecular weight (L-8) in Production Example 12 except that the starting monomer mixture was changed to one of 88 wt. parts of styrene, 12 wt. parts of butyl acrylate, and 2 wt. parts of di-tert-butyl peroxide.

A part of the polymer solution was sampled and dried under a reduced pressure to recover the low-molecular weight polymer (L-9). The polymer (L-9) showed Mw=12,200, Mn=4,500, PMW=10,100, and Tg=65° C. The polymer conversion was 98%.

Production of binder resin

A resin composition (XIV) was prepared in the same manner as in the preparation of the resin composition (XII) in Example 12 except for using 25 wt. parts of the high-molecular weight polymer (H-13) and 225 wt. parts of the low-molecular weight polymer (L-9).

The resin composition (XIV) showed $P_1$MW=10,600, $P_2$MW=$0.97\times10^6$, A(≧$10^6$)=9.8%, Tg=64.3° C. and a THF-insoluble content=2.1 wt. %.

Production Example 15 for resin composition

Synthesis of high-molecular weight polymer (H-14)

A high-molecular weight polymer (H-14) suspension liquid was prepared in the same manner as in Synthesis of high-molecular weight polymer (H-13) except that the styrene was used in 67 wt. parts, the butyl acrylate was used in 28 wt. parts, and the 2,2bis(4,4-di-tert-butylperoxycyclohexyl)propane was used in 0.2 wt. part.

To the suspension liquid after the reaction, an NaOH aqueous solution in an amount of 2 times equivalent to the acid value (AV=7.8) of the resultant high-molecular weight polymer (H-14) was added, and the system was stirred for 2 hours.

The resultant high-molecular weight polymer (H-14) was filtered out, washed with water, dried and, as a result of measurement, showed Mw=$1.38\times10^6$, PMW=$0.53\times10^6$ and Tg=56° C.

Production of binder resin

A resin composition (XV) was prepared in the same manner as in the preparation of resin component (XII) in Example 12 except for using 25 wt. parts of the high-molecular weight polymer (H-14) and 225 wt. parts of the low-molecular weight polymer (L-9).

The resin composition (XV) showed $P_1$MW=10,600, $P_2$MW=$0.55\times10^6$, A(≧$10^6$)=6.8%, Tg=59° C. and a THF-insoluble content=1.2 wt. %.

Comparative Production Example 8 for resin composition

Synthesis of high-molecular weight polymer (H-15)

A high-molecular weight polymer (H-15) suspension liquid was prepared in the same manner as in Synthesis of high-molecular weight polymer (H-13) except that no monobutyl maleate was used and the styrene was used in 76 wt. parts and the butyl acrylate was used in 24 wt. parts.

The resultant high-molecular weight polymer (H-15) was filtered out, washed with water, dried and, as a result of measurement, showed Mw=$0.925\times10^6$, PMW=$0.65\times10^6$ and Tg=62° C.

Production of binder resin

A resin composition (viii) was prepared in the same manner as in the preparation of resin component (XII) in Example 12 except for using 25 wt. parts of the high-molecular weight polymer (H-15) and 225 wt. parts of the low-molecular weight polymer (L-8).

The resin composition (viii) showed $P_1$MW=8,400, $P_2$MW=$0.69\times10^6$, A(≧$10^6$)=1.5%, Tg=58.3° C. and a THF-insoluble content=0.9 wt. %.

Comparative Production Example 9 for resin composition

Synthesis of high-molecular weight polymer (H-16)

A high-molecular weight polymer (H-16) suspension liquid was prepared in the same manner as in Synthesis of high-molecular weight polymer (H-13) except that the styrene was used in 64 wt. parts, the butyl acrylate was used in 31 wt. parts, and the polymerization initiator comprised only 0.2 wt. part of benzoyl peroxide.

To the suspension liquid after the reaction, an NaOH aqueous solution in an amount of 2 times equivalent to the acid value (AV=10.8) of the resultant high-molecular weight polymer (H-16) was added, and the system was stirred for 2 hours.

The resultant high-molecular weight polymer (H-16) was filtered out, washed with water, dried and, as a result of measurement, showed Mw=$0.915\times10^6$, PMW=$0.37\times10^6$ and Tg=51° C.

Production of binder resin

A resin composition (ix) was prepared in the same manner as in the preparation of resin component (XII) in Example 12 except for using 25 wt. parts of the high-molecular weight polymer (H-16) and 225 wt. parts of the low-molecular weight polymer (L-9).

The resin composition (ix) showed $P_1$MW=10,800, $P_2$MW=$0.37\times10^6$, A(≧$10^6$)=6.5%, Tg=58.2° C. and a THF-insoluble content=0.9 wt. %.

Comparative Production Example 10 for resin composition

Synthesis of low-molecular weight polymer (L-10)

A low-molecular weight polymer (L-10) solution was prepared in the same manner as in Synthesis of low-molecular weight polymer (L-8) except that the styrene was used in 82 wt. parts, the butyl acrylate was used in 18 wt. parts and the di-tertbutyl peroxide was used in 0.9 wt. part.

A part of the polymer solution was sampled and dried under a reduced pressure to recover the low-molecular weight polymer (L-10) which showed Mw=29,000, Mn=9,500, PMW=28,200 and Tg=65° C.

Production of binder resin

A resin composition (x) was prepared in the same manner as in Example 12 except that Production of binder resin was effected by using 30 wt. parts of the high-molecular weight polymer (H-13) and 210 wt. parts of the low-molecular weight polymer (L-10).

The resin composition (x) showed $P_1$MW=32,000, $P_2$MW=$1.1\times10^6$, A(≧$10^6$)=10.1%, Tg=63.5° C. and a THF-insoluble content=2.2 wt. %.

The binder resin compositions (XII)–(XV) and (viii)–(x) prepared in the above Production Examples 12–15 and Comparative Production Examples 8–10 showed properties as shown in the following Table 10.

TABLE 10

Properties of binder resin composition

| | High-molecular weight polymer | | | | | Low-molecular weight polymer | | | | | Blend ratio | Binder resin composition | | | | |
|---|---|---|---|---|---|---|---|---|---|---|---|---|---|---|---|---|
| Binder | PMW | Mw ×$10^4$ | PWM ×$10^4$ | Tg (° C.) | A/B*1 | PMW | Mw ×$10^4$ | Mn ×$10^4$ | PWM ×$10^4$ | Tg (° C.) | Low/High | $P_1$MW ×$10^4$ | $P_2$MW ×$10^4$ | A (≧$10^6$) (%) | Tg (° C.) | THF-insoluble (%) |
| (XII) | (H-13) | 155 | 73 | 62 | 1667 | (L-8) | 1.15 | 0.39 | 0.76 | 56 | 75/25 | 0.84 | 97 | 9.1 | 56.0 | 2.2 |
| (XIII) | (H-13) | 155 | 73 | 62 | 1667 | (L-8) | 1.15 | 0.39 | 0.76 | 56 | 65/35 | 0.85 | 110 | 14.0 | 57.5 | 2.3 |
| (XIV) | (H-13) | 155 | 73 | 62 | 1667 | (L-9) | 1.22 | 0.45 | 1.01 | 65 | 75/25 | 1.06 | 97 | 9.8 | 64.3 | 2.1 |
| (XV) | (H-14) | 138 | 53 | 56 | 1667 | (L-9) | 1.22 | 0.45 | 1.01 | 65 | 75/25 | 1.06 | 55 | 6.8 | 59.0 | 1.2 |
| (viii) | (H-15) | 92.5 | 65 | 62 | 0 | (L-8) | 1.15 | 0.39 | 0.76 | 56 | 75/25 | 0.84 | 69 | 1.5 | 58.3 | 0.9 |
| (ix) | (H-16) | 91.5 | 37 | 51 | 1667 | (L-9) | 1.22 | 0.45 | 2.01 | 65 | 75/25 | 1.08 | 37 | 2.1 | 58.2 | 0.9 |
| (x) | (H-13) | 155 | 73 | 62 | 1667 | (L-10) | 2.9 | 0.95 | 2.82 | 65 | 70/30 | 3.2 | 110 | 10.1 | 63.5 | 2.2 |

*1In A/B, A represents a monomer unit having at least one of carboxyl group, carboxylic acid salt group and carboxylic anhydride group, and B represents a crosslinking monomer unit.

Example 16

| | |
|---|---|
| Binder resin composition (XII) | 100 wt. parts |
| Magnetic fine powder (Dav. = 0.2 μm) | 100 wt. parts |
| Negatively chargeable monoazo-pigment | 0.6 wt. part |

The above blend was melt-kneaded through a twin-screw extruder (L/D=30) heated at 130° C. The kneaded product was cooled, coarsely crushed by a hammer mill and finely pulverized by a jet mill. The pulverized product was classified pneumatically to obtain magnetic resin particles having a weight-average particle size of 6.7 μm.

The magnetic resin particles in an amount of 100 wt. parts were dry-blended with 1.2 wt. parts of silica fine powder to obtain a magnetic toner.

The resultant magnetic toner showed properties as given in Table 11 below.

The above prepared magnetic toner as a developer was charged in a laser beam printer having a structure as shown in FIG. 13 and subjected to a printing test. The resultant images were evaluated, and simultaneously the states of the developer-carrying member, the photosensitive and the elastic layer-thickness regulating member were observed to evaluate the successive image forming performances.

Referring to FIG. 13, the laser beam printer used had a photosensitive member 3 having a diameter of 24 mm and rotating at a speed of 36.0 mm/sec. The photosensitive member 3 was uniformly charged to a dark part potential Vd=−600 V by a charging roller 72 (the bias application means therefor being omitted from showing). Then, the photosensitive member was exposed imagewise to provide a light-part potential Vl=−150 V, thereby forming an electrostatic latent image. The latent image was developed with a negative toner 13 by a developing apparatus to form a toner image. The toner image on the photosensitive member 3 was transferred to a transfer-receiving member by a transfer roller 40 (the bias application means therefor being omitted from showing). The residual toner on the photosensitive member was removed by a cleaner 58. The above steps were repeated to effect repetitive image formation.

The developing apparatus had a structure as shown in FIG. 12.

The toner 13 was contained in the developer container 2. In the container, a stirring member 101 having an arm 101*a* was disposed and the arm was moved reciprocally accompanying the rotation of a developer-carrying member 6, thereby to slidably move a plate-like developer-feeding member 101*b*. As a result, the toner in the container 2 was stirred and supplied to the developer-carrying member 6. The developer-carrying member 6 comprised a 12 mm-dia. aluminum tube, which had been blasted with definite-shaped particles (glass beads, 80% or more of which had diameters in the range of 53–62 mm) to have an uneven surface comprising sphere-traced concavities (diameter=53–62 μm, unevenness pitch=33 μm and surface roughness d=2.0 μm) and then coated with a layer of the above-described Prescription Example 1. The toner on the developer-carrying member 6 was attracted to the member 6 by a magnet roller 15 (developer conveying pole $S_2$=700 G) and conveyed accompanying the rotation of the member 6 at 54.0 mm/sec, which was 1.5 times the peripheral rotation speed of the photosensitive member 3.

A uniform toner layer was formed on the developer-carrying member by the action of an elastic blade 16 and was also imparted with a charge. The elastic blade 16 comprised a 1.2 mm-thick urethane rubber blade bonded to a supporting metal plate and showed a storage modulus E'=6.8×10$^6$ Pa, a loss modulus E"=3.7×10$^6$ Pa, a length change percentage of 2% between 10° C. and 60° C., and a loss modulus ratio $E''_{10}/E''_{60}$=13.4. The elastic blade 16 was pressed against the developer-carrying member 6 at a drawing pressure of 12 g/cm, and the blade free end was disposed 2.0 mm-distant from the position of the blade pressed to the member 6.

The photosensitive member 3 and the developer-carrying member 6 were disposed opposite to each other with a spacing SD=320 μm at the closest position. At the time of image formation (image region), the developing sleeve 6 was supplied with an AC bias of Vpp=−1200 V and f=1800 Hz superposed with a DC bias of $V_C$=−400 V for development.

The results of the printing test are summarized in Table 12.

Example 17

A magnetic toner was prepared in the same manner as in Example 16 except for using the binder resin composition (XIII) and as subjected to a printing test in the same manner as in Example 16.

The properties of the toner are summarized in Table 11 and the results of the printing test are summarized in Table 12.

Example 18

A magnetic toner was prepared in the same manner as in Example 16 except for using the binder resin composition (XIV) and was subjected to a printing test in the same manner as in Example 16.

The properties of the toner are summarized in Table 11 and the results of the printing test are summarized in Table 12.

Example 19

| | |
|---|---|
| Binder resin composition (XV) | 100 wt. parts |
| Magnetic fine powder | 100 wt. parts |
| Negatively chargeable azo-iron oxide | 2 wt. parts |

A magnetic toner was prepared starting from the above blend otherwise in the same manner as in Example 16.

The magnetic toner was subjected to a printing test in the same manner as in Example 16 except that the developer-carrying member had a coating formed from the above-mentioned Prescription Example 2.

The properties of the toner are summarized in Table 11 and the results of the printing test are summarized in Table 12.

Comparative Example 8

A magnetic toner was prepared in the same manner as in Example 16 except for using the binder resin composition (viii) and was subjected to a printing test in the same manner as in Example 16.

The properties of the toner are summarized in Table 11 and the results of the printing test are summarized in Table 12.

Comparative Example 9

A magnetic toner was prepared in the same manner as in Example 16 except for using the binder resin composition (ix) and was subjected to a printing test in the same manner as in Example 16.

The properties of the toner are summarized in Table 11 and the results of the printing test are summarized in Table 12.

Comparative Example 10

A magnetic toner was prepared in the same manner as in Example 16 except for using the binder resin composition (x) and was subjected to a printing test in the same manner as in Example 16.

The properties of the toner are summarized in Table 11 and the results of the printing test are summarized in Table 12.

The image quality of the printed images in Table 2 was determined as an overall evaluation of toner scattering, roughening of image and fog on the printed images.

TABLE 11

| Toner particles | | | | | |
|---|---|---|---|---|---|
| | Molecular weight distribution | | | | |
| | $P_1MW$ ($\times 10^4$) | $P_2MW$ ($\times 10^4$) | A ($\geqq 10^6$) (%) | MI (g/10 min) | THF-insoluble (wt. %) |
| Ex. 16 | 0.804 | 70 | 4.9 | 23.1 | 0.9 |
| 17 | 0.846 | 80 | 8.2 | 5.6 | 1.3 |
| 18 | 1.08 | 70 | 4.3 | 11.5 | 1.0 |
| 19 | 0.943 | 36 | 3.5 | 19.9 | 0.5 |
| Comp. Ex. 8 | 0.801 | 42 | 1.2 | 46.8 | 0.2 |
| 9 | 1.04 | 30 | 1.0 | 20.0 | 0.2 |
| 10 | 3.03 | 80 | 8.1 | 3.5 | 0.9 |

TABLE 12

| Printing test results | | | | | |
|---|---|---|---|---|---|
| | Printed image evaluation | | Durability of members | | |
| | Image density | Image quality | Sleeve | Photosensitive member | Elastic blade |
| Ex. 16 | ◎ | ◎ | Δ | Δ | ○ |
| 17 | ◎ | ○ | Δ | Δ | ○ |
| 18 | ◎ | ◎ | ◎ | ◎ | ◎ |
| 19 | ○ | ○ | ○ | Δ | ○ |
| Comp. Ex. 8 | X | Δ | X | X | X |
| 9 | Δ | X | X | X | X |
| 10 | Δ | Δ | X | X | X |

What is claimed is:

1. An image forming method, comprising:

a charging step of disposing a charging member in contact with a member to be charged and applying a voltage to the charging member, thereby charging the member to be charged, a step of forming an electrostatic image on the charged member to be charged, a step of developing the electrostatic image with a toner to form a toner image on the member to be charged, a transfer step of transferring the toner image on the member to be charged to a transfer-receiving material, and a cleaning step of cleaning the surface of the member to be charged after the transfer step;

wherein the toner comprises a composition comprising polymer components, a colorant and a metal-containing organic compound, wherein the composition shows a melt index (at 125° C., 10 kg-load) of 5–25 g/10 min., and the polymer components are characterized by (a) having a THF (tetrahydrofuran)-insoluble content from 0 to 5 wt. %, (b) including a THF-soluble content thereof providing a GPC (gel permeation chromatography) chromatogram showing i) a main peak in a molecular weight region of $2\times10^3$–$3\times10^4$, and a sub-peak or shoulder in a molecular weight region of at least $10^5$, and ii) an areal percentage of 3–10% in a molecular weight region of at least $10^6$, and (c) including a polymer component (H) providing the sub-peak or shoulder in the molecular weight region of at least $10^5$ obtained by polymerization using a polyfunctional polymerization initiator and a monofunctional polymerization initiator, said polymer component (H) comprising a monomer unit (A) having at least one species of carboxyl group, carboxylic acid salt group or carboxylic anhydride group.

2. The image forming method according to claim 1, wherein said charging member comprises at least a surface layer contacting the member to be charged and an elastic layer below the surface layer; said surface layer comprises a surface resin and an insulating metal oxide dispersed therein and is electro-semiconductive.

3. The image forming method according to claim 2, wherein the charging member is characterized by features that a) the metal oxide contained in the surface layer has a volume resistivity R' satisfying $R' \geqq 1\times10^{12}$ ohm.cm, and the surface resin has a volume resistivity R" satisfying $R''=1\times10^7$–$1\times10^{11}$ ohm.cm, b) the surface layer has a maximum roughness $R_{max}$ in the range of 10–100 μm, and c) the elastic layer has a volume resistivity Rd in the range of $1\times10^2$–$1\times10^{10}$ ohm.cm.

4. The image forming method according to claim 1, wherein the cleaning member is contacted at a linear pressure P, shows a length change rate dL, and has a storage modulus E', a loss modulus E" and a ratio $E''_{10}/E''_{60}$ which is a ratio of the E" between 10° C. and 60° C., respectively satisfying:

$$R=25\text{–}60 \text{ g-f/cm},$$

$$dL \leqq 10\%,$$

$$E'=5\times10^6\text{–}5\times^7 \text{ Pa},$$

$$E'' \geqq 1\times10^5 \text{ Pa},$$

and $$E''_{10}/E''_{60}=3\text{–}50.$$

5. The image forming method according to claim 1, wherein the toner has dynamic visco-elasticities including a dynamic loss modulus (G") and a dynamic loss tangent (tan δ) which is a ratio of G" to a dynamic storage modulus (G') at 200° C. and 150° C. satisfying the following conditions:

$$1 \leqq \tan\delta_{150}/\tan\delta_{200} \leqq 2,$$

$$10^3 \text{ dyn/cm}^2 \leqq G''_{200} \leqq G''_{150} \leqq 10^5 \text{ dyn/cm}^2.$$

6. A process cartridge detachably mountable to a main assembly of an image forming apparatus, comprising:

an electrostatic image-bearing member; and developing means integrally supported with the electrostatic image-bearing member to form the process cartridge;

said developing means including a developer-carrying member for carrying a developer layer thereon, and elastic regulating member for exerting an elastic force onto the developer layer on the developer-carrying member to regulate a thickness of the developer layer, a developer container for containing the developer to be supplied to the developer-carrying member, and a stirring means for stirring the developer disposed in the developer container;

wherein said developer comprises at least a toner which is of a composition comprising polymer components, a colorant and a metal-containing organic compound, wherein the composition shows a melt index (at 125° C., 10 kg-load) of 5–25 g/10 min., and the polymer components are characterized by (a) having a THF (tetrahydrofuran)-insoluble content from 0 to 5 wt. %, (b) including a THF-soluble content thereof providing a GPC (gel permeation chromatography) chromatogram showing i) a main peak in a molecular weight region of $2\times10^3$–$3\times10^4$, and a sub-peak or shoulder in a molecular weight region of at least $10^5$, and ii) an areal percentage of 3–10% in a molecular weight region of at least $10^6$, and (c) including a polymer component (H) providing the sub-peak or shoulder in the molecular weight region of at least $10^5$ obtained by polymerization using a polyfunctional polymerization initiator and a monofunctional polymerization initiator, said polymer component (H) having at least one species of carboxyl group, carboxylic acid salt group or carboxylic anhydride group.

7. The process cartridge according to claim 6, wherein said developer carrying member has an outer diameter of at most 15 mm and has an uneven surface which comprises a plurality of sphere-traced concavities formed by blasting with definite-shaped particles and is further coated with a resin film containing crystalline graphite, said sphere-traced concavities having a diameter of 20–250 μm and being formed at a pitch of 2–100 μm to provide a surface roughness of 0.1–5 μm.

8. The process cartridge according to claim 6, wherein the elastic regulating member contacts the developer-carrying member at a drawing pressure of 10–15 g/cm and satisfies viscoelastic properties inclusive of a storage modulus E' in a range of $5\times10^6$–$5\times10^7$ Pa, a loss modulus E" of at least $1\times10^5$ Pa, a change in length of at most 10% between 10 and 60° C., and a ratio $E''_{10}/E''_{60}$ in the range of 3–50 between the loss modulus $E''_{10}$ at 10° C. and the loss modulus $E''_{60}$ at 60° C.

9. The process cartridge according to claim 6, wherein said stirring means moves along with the rotation of the developer-carrying member and comprises a plate-like toner-feeding member which is disposed to be slidably reciprocated along the bottom of the developer container.

10. An image forming method, comprising:

a charging step of disposing a charging member in contact with a member to be charged and applying a voltage to the charging member, thereby charging the member to be charged, a step of forming an electrostatic image on the charged member to be charged, a step of developing the electrostatic image with a toner to form a toner image on the member to be charged, a transfer step of transferring the toner image on the member to be charged to a transfer receiving material, and a cleaning step of cleaning the surface of the member to be charged after the transfer step;

wherein the toner comprises a composition comprising polymer components, a colorant and a metal-containing organic compound, wherein the composition shows a melt index (at 125° C., 10 kg-load) of 5–25 g/10 min., and the polymer components are characterized by (a) having a THF (tetrahydrofuran)-insoluble content from 0 to 5 wt. %, (b) including a THF-soluble content thereof providing a GPC (gel permeation chromatography) chromatogram showing i) a main peak in a molecular weight region of $2\times10^3$–$3\times10^4$, and a sub-peak or shoulder in a molecular weight region of at least $10^5$, and ii) an areal percentage of 3–10% in a molecular weight region of at least $10^6$, and (c) including a polymer component (H) providing the sub-peak or shoulder in the molecular weight region of at least $10^5$ obtained by polymerization using a polyfunctional polymerization initiator and a monofunctional polymerization initiator, said polymer component (H) comprising a monomer unit (A) having at least one species of carboxyl group, carboxylic acid salt group or carboxylic anhydride group and a cross-linking monomer unit (B) in a ratio satisfying $20<A/B<10{,}000$ by weight.

11. The image forming method according to claim 10, wherein said charging member comprises at least a surface layer contacting the member to be charged and an elastic layer below the surface layer; said surface layer comprises a surface resin and an insulating metal oxide dispersed therein and is electro-semiconductive.

12. The image forming method according to claim 11, wherein the charging member is characterized by a) the metal oxide contained in the surface layer has a volume resistivity R' satisfying $R'\geqq1\times10^{12}$ ohm.cm, and the surface resin has a volume resistivity R" satisfying $R''=1\times10^7$–$1\times10^{11}$ ohm.cm, b) the surface layer has a maximum roughness $R_{max}$ in the range of 10–100 μm, and c) the elastic layer has a volume resistivity Rd in the range of $1\times10^2$–$1\times10^{10}$ ohm.cm.

13. The image forming method according to claim 10, wherein the cleaning member is contacted at a linear pressure P. shows a length change rate dL, and has a storage modulus E', a loss modulus E" and a ratio $E''_{10}/E''_{60}$ which is a ratio of the E" between 10° C. and 60° C., respectively satisfying:

$$R=25\text{–}60 \text{ g-f/cm},$$

$$dL\leqq10\%,$$

$$E'=5\times10^6\text{–}5\times10^7 \text{ Pa},$$

$$E''\geqq1\times10^5 \text{ Pa},$$

and $$E''_{10}/E''_{60}=3\text{–}50.$$

14. The image forming method according to claim 10, wherein the toner has dynamic visco-elasticities including a dynamic loss modulus (G") and a dynamic loss tangent (tan δ) which is a ratio of G" to a dynamic storage modulus (G') at 200° C. and 150° C. satisfying the following conditions:

$$1<\tan\delta_{150}/\tan\delta_{200}\leqq 2,$$

$$10^3\ \mathrm{dyn/cm^2}\leqq G''_{200}\leqq G''_{150}\leqq 10^5\ \mathrm{dyn/cm^2}.$$

15. A process cartridge detachably mountable to a main assembly of an image forming apparatus, comprising:

an electrostatic image-bearing member; and developing means integrally supported with the electrostatic image-bearing member to form the process cartridge;

said developing means including a developer-carrying member for carrying a developer layer thereon, an elastic regulating member for exerting an elastic force onto the developer layer on the developer-carrying member to regulate a thickness of the developer layer, a developer container for containing the developer to be supplied to the developer-carrying member, and a stirring means for stirring the developer disposed in the developer container;

wherein said developer comprises at least a toner which is of a composition comprising: polymer components, a colorant and a metal-containing organic compound, wherein the composition shows a melt index (at 125° C., 10 kg-load) of 5–25 g/10 min., and the polymer components are characterized by (a) having a THF (tetrahydrofuran)-insoluble content from 0 to 5 wt. %, (b) including a THF-soluble content thereof providing a GPC (gel permeation chromatography) chromatogram showing i) a main peak in a molecular weight region of $2\times10^3$–$3\times10^4$, and a sub-peak or shoulder in a molecular weight region of at least $10^5$, and ii) an areal percentage of 3–10% in a molecular weight region of at least $10^6$, and (c) including a polymer component (H) providing the sub-peak shoulder in the molecular weight region of at least $10^5$ obtained by polymerization using a polyfunctional polymerization initiator and a monofunctional polymerization initiator, said polymer component (H) comprising a monomer unit (A) having at least one species of carboxyl group, carboxylic acid salt group or carboxylic anhydride group and a cross-linking monomer unit (B) in a ratio satisfying 20<A/B<10,000 by weight.

16. The process cartridge according to claim 15, wherein said developer carrying member has an outer diameter of at most 15 mm and has an uneven surface which comprises a plurality of sphere-traced concavities formed by blasting with definite-shaped particles and is further coated with a resin film containing crystalline graphite, said sphere-traced concavities having a diameter of 20–250 μm and being formed at a pitch of 2–100 μm to provide a surface roughness of 0.1–5 μm.

17. The process cartridge according to claim 15, wherein the elastic regulating member contacts the developer-carrying member at a drawing pressure of 10–15 g/cm and satisfies viscoelastic properties inclusive of a storage modulus E' in a range of $5\times10^6$–$5\times10^7$ Pa, a loss modulus E" of at least $1\times10^5$ Pa, a change in length of at most 10% between 10 and 60° C., and a ratio $E''_{10}/E''_{60}$ in the range of 3–50 between the loss modulus $E''_{10}$ at 10° C. and the loss modulus $E''_{60}$ at 60° C.

18. The process cartridge according to claim 15, wherein said stirring means moves along with the rotation of the developer-carrying member and comprises a plate-like toner-feeding member which is disposed to be slidably reciprocated along the bottom of the developer container.

19. The image forming method according to claim 1 or 10 wherein toner composition has dynamic visco-elasticities including a dynamic loss modulus (G") and a dynamic loss tangent (tan δ) which is a ratio of G" to a dynamic storage modulus (G') at 200° C. and 150° C. satisfying the following conditions:

$$1\leqq\tan\delta_{150}/\tan\delta_{200}\leqq 2,$$

$$10^3\ \mathrm{dyn/cm^2}\leqq G''_{200}\leqq G''_{150}\leqq 10^5\ \mathrm{dyn/cm^2}.$$

20. The image forming method according to claim 1 or 10 wherein the toner composition has a THF-insoluble content of at most 3 wt. %.

21. The image forming method according to claim 1 or 10 wherein the polymer components of the toner composition include a low-molecular weight fraction having molecular weights below $10^5$ showing an acid value of at most 3.0.

22. The image forming method according to claim 1 or 10 wherein the polymer components of the toner composition include a low-molecular weight fraction having molecular weights below $10^5$ showing an acid value of at most 1.5.

23. The image forming method according to claim 1 and 10 wherein the polymer components of the toner composition include a high-molecular weight fraction having molecular weights of at least $10^5$ showing an acid value above 3.0.

24. The image forming method according to claim 1 or 10 wherein the polymer components of the toner composition include a high-molecular weight fraction having molecular weights of at least $10^5$ showing an acid value above 5.0.

25. The image forming method according to claim 1 or 10 wherein the polymer components of the toner composition include a high-molecular weight fraction having molecular weights of at least $10^5$ containing 1–20 wt. % of a carboxyl group-containing monomer unit.

26. The image forming method according to claim 1 or 10 wherein the polymer components of the toner composition include a high-molecular weight fraction having molecular weights of at least $10^5$ containing 3–15 wt. % of a carboxyl group-containing monomer unit.

27. The image forming method according to claim 1 or 10 , wherein the polymer components of the toner composition have a glass transition temperature of 50–70° C.

28. The image forming method of claim 1 or 10, wherein the polymer components of the toner composition have a glass transition temperature of 55–65° C.

29. The image forming method of claim 1 or 10, wherein the toner composition has a melt index of 8–20 g/10 min.

30. The image forming method of claim 1 or 10, wherein the polymer component (H) of the toner composition contains at most 1 wt. % of a crosslinking monomer unit.

31. The image forming method of claim 1 or 10, wherein the polymer component (H) of the toner composition contains 0.001–0.05 wt. % of a crosslinking monomer unit.

32. The image forming method of claim 1 or 10, wherein the toner composition further comprises a low molecular weight wax having a weight average molecular weight of at most $3\times10^4$.

33. The image forming method of claim 1 or 10, wherein the toner composition contains 1–20 wt. parts of the low-molecular weight wax per 100 wt. parts of the polymer components.

34. The image forming method of claim 1 or 10, wherein the metal-containing organic compound is represented by the following formula (I):

[I]

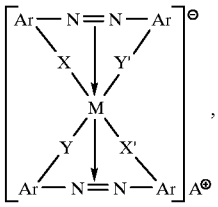

wherein M is a coordination center metal having a coordination number of 6, selected from the group consisting of Cr, Co, Ni, Mn and Fe; Ar is (i) phenyl or naphthyl optionally substituted with nitro, halogen, carboxyl, anilide or alkyl and (ii) alkoxy having 1–18 carbon atoms; X, X', Y and Y' are independently —O—, —CO—, —NH—, or —NR—, wherein R is an alkyl having 1–4 carbon atoms; and $A^{(+)}$ is hydrogen, sodium, potassium, ammonium or aliphatic ammonium.

35. The image forming method of claim 1 or 10, wherein the metal-containing organic compound is represented by the following formula (II):

[II]

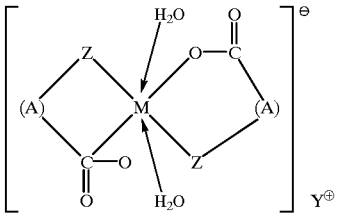

wherein M is a coordination center metal having a coordination number of 6, selected from the group consisting of Cr, Co, Ni, Mn and Fe; A is

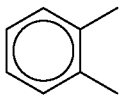

optionally substituted with an alkyl group,

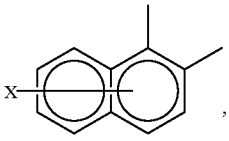

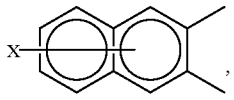

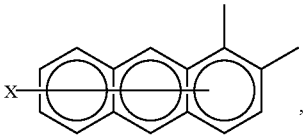

-continued

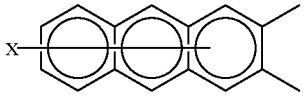

wherein X is hydrogen, alkyl, halogen or nitro,

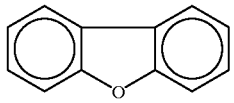

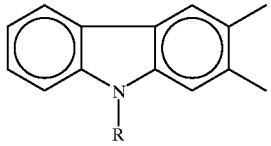

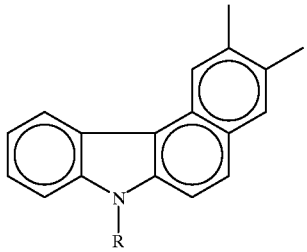

wherein R is hydrogen $C_1$–$C_{18}$ alkyl or $C_1$–$C_{18}$ alkenyl; $Y^{(+)}$ is a counter ion selected from the group consisting of hydrogen, sodium, potassium, ammonium and aliphatic ammonium; and Z is —O— or —CO.O—.

36. The process cartridge of claim 6 or 15, wherein the toner composition has dynamic visco-elasticities including a dynamic loss modulus (G") and a dynamic loss tangent (tan σ) which is a ratio of G" to a dynamic storage modulus (G') at 200° C. and 150° C. satisfying the following conditions:

$$1 \leqq \tan \sigma_{150}/\tan \sigma_{200} \leqq 2,$$

$$10^3 \text{ dyn/cm}^2 \leqq G''_{200} \leqq G''_{150} \leqq 10^5 \text{ dyn/cm}^2.$$

37. The process cartridge of claim 6 or 15, wherein the toner composition has a THF-insoluble content of at most 3 wt. %.

38. The process cartridge of claim 6 or 15, wherein the polymer components of the toner composition include a low-molecular weight fraction having molecular weights below $10^5$ showing an acid value of at most 3.0.

39. The process cartridge of claim 6 or 15, wherein the polymer components of the toner composition include a high-molecular weight fraction having molecular weights below $10^5$ showing an acid value of at most 1.5.

40. The process cartridge of claim 6 or 15, wherein the polymer components of the toner composition include a high-molecular weight fraction having molecular weights of at least $10^5$ showing an acid value above 3.0.

41. The process cartridge of claim 6 or 15, wherein the polymer components of the toner composition include a high-molecular weight fraction having molecular weights below $10^5$ showing an acid value above 5.0.

42. The process cartridge of claim 6 or 15, wherein the polymer components of the toner composition include a high-molecular weight fraction having molecular weights of at least $10^5$ containing 1–20 wt. % of a carboxyl group-containing monomer unit.

43. The process cartridge of claim 6 or 15, wherein the polymer components of the toner composition include a high-molecular weight fraction having molecular weights of at least $10^5$ containing 3–15 wt. % of a carboxyl group-containing monomer unit.

44. The process cartridge of claim 6 or 15, wherein the polymer components of the toner composition have a glass transition temperature of 50–70° C.

45. The process cartridge of claim 6 or 15, wherein the polymer components of the toner composition have a glass transition temperature of 55–65° C.

46. The process cartridge of claim 6 or 15, wherein the toner composition has a melt index of 8–20 g/10 min.

47. The process cartridge of claim 6 or 15, wherein the polymer component (H) of the toner composition contains at most 1 wt. % of a cross-linking monomer unit.

48. The process cartridge of claim 6 or 15, wherein the polymer component (H) of the toner composition contains 0.001–0.05 wt. % of a cross-linking monomer unit.

49. The process cartridge of claim 6 or 15, wherein the toner composition further comprises a low-molecular weight wax having a weight average molecular weight of at most $3\times10^4$.

50. The process cartridge of claim 6 or 15, wherein the toner composition contains 1–20 wt. parts of the low-molecular weight wax per 100 wt. parts of the polymer components.

51. The process cartridge of claim 6 or 15, wherein in the toner composition the metal-containing organic compound is represented by the following formula (I):

[I]

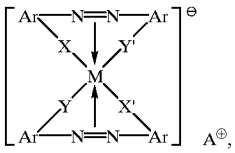

wherein M is a coordination center metal having a coordination number of 6 selected from group consisting of Cr, Co, Ni, Mn and Fe; Ar is (i) phenyl or naphthyl optionally substituted with nitro, halogen, carboxyl, anilide or alkyl and (ii) alkoxy having 1–18 carbon atoms; X, X', Y and Y' are independently —O—, —CO—, —NH—, or —NR—, wherein R is an alkyl having 1–4 carbon atoms; and $A^{(+)}$ is hydrogen, sodium, potassium, ammonium or aliphatic ammonium.

52. The process cartridge of claim 6 or 15, wherein in the toner composition the metal-containing organic compound is represented by the following formula II:

[II]

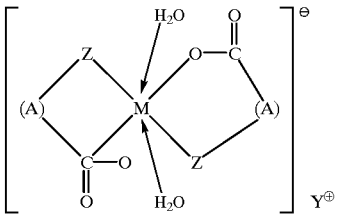

wherein M is a coordination center metal having a coordination number of 6 selected from the group consisting of Cr, Co, Ni, Mn and Fe; A is

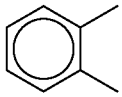

optionally substituted with an alkyl group,

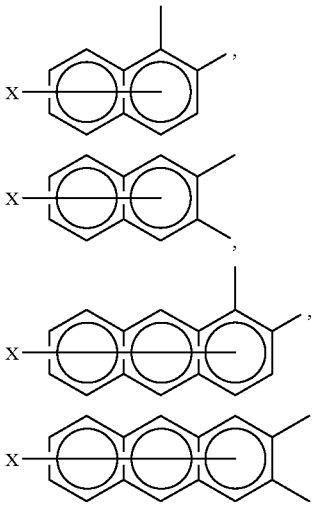

wherein X is hydrogen, alkyl, halogen or nitro,

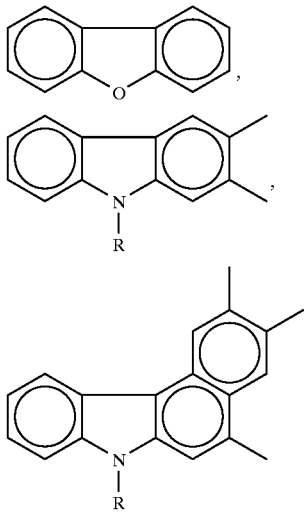

wherein R is hydrogen, $C_1$–$C_{18}$ alkyl or $C_1$–$C_{18}$ alkenyl; $Y^{(+)}$ is a counter ion selected from the group consisting of hydrogen, sodium, potassium, ammonium and aliphatic ammonium; and Z is 13 O— or —CO.O—.

* * * * *

UNITED STATES PATENT AND TRADEMARK OFFICE

CERTIFICATE OF CORRECTION

PATENT NO. : 5,942,366

DATED : August 24, 1999

INVENTOR(S) : MANABU OHNO ET AL.

It is certified that error appears in the above-identified patent and that said Letters Patent is hereby corrected as shown below:

COLUMN 7

Line 51, "GPC" should read --[GPC--;
Line 52, "ponents" should read --ponents]--; and
Line 63, "GPC" should read --[GPC--; and
"waxes" should read --waxes]--.

COLUMN 12

Line 18, "providing" should read --provides--.

COLUMN 27

Line 23, "the" should read --to-- (second occurrence).

COLUMN 28

Line 20, "changing" should read --charging--.

COLUMN 31

Line 2, "peals-to-peak" should read --peak-to-peak--.

COLUMN 62

Line 46, "10" should read --10,--; and
Line 47, "," should be deleted.

UNITED STATES PATENT AND TRADEMARK OFFICE

CERTIFICATE OF CORRECTION

PATENT NO. : 5,942,366

DATED : August 24, 1999

INVENTOR(S) : MANABU OHNO ET AL.

It is certified that error appears in the above-identified patent and that said Letters Patent is hereby corrected as shown below:

COLUMN 66

Line 60, "13" should be deleted.

Signed and Sealed this

First Day of August, 2000

*Attest:*

Q. TODD DICKINSON

*Attesting Officer*

*Director of Patents and Trademarks*